US012366142B2

(12) United States Patent
Eitschberger

(10) Patent No.: US 12,366,142 B2
(45) Date of Patent: Jul. 22, 2025

(54) MODULAR PERFORATING GUN SYSTEM

(71) Applicant: DynaEnergetics Europe GmbH, Troisdorf (DE)

(72) Inventor: Christian Eitschberger, Munich (DE)

(73) Assignee: DynaEnergetics Europe GmbH, Troisdorf (DE)

( * ) Notice: Subject to any disclaimer, the term of this patent is extended or adjusted under 35 U.S.C. 154(b) by 0 days.

(21) Appl. No.: 18/546,999

(22) PCT Filed: Feb. 28, 2022

(86) PCT No.: PCT/EP2022/055014

§ 371 (c)(1),
(2) Date: Aug. 18, 2023

(87) PCT Pub. No.: WO2022/184654

PCT Pub. Date: Sep. 9, 2022

(65) Prior Publication Data

US 2024/0125214 A1 Apr. 18, 2024
US 2025/0043665 A9 Feb. 6, 2025

Related U.S. Application Data

(60) Provisional application No. 63/309,674, filed on Feb. 14, 2022, provisional application No. 63/276,103, (Continued)

(51) Int. Cl.
*E21B 43/117* (2006.01)
*E21B 17/10* (2006.01)
(Continued)

(52) U.S. Cl.
CPC ..... *E21B 43/117* (2013.01); *E21B 17/10* (2013.01); *E21B 43/119* (2013.01); *E21B 43/11855* (2013.01)

(58) Field of Classification Search
CPC ..... E21B 47/10; E21B 43/117; E21B 43/119; E21B 43/116; E21B 43/11855; E21B 17/10
See application file for complete search history.

(56) References Cited

U.S. PATENT DOCUMENTS 2,216,359 A 10/1940 Spencer
2,228,873 A 1/1941 Hardt et al.
(Continued)

FOREIGN PATENT DOCUMENTS

AU 2010217183 B2 6/2016
CA 288787 A 4/1929
(Continued)

OTHER PUBLICATIONS

ZERO180TM Gun System Assembly and Arming Procedures, MAN-Z180-000 (R09), Owen Oil Tools, 2015-2020, 38 pages.
(Continued)

*Primary Examiner* — Yong-Suk (Philip) Ro
(74) *Attorney, Agent, or Firm* — Womble Bond Dickinson (US) LLP

(57) ABSTRACT

A system for use within a gun housing of a perforating gun may include a centralizer and a detonator holder. The centralizer may include a centralizer body and a centralizer bore extending through the centralizer body. The detonator holder may be disposed within the centralizer bore and may include a first detonator holder end configured to receive a detonator and a second detonator holder end comprising a detonator holder coupling. The detonator holder may extend through the centralizer and may be mechanically coupled to the centralizer. The centralizer may be configured to engage with an inner surface of the gun housing.

19 Claims, 28 Drawing Sheets

Related U.S. Application Data filed on Nov. 5, 2021, provisional application No. 63/271,846, filed on Oct. 26, 2021, provisional application No. 63/166,720, filed on Mar. 26, 2021, provisional application No. 63/155,902, filed on Mar. 3, 2021.

(51) Int. Cl.
*E21B 43/119* (2006.01)
*E21B 43/1185* (2006.01)

(56) References Cited

U.S. PATENT DOCUMENTS 2,296,346 A 9/1942 Hearn
2,326,406 A 8/1943 Lloyd
2,358,466 A 9/1944 Miller
2,418,486 A 4/1947 Smylie
2,439,394 A 4/1948 Lanzalotti et al.
2,519,116 A 8/1950 Crake
2,543,814 A 3/1951 Thompson et al.
2,598,651 A 5/1952 Spencer
2,621,744 A 12/1952 Toelke
2,644,530 A 7/1953 Baker
2,655,993 A 10/1953 Lloyd
2,696,258 A 12/1954 Greene
2,734,456 A 2/1956 Sweetman
2,742,857 A 4/1956 Turechek
2,755,863 A 7/1956 Stansbury et al.
2,785,631 A 3/1957 Blanchard
2,799,343 A 7/1957 Conrad
2,821,136 A 1/1958 Castel
2,889,775 A 6/1959 Owen
2,906,339 A 9/1959 Griffin
2,946,283 A 7/1960 Udry
2,982,210 A 5/1961 Andrew et al.
3,040,659 A 6/1962 Mcculleugh
RE25,407 E 6/1963 Lebourg
3,125,024 A 3/1964 Hicks et al.
3,155,164 A 11/1964 Keener
3,158,680 A 11/1964 Lovitt et al.
3,170,400 A 2/1965 Nelson
3,173,992 A 3/1965 Boop
RE25,846 E 8/1965 Campbell
3,208,378 A 9/1965 Boop
3,246,707 A 4/1966 Bell
3,264,989 A 8/1966 Rucker
3,264,994 A 8/1966 Kurt
3,303,884 A 2/1967 Medford
3,336,054 A 8/1967 Blount et al.
3,374,735 A 3/1968 Moore
3,426,849 A 2/1969 Brumble, Jr.
3,426,850 A 2/1969 Mcduffie, Jr.
3,444,810 A 5/1969 Hakala
3,504,723 A 4/1970 Cushman et al.
3,565,188 A 2/1971 Hakala
3,706,344 A * 12/1972 Vann ..... E21B 43/14 166/313
3,859,921 A 1/1975 Stephenson
4,007,790 A 2/1977 Henning
4,007,796 A 2/1977 Boop
4,039,239 A 8/1977 Cobaugh et al.
4,058,061 A 11/1977 Mansur, Jr. et al.
4,100,978 A 7/1978 Boop
4,107,453 A 8/1978 Erixon
4,132,171 A 1/1979 Pawlak et al.
4,140,188 A 2/1979 Vann
4,172,421 A 10/1979 Regalbuto
4,182,216 A 1/1980 DeCaro
4,191,265 A 3/1980 Bosse-Platiere
4,208,966 A 6/1980 Hart
4,220,087 A 9/1980 Posson
4,234,768 A 11/1980 Boop
4,266,613 A 5/1981 Boop
4,290,486 A 9/1981 Regalbuto
4,299,287 A * 11/1981 Vann ..... E21B 43/116 166/318
4,312,273 A 1/1982 Camp
4,363,529 A 12/1982 Loose
4,411,491 A 10/1983 Larkin et al.
4,457,383 A 7/1984 Boop
4,479,556 A 10/1984 Stout et al.
4,479,584 A 10/1984 Raz
4,485,741 A 12/1984 Moore et al.
4,491,185 A 1/1985 McClure
4,496,008 A 1/1985 Pottier et al.
4,512,418 A 4/1985 Regalbuto et al.
4,519,313 A 5/1985 Leidel
4,523,649 A 6/1985 Stout
4,523,650 A 6/1985 Sehnert et al.
4,534,423 A 8/1985 Regalbuto
4,566,544 A 1/1986 Bagley et al.
4,574,892 A 3/1986 Grigar et al.
4,598,775 A 7/1986 Vann et al.
4,609,057 A 9/1986 Walker et al.
4,621,396 A 11/1986 Walker et al.
4,629,001 A 12/1986 Miller et al.
4,635,734 A 1/1987 Donovan et al.
4,637,478 A 1/1987 George
4,643,097 A 2/1987 Chawla et al.
4,650,009 A 3/1987 McClure et al.
4,657,089 A 4/1987 Stout
4,660,910 A 4/1987 Sharp et al.
4,730,793 A 3/1988 Thurber, Jr. et al.
4,744,424 A 5/1988 Lendermon et al.
4,747,201 A 5/1988 Donovan et al.
4,753,170 A 6/1988 Regalbuto et al.
4,762,067 A 8/1988 Barker et al.
4,776,393 A 10/1988 Forehand et al.
4,790,383 A 12/1988 Savage et al.
4,796,708 A 1/1989 Lembcke
4,800,815 A 1/1989 Appledorn et al.
4,817,531 A 4/1989 Walker et al.
4,832,134 A 5/1989 Gill
4,852,494 A 8/1989 Williams
4,869,171 A 9/1989 Abouav
4,889,183 A 12/1989 Sommers et al.
4,919,050 A 4/1990 Dobrinski et al.
5,006,833 A 4/1991 Marlowe et al.
5,027,708 A 7/1991 Gonzalez et al.
5,033,553 A 7/1991 Miszewski et al.
5,038,682 A 8/1991 Marsden
5,040,619 A 8/1991 Jordan et al.
5,052,489 A 10/1991 Carisella et al.
5,060,573 A 10/1991 Montgomery et al.
5,088,413 A 2/1992 Huber
5,105,742 A 4/1992 Sumner
5,159,145 A 10/1992 Carisella et al.
5,159,146 A 10/1992 Carisella et al.
5,204,491 A 4/1993 Aureal et al.
5,237,136 A 8/1993 Langston
5,241,891 A 9/1993 Hayes et al.
5,322,019 A 6/1994 Hyland
5,323,684 A 6/1994 Umphries
5,334,801 A 8/1994 Mohn
5,347,929 A 9/1994 Lerche et al.
5,358,418 A 10/1994 Carmichael
5,379,845 A 1/1995 Blount et al.
5,392,851 A 2/1995 Arend
5,392,860 A 2/1995 Ross
5,436,791 A 7/1995 Turano et al.
5,503,077 A 4/1996 Motley
5,531,164 A 7/1996 Mosley
5,564,499 A 10/1996 Willis et al.
5,603,384 A 2/1997 Bethel et al.
5,648,635 A 7/1997 Lussier et al.
5,671,899 A 9/1997 Nicholas et al.
5,703,319 A 12/1997 Fritz et al.
5,756,926 A 5/1998 Bonbrake et al.
5,775,426 A 7/1998 Snider et al.
5,778,979 A 7/1998 Burleson et al.
5,785,130 A 7/1998 Wesson et al.
5,791,914 A 8/1998 Loranger et al.
5,803,175 A 9/1998 Myers, Jr. et al.

(56) References Cited

U.S. PATENT DOCUMENTS 5,816,343 A 10/1998 Markel et al.
5,820,402 A 10/1998 Chiacchio et al.
5,823,266 A 10/1998 Burleson et al.
5,837,925 A 11/1998 Nice
5,911,277 A 6/1999 Hromas et al.
5,964,294 A 10/1999 Edwards et al.
5,992,289 A 11/1999 George et al.
6,006,833 A 12/1999 Burleson et al.
6,012,525 A 1/2000 Burleson et al.
6,014,933 A 1/2000 Umphries et al.
6,056,058 A 5/2000 Gonzalez
6,070,662 A 6/2000 Ciglenec et al.
6,112,666 A 9/2000 Murray et al.
6,263,283 B1 7/2001 Snider et al.
6,269,875 B1 8/2001 Harrison, III et al.
6,297,447 B1 10/2001 Burnett et al.
6,298,915 B1 10/2001 George
6,305,287 B1 10/2001 Capers et al.
6,315,461 B1 11/2001 Cairns
6,333,699 B1 12/2001 Zierolf
6,354,374 B1 3/2002 Edwards et al.
6,378,438 B1 4/2002 Lussier et al.
6,385,031 B1 5/2002 Lerche et al.
6,386,108 B1 5/2002 Brooks et al.
6,397,947 B1 6/2002 Behrmann et al.
6,408,758 B1 6/2002 Duguet
6,412,388 B1 7/2002 Frazier
6,412,415 B1 7/2002 Kothari et al.
6,418,853 B1 7/2002 Duguet et al.
6,419,044 B1 7/2002 Tite et al.
6,439,121 B1 8/2002 Gillingham
6,464,511 B1 10/2002 Watanabe et al.
6,467,415 B2 10/2002 Menzel et al.
6,474,931 B1 11/2002 Austin et al.
6,487,973 B1 12/2002 Gilbert, Jr. et al.
6,497,285 B2 12/2002 Walker
6,506,083 B1 1/2003 Bickford et al.
6,520,258 B1 2/2003 Yang et al.
6,582,251 B1 6/2003 Burke et al.
6,595,290 B2 7/2003 George et al.
6,618,237 B2 9/2003 Eddy et al.
6,651,747 B2 11/2003 Chen et al.
6,659,180 B2 12/2003 Moss
6,675,896 B2 1/2004 George
6,679,327 B2 1/2004 Sloan et al.
6,719,061 B2 4/2004 Muller et al.
6,739,265 B1 5/2004 Badger et al.
6,742,602 B2 6/2004 Trotechaud
6,752,083 B1 6/2004 Lerche et al.
6,773,312 B2 8/2004 Bauer et al.
6,776,668 B1 8/2004 Scyoc et al.
6,779,605 B2 8/2004 Jackson
6,822,542 B2 11/2004 Clark et al.
6,837,310 B2 1/2005 Martin
6,843,317 B2 1/2005 Mackenzie
6,851,471 B2 2/2005 Barlow et al.
6,851,476 B2 2/2005 Gray et al.
6,902,414 B2 6/2005 Dopf et al.
7,000,699 B2 2/2006 Yang et al.
7,013,977 B2 3/2006 Nordaas
7,044,230 B2 5/2006 Starr et al.
7,074,064 B2 7/2006 Wallace
7,093,664 B2 8/2006 Todd et al.
7,104,323 B2 9/2006 Cook et al.
7,107,908 B2 9/2006 Forman et al.
7,114,564 B2 10/2006 Parrott et al.
7,147,068 B2 12/2006 Vail, III
7,168,494 B2 1/2007 Starr et al.
7,182,625 B2 2/2007 Machado et al.
7,193,156 B2 3/2007 Alznauer et al.
7,193,527 B2 3/2007 Hall
7,210,524 B2 5/2007 Sloan et al.
7,234,521 B2 6/2007 Shammai et al.
7,237,626 B2 7/2007 Gurjar et al.
7,243,722 B2 7/2007 Oosterling et al.
7,278,491 B2 10/2007 Scott
7,297,004 B1 11/2007 Shuhart et al.
7,306,038 B2 12/2007 Challacombe
7,347,278 B2 3/2008 Lerche et al.
7,347,279 B2 3/2008 Li et al.
7,350,448 B2 4/2008 Bell et al.
7,353,879 B2 4/2008 Todd et al.
7,357,083 B2 4/2008 Takahara et al.
7,360,487 B2 4/2008 Myers, Jr. et al.
7,364,451 B2 4/2008 Ring et al.
7,387,162 B2 6/2008 Mooney, Jr. et al.
7,404,725 B2 7/2008 Hall et al.
7,441,601 B2 10/2008 George et al.
7,455,104 B2 11/2008 Duhon et al.
7,473,104 B1 1/2009 Wertz
7,476,132 B2 1/2009 Xu
7,493,945 B2 2/2009 Doane et al.
7,510,017 B2 3/2009 Howell et al.
7,540,758 B2 6/2009 Ho
7,544,102 B2 6/2009 Oda
7,565,927 B2 7/2009 Gerez et al.
7,568,429 B2 8/2009 Hummel et al.
7,591,212 B2 9/2009 Myers, Jr. et al.
7,647,978 B2 1/2010 Scott
7,690,925 B2 4/2010 Goodman
7,726,396 B2 6/2010 Briquet et al.
7,735,578 B2 6/2010 Loehr et al.
7,736,261 B2 6/2010 Wittkopp et al.
7,752,971 B2 7/2010 Loehr
7,762,172 B2 7/2010 Li et al.
7,762,331 B2 7/2010 Goodman et al.
7,762,351 B2 7/2010 Vidal
7,775,279 B2 8/2010 Marya et al.
7,778,006 B2 8/2010 Stewart et al.
7,789,153 B2 9/2010 Prinz et al.
7,810,430 B2 10/2010 Chan et al.
7,815,440 B2 10/2010 Hsieh et al.
7,886,842 B2 2/2011 Howard et al.
7,901,247 B2 3/2011 Ring
7,908,970 B1 3/2011 Jakaboski et al.
7,929,270 B2 4/2011 Hummel et al.
7,934,453 B2 5/2011 Moore
7,980,874 B2 7/2011 Finke et al.
8,028,624 B2 10/2011 Mattson
8,061,425 B2 11/2011 Hales et al.
8,066,083 B2 11/2011 Hales et al.
8,069,789 B2 12/2011 Hummel et al.
8,074,713 B2 12/2011 Ramos et al.
8,074,737 B2 12/2011 Hill et al.
8,079,296 B2 12/2011 Barton et al.
8,091,477 B2 1/2012 Brooks et al.
8,127,846 B2 3/2012 Hill et al.
8,136,439 B2 3/2012 Bell
8,141,434 B2 3/2012 Kippersund et al.
8,151,882 B2 4/2012 Grigar et al.
8,157,022 B2 4/2012 Bertoja et al.
8,181,718 B2 5/2012 Burleson et al.
8,182,212 B2 5/2012 Parcell
8,186,259 B2 5/2012 Burleson et al.
8,230,788 B2 7/2012 Brooks et al.
8,256,337 B2 9/2012 Hill et al.
8,336,437 B2 12/2012 Barlow et al.
8,336,635 B2 12/2012 Greenlee et al.
8,387,533 B2 3/2013 Runkel
8,388,374 B2 3/2013 Grek et al.
8,395,878 B2 3/2013 Stewart et al.
8,413,727 B2 4/2013 Holmes
8,439,114 B2 5/2013 Parrott et al.
8,443,886 B2 * 5/2013 Torres ..... E21B 43/119 175/4.53
8,451,137 B2 5/2013 Bonavides et al.
8,468,944 B2 6/2013 Givens et al.
8,596,378 B2 12/2013 Mason et al.
8,661,978 B2 3/2014 Backhus et al.
8,678,666 B2 3/2014 Scadden et al.
8,684,083 B2 4/2014 Torres et al.
8,695,506 B2 4/2014 Lanclos
8,807,003 B2 8/2014 Le et al.
8,807,206 B2 8/2014 Walker

(56) References Cited

U.S. PATENT DOCUMENTS 8,833,441 B2 9/2014 Fielder et al.
8,863,665 B2 10/2014 DeVries et al.
8,869,887 B2 10/2014 Deere et al.
8,875,787 B2 11/2014 Tassaroli
8,875,796 B2 11/2014 Hales et al.
8,881,816 B2 11/2014 Glenn et al.
8,884,778 B2 11/2014 Lerche et al.
8,931,569 B2 1/2015 Fagley et al.
8,943,943 B2 2/2015 Tassaroli
8,960,093 B2 2/2015 Preiss et al.
8,960,288 B2 2/2015 Sampson
9,065,201 B2 6/2015 Borgfeld et al.
9,080,433 B2 7/2015 Lanclos et al.
9,115,572 B1 8/2015 Hardesty et al.
9,145,763 B1 9/2015 Sites, Jr.
9,145,764 B2 9/2015 Burton et al.
9,181,790 B2 11/2015 Mace et al.
9,194,219 B1 11/2015 Hardesty et al.
9,206,675 B2 12/2015 Hales et al.
9,284,819 B2 3/2016 Tolman et al.
9,284,824 B2 3/2016 Fadul et al.
9,297,242 B2 3/2016 Zhang et al.
9,317,038 B2 4/2016 Ozick et al.
9,347,755 B2 5/2016 Backhus et al.
9,359,863 B2 6/2016 Streich et al.
9,383,237 B2 7/2016 Wiklund et al.
9,428,979 B2 8/2016 Bell et al.
9,466,916 B2 10/2016 Li et al.
9,476,289 B2 10/2016 Wells
9,484,646 B2 11/2016 Thomas
9,494,021 B2 11/2016 Parks et al.
9,523,265 B2 12/2016 Upchurch et al.
9,523,271 B2 12/2016 Bonavides et al.
9,581,422 B2 2/2017 Preiss et al.
9,593,548 B2 3/2017 Hill et al.
9,598,942 B2 3/2017 Wells et al.
9,605,937 B2 3/2017 Eitschberger et al.
9,617,814 B2 4/2017 Seals et al.
9,634,427 B2 4/2017 Lerner et al.
9,677,363 B2 6/2017 Schacherer et al.
9,689,223 B2 6/2017 Schacherer et al.
9,702,211 B2 7/2017 Tinnen
9,702,680 B2 7/2017 Parks et al.
9,709,373 B2 7/2017 Hikone et al.
9,784,549 B2 10/2017 Eitschberger
9,845,666 B2 12/2017 Hardesty et al.
9,903,185 B2 2/2018 Ursi et al.
9,903,192 B2 2/2018 Entchev et al.
10,047,591 B2 8/2018 Bell et al.
10,066,921 B2 9/2018 Eitschberger
10,077,641 B2 9/2018 Rogman et al.
10,138,713 B2 11/2018 Tolman et al.
10,151,180 B2 12/2018 Robey et al.
10,188,990 B2 1/2019 Burmeister et al.
10,190,398 B2 1/2019 Goodman et al.
10,352,144 B2 7/2019 Entchev et al.
10,400,558 B1 9/2019 Shahinpour et al.
10,429,161 B2 10/2019 Parks et al.
10,458,213 B1 10/2019 Eitschberger et al.
10,598,002 B2 3/2020 Sites
10,683,703 B2 6/2020 Faircloth et al.
10,731,444 B2 8/2020 Wells et al.
10,767,430 B2 9/2020 Covalt et al.
10,900,333 B2 1/2021 Langford et al.
10,900,334 B2 1/2021 Knight et al.
10,900,335 B2 1/2021 Knight et al.
10,954,761 B2 3/2021 Von Kaenel et al.
10,982,513 B2 4/2021 Gupta et al.
11,053,782 B2 7/2021 Loehken et al.
11,078,762 B2 8/2021 Mauldin et al.
11,125,056 B2 9/2021 Parks et al.
11,713,625 B2 8/2023 Eitschberger
11,732,556 B2 8/2023 Eitschberger
2002/0020320 A1 2/2002 Lebaudy et al.
2002/0062991 A1 5/2002 Farrant et al.
2002/0185275 A1 12/2002 Yang et al.
2003/0000411 A1 1/2003 Cernocky et al.
2003/0001753 A1 1/2003 Cernocky et al.
2003/0098158 A1 5/2003 George et al.
2004/0141279 A1 7/2004 Amano et al.
2004/0211862 A1 10/2004 Elam
2004/0216633 A1 11/2004 Kash
2004/0216868 A1 11/2004 Owen
2005/0139352 A1 6/2005 Mauldin
2005/0167101 A1 8/2005 Sugiyama
2005/0173118 A1 8/2005 Li et al.
2005/0178282 A1 8/2005 Brooks et al.
2005/0183610 A1 8/2005 Barton et al.
2005/0186823 A1 8/2005 Ring et al.
2005/0194146 A1 9/2005 Barker et al.
2005/0218260 A1 10/2005 Corder et al.
2005/0229805 A1 10/2005 Myers, Jr. et al.
2005/0230099 A1 10/2005 Thomson et al.
2005/0257710 A1 11/2005 Monetti et al.
2006/0075889 A1 4/2006 Walker
2007/0084336 A1* 4/2007 Neves ..... E21B 43/119 102/305
2007/0125540 A1 6/2007 Gerez et al.
2007/0158071 A1 7/2007 Mooney, Jr. et al.
2008/0029302 A1 2/2008 Scott
2008/0047456 A1 2/2008 Li et al.
2008/0047716 A1 2/2008 McKee et al.
2008/0110612 A1 5/2008 Prinz et al.
2008/0134922 A1 6/2008 Grattan et al.
2008/0149338 A1 6/2008 Goodman et al.
2008/0173204 A1 7/2008 Anderson et al.
2008/0173240 A1 7/2008 Furukawahara et al.
2008/0264639 A1 10/2008 Parrott et al.
2008/0314591 A1 12/2008 Hales et al.
2009/0050322 A1 2/2009 Hill et al.
2009/0151588 A1 6/2009 Burleson et al.
2009/0159285 A1 6/2009 Goodman
2009/0272519 A1 11/2009 Green et al.
2009/0272529 A1 11/2009 Crawford
2009/0301723 A1 12/2009 Gray
2009/0308589 A1 12/2009 Bruins et al.
2010/0000789 A1 1/2010 Barton et al.
2010/0011945 A1 1/2010 Loehr
2010/0012774 A1 1/2010 Fanucci et al.
2010/0022125 A1 1/2010 Burris et al.
2010/0024674 A1 2/2010 Peeters et al.
2010/0089643 A1* 4/2010 Vidal ..... E21B 43/117 175/2
2010/0096131 A1 4/2010 Hill et al.
2010/0107917 A1 5/2010 Moser
2010/0163224 A1 7/2010 Strickland
2010/0206064 A1 8/2010 Estes
2010/0230104 A1 9/2010 Nölke et al.
2010/0230163 A1 9/2010 Hales et al.
2010/0252323 A1 10/2010 Goodman et al.
2010/0286800 A1 11/2010 Lerche et al.
2010/0300750 A1 12/2010 Hales et al.
2011/0024116 A1 2/2011 McCann et al.
2011/0024117 A1 2/2011 Cardenas et al.
2011/0042069 A1 2/2011 Bailey et al.
2011/0100627 A1 5/2011 Hales et al.
2011/0301784 A1 12/2011 Oakley et al.
2012/0006217 A1 1/2012 Anderson
2012/0085538 A1 4/2012 Guerrero et al.
2012/0094553 A1 4/2012 Fujiwara et al.
2012/0160483 A1 6/2012 Carisella
2012/0199031 A1 8/2012 Lanclos
2012/0199352 A1 8/2012 Lanclos et al.
2012/0241169 A1 9/2012 Hales et al.
2012/0242135 A1 9/2012 Thomson et al.
2012/0247769 A1 10/2012 Schacherer et al.
2012/0247771 A1 10/2012 Black et al.
2012/0298361 A1 11/2012 Sampson
2013/0008639 A1 1/2013 Tassaroli et al.
2013/0008669 A1 1/2013 Deere et al.
2013/0037255 A1 2/2013 Kash et al.
2013/0043074 A1 2/2013 Tassaroli
2013/0062055 A1 3/2013 Tolman et al.
2013/0112396 A1 5/2013 Splittstoeßer

(56) References Cited

U.S. PATENT DOCUMENTS

| | | | |
|---|---|---|---|
| 2013/0118342 | A1 | 5/2013 | Tassaroli |
| 2013/0133889 | A1 | 5/2013 | Schacherer et al. |
| 2013/0168083 | A1 | 7/2013 | McCarter et al. |
| 2013/0199843 | A1 | 8/2013 | Ross |
| 2013/0220614 | A1 | 8/2013 | Torres et al. |
| 2013/0248174 | A1 | 9/2013 | Dale et al. |
| 2013/0256464 | A1 | 10/2013 | Belik et al. |
| 2014/0000877 | A1 | 1/2014 | Robertson et al. |
| 2014/0033939 | A1 | 2/2014 | Priess et al. |
| 2014/0053750 | A1 | 2/2014 | Lownds et al. |
| 2014/0127941 | A1 | 5/2014 | Lu |
| 2014/0131035 | A1 | 5/2014 | Entchev et al. |
| 2014/0144702 | A1 | 5/2014 | Walker |
| 2014/0148044 | A1 | 5/2014 | Balcer et al. |
| 2014/0251612 | A1 | 9/2014 | Powers |
| 2015/0075783 | A1 | 3/2015 | Angman et al. |
| 2015/0176386 | A1 | 6/2015 | Castillo et al. |
| 2015/0226044 | A1 | 8/2015 | Ursi et al. |
| 2015/0260496 | A1 | 9/2015 | Backhus et al. |
| 2015/0285019 | A1 | 10/2015 | Wood et al. |
| 2015/0308208 | A1 | 10/2015 | Capps et al. |
| 2015/0330192 | A1 | 11/2015 | Rogman et al. |
| 2015/0345922 | A1 | 12/2015 | Lanclos et al. |
| 2016/0040520 | A1 | 2/2016 | Tolman et al. |
| 2016/0061572 | A1 | 3/2016 | Eitschberger et al. |
| 2016/0069163 | A1 | 3/2016 | Tolman et al. |
| 2016/0084048 | A1 | 3/2016 | Harrigan et al. |
| 2016/0168961 | A1 | 6/2016 | Parks et al. |
| 2016/0178333 | A1 | 6/2016 | Biggs et al. |
| 2016/0208587 | A1 | 7/2016 | Hardesty et al. |
| 2016/0273902 | A1 | 9/2016 | Eitschberger |
| 2016/0333675 | A1 | 11/2016 | Wells et al. |
| 2016/0365667 | A1 | 12/2016 | Mueller et al. |
| 2017/0030693 | A1 | 2/2017 | Preiss et al. |
| 2017/0051586 | A1 | 2/2017 | Wells et al. |
| 2017/0052011 | A1 | 2/2017 | Parks et al. |
| 2017/0052586 | A1 | 2/2017 | Nejedlo |
| 2017/0145798 | A1 | 5/2017 | Robey et al. |
| 2017/0175498 | A1 | 6/2017 | Segura |
| 2017/0211363 | A1 | 7/2017 | Bradley et al. |
| 2017/0241244 | A1 | 8/2017 | Barker et al. |
| 2017/0268860 | A1 | 9/2017 | Eitschberger |
| 2017/0314372 | A1 | 11/2017 | Tolman et al. |
| 2018/0030334 | A1 | 2/2018 | Collier et al. |
| 2018/0135398 | A1 | 5/2018 | Entchev et al. |
| 2018/0202789 | A1 | 7/2018 | Parks et al. |
| 2018/0209251 | A1 | 7/2018 | Robey et al. |
| 2018/0274342 | A1 | 9/2018 | Sites |
| 2018/0299239 | A1 | 10/2018 | Eitschberger et al. |
| 2018/0318770 | A1 | 11/2018 | Eitschberger et al. |
| 2019/0040722 | A1 | 2/2019 | Yang et al. |
| 2019/0048693 | A1 | 2/2019 | Henke et al. |
| 2019/0049225 | A1 | 2/2019 | Eitschberger |
| 2019/0195054 | A1 | 6/2019 | Bradley et al. |
| 2019/0211655 | A1 | 7/2019 | Bradley et al. |
| 2019/0264548 | A1 | 8/2019 | Zhao et al. |
| 2019/0284889 | A1 | 9/2019 | LaGrange et al. |
| 2019/0292887 | A1 | 9/2019 | Austin, II et al. |
| 2019/0316449 | A1 | 10/2019 | Schultz et al. |
| 2020/0063553 | A1 | 2/2020 | Zemla et al. |
| 2020/0072029 | A1 | 3/2020 | Anthony et al. |
| 2020/0088011 | A1 | 3/2020 | Eitschberger et al. |
| 2020/0157924 | A1 | 5/2020 | Melhus |
| 2020/0182025 | A1 | 6/2020 | Brady |
| 2020/0332630 | A1 | 10/2020 | Davis et al. |
| 2020/0362652 | A1 | 11/2020 | Eitschberger et al. |
| 2020/0362654 | A1 | 11/2020 | Eitschberger et al. |
| 2020/0378731 | A1 | 12/2020 | Mcnelis |
| 2020/0399995 | A1 | 12/2020 | Preiss et al. |
| 2021/0238966 | A1 | 8/2021 | Preiss et al. |
| 2023/0045109 | A1 | 2/2023 | Goyeneche |
| 2023/0212927 | A1 | 7/2023 | Cook et al. |

FOREIGN PATENT DOCUMENTS

| | | | |
|---|---|---|---|
| CA | 2003166 | A1 | 5/1991 |
| CA | 2821506 | A1 | 1/2015 |
| CA | 2824838 | A1 | 2/2015 |
| CA | 2888787 | A1 | 10/2015 |
| CA | 2980935 | A1 | 10/2016 |
| CA | 3101558 | A1 | 12/2019 |
| CN | 85107897 | A | 9/1986 |
| CN | 2648065 | | 10/2004 |
| CN | 2661919 | | 12/2004 |
| CN | 2821154 | | 9/2006 |
| CN | 101397890 | A | 4/2009 |
| CN | 101691837 | B | 4/2010 |
| CN | 101178005 | B | 10/2010 |
| CN | 201620848 | U | 11/2010 |
| CN | 201764910 | U | 3/2011 |
| CN | 202165062 | U | 3/2012 |
| CN | 102878877 | A | 1/2013 |
| CN | 202810806 | U | 3/2013 |
| CN | 103993861 | A | 8/2014 |
| CN | 104278976 | A | 1/2015 |
| CN | 104989335 | A | 10/2015 |
| CN | 205805521 | U | 12/2016 |
| CN | 104314529 | B | 1/2017 |
| CN | 205895214 | U | 1/2017 |
| CN | 209195375 | U | 8/2019 |
| CN | 213297926 | U | 5/2021 |
| DE | 102007007498 | | 10/2015 |
| EP | 0088516 | A1 | 9/1983 |
| EP | 132330 | B1 | 9/1988 |
| EP | 0216527 | B1 | 11/1990 |
| EP | 0416915 | A2 | 3/1991 |
| EP | 0180520 | B1 | 5/1991 |
| EP | 679859 | A2 | 11/1995 |
| EP | 0482969 | B1 | 8/1996 |
| EP | 694157 | B1 | 8/2001 |
| EP | 2702349 | B1 | 11/2015 |
| EP | 2310616 | B1 | 10/2017 |
| EP | 3277913 | A1 | 2/2018 |
| EP | 3239648 | B1 | 9/2018 |
| EP | 3478928 | B1 | 6/2021 |
| GB | 2383236 | B | 1/2004 |
| JP | 2003329399 | A | 11/2003 |
| RU | 2295694 | C2 | 3/2007 |
| RU | 78521 | U1 | 11/2008 |
| RU | 93521 | U1 | 4/2010 |
| RU | 100552 | U1 | 12/2010 |
| RU | 2434122 | C2 | 11/2011 |
| RU | 2542024 | C1 | 2/2015 |
| RU | 2561828 | C2 | 9/2015 |
| RU | 2579307 | C1 | 4/2016 |
| RU | 2633904 | C1 | 10/2017 |
| WO | 8802056 | A1 | 3/1988 |
| WO | 1988002056 | A1 | 3/1988 |
| WO | 1994009246 | A1 | 4/1994 |
| WO | 9905390 | A1 | 2/1999 |
| WO | 1999005390 | A1 | 2/1999 |
| WO | 0133029 | A3 | 5/2001 |
| WO | 0159401 | A1 | 8/2001 |
| WO | 2001059401 | A1 | 8/2001 |
| WO | 2001096807 | A2 | 12/2001 |
| WO | 2008098052 | A3 | 10/2008 |
| WO | 2009091422 | A2 | 7/2009 |
| WO | 2009091422 | A3 | 3/2010 |
| WO | 2010104634 | A2 | 9/2010 |
| WO | 2012006357 | A2 | 1/2012 |
| WO | 2012135101 | A2 | 10/2012 |
| WO | 2012106640 | A3 | 11/2012 |
| WO | 2012149584 | A1 | 11/2012 |
| WO | 2014046670 | A1 | 3/2014 |
| WO | 2014089194 | A1 | 6/2014 |
| WO | 2015006869 | A1 | 1/2015 |
| WO | 2015028204 | A2 | 3/2015 |
| WO | 2015134719 | A1 | 9/2015 |
| WO | 2016100269 | A1 | 6/2016 |
| WO | 2017062444 | A1 | 4/2017 |
| WO | 2018009223 | A1 | 1/2018 |
| WO | 2018057949 | A1 | 3/2018 |

(56) References Cited

FOREIGN PATENT DOCUMENTS

| | | | |
|---|---|---|---|
| WO | 2019071027 | A1 | 4/2019 |
| WO | 2019148009 | A2 | 8/2019 |
| WO | 2020112983 | A1 | 6/2020 |
| WO | 2020154061 | A1 | 7/2020 |
| WO | 2020232242 | A1 | 11/2020 |
| WO | 2021025716 | A1 | 2/2021 |
| WO | 2022135749 | A1 | 6/2022 |
| WO | 2022184654 | A1 | 9/2022 |

OTHER PUBLICATIONS

Velocity™ Perforating System, Plug and Play Guns for Pumpdown Operations, Halliburton, H012844WP, issued Mar. 2021, 8 pages.
Schlumberger; Fractal Flex Multistage stimulation perforating system; dated 2018; 1 page.
G&H Diversified Manufacturing, LP; Petitioner's Oral Argument Presentation for PGR No. PGR2021-00078; dated Jul. 26, 2022; 65 pages.
International Searching Authority; International Preliminary Report on Patentability of the International Searching Authority for PCT/EP2020/085624; mailed on Jun. 23, 2022; 6 pages.
SWM International, LLC and Nextier Completion Solutions Inc.; Petitioner's Reply to Patent Owner's Response to Petition for Case No. PGR2021-00097; dated Jul. 29, 2022, 36 pages.
INPI Argentina; Office Action for Application No. 20190101834; dated Aug. 22, 2022, 3 pages.
Norwegian Industrial Property Office; Office Action for NO Application No. 20180507; dated Sep. 29, 2022; 2 pages.
United States Patent and Trademark Office; Notice of Allowance for U.S. Appl. No. 16/809,729; dated Sep. 21, 2022; 7 pages.
United States Patent and Trademark Office; Notice of Allowance for U.S. Appl. No. 17/007,574; dated Sep. 26, 2022; 8 pages.
United States Patent and Trademark Office; Notice of Allowance for U.S. Appl. No. 17/352,728; dated Sep. 21, 2022; 8 pages.
United States District Court for the Southern District of Texas; Memorandum Opinion and Order for Civil Action No. H-20-2123; dated Sep. 19, 2022; 115 pages.
United States Patent and Trial Appeal Board; Final Written Decision on PGR2021-00078; issued Oct. 28, 2022; 139 pages.
Norwegian Industrial Patent Office; Approval for Grant of Norwegian Application No. 20180507 dated Oct. 18, 2023; 2 pages.
United States Patent and Trademark Office; Ex Parte Quayle Action issued in U.S. Appl. No. 17/223,899 dated Aug. 29, 2023; 6 pages.
Norwegian Industrial Patent Office; Office Action issued in Norwegian Application No. 20210799 dated Jan. 17, 2024; 3 page.
Parrott, Robert; Declaration for IPR2021-00082; dated Oct. 20, 2020; 110 pages.
Parrott, Robert; Declaration for PGR No. 2021-00078; dated May 10, 2021; 182 pages.
Patent Trial and Appeal Board; Decision Granting Patent Owner's Request for Rehearing and Motion to Amend for IPR2018-00600; dated Jul. 6, 2020; 27 pages.
Patent Trial and Appeals Board; Decision Granting Institution of Post Grant Review, PGR No. PGR2021-00097; dated Jan. 6, 2022; 92 pages.
PCT Search Report and Written Opinion, mailed May 4, 2015: See Search Report and Written opinion for PCT Application No. PCT/EP2014/065752, 12 pgs.
PerfX Wireline Services, LLC; PerfX Wireline Services, LLC's Preliminary Invalidity Contentions for Civil Action No. 1:20-CV-03665; dated Jul. 2, 2021; 4 pages.
PerfX Wireline Services, LLC; Defendant PerfX Wireline Services, LLC's Opening Claim Construction Brief; dated Oct. 18, 2021; 23 pages.
PerfX Wireline Services, LLC; Invalidity Chart for U.S. Pat. No. 10,844,697 in view of the Dynawell Gun System Exhibit A; dated Jul. 2, 2021; 42 pages.
PerfX Wireline Services, LLC; Invalidity Chart for U.S. Pat. No. 10,844,697 in view of the LRI Gun System Exhibit B; dated Jul. 2, 2021; 33 pages.
PerfX Wireline Services, LLC; Invalidity Chart for U.S. Pat. No. 10,844,697 in view of the Owen Oil Tools System Exhibit C; dated Jul. 2, 2021; 64 pages.
PerfX Wireline Services, LLC; Invalidity Chart for U.S. Pat. No. 10,844,697 in view of the Select Fire System Exhibit D; dated Jul. 2, 2021; 49 pages.
PerfX Wireline Services, LLC; Invalidity Chart for U.S. Pat. No. 10,844,697 in view of U.S. Pat. No. 10,077,641 Exhibit H; dated Jul. 2, 2021; 41 pages.
PerfX Wireline Services, LLC; Invalidity Chart for U.S. Pat. No. 10,844,697 in view of U.S. Pat. No. 4,007,796 Exhibit F; dated Jul. 2, 2021; 40 pages.
PerfX Wireline Services, LLC; Invalidity Chart for U.S. Pat. No. 10,844,697 in view of U.S. Pat. No. 5,042,594 Exhibit E; dated Jul. 2, 2021; 38 pages.
PerfX Wireline Services, LLC; Invalidity Chart for U.S. Pat. No. 10,844,697 in view of U.S. Pat. No. 9,145,764 Exhibit G; dated Jul. 2, 2021; 58 pages.
PerfX's Wireline Services, LLC; Exhibit A-1: Invalidity Chart for U.S. Pat. No. 10,844,697 in view of the Dynawell Gun System; dated Aug. 30, 2021; 30 pages.
PerfX's Wireline Services, LLC; Exhibit A-2: Invalidity Chart for U.S. Pat. No. 10,844,697 in view of the LRI Gun System; dated Aug. 30, 2021; 29 pages.
PerfX's Wireline Services, LLC; Exhibit A-3: Invalidity Chart for U.S. Pat. No. 10,844,697 in view of the Owen Oil Tools System; dated Aug. 30, 2021; 42 pages.
PerfX's Wireline Services, LLC; Exhibit A-4: Invalidity Chart for U.S. Pat. No. 10,844,697 in view of the Select Fire System; dated Aug. 30, 2021; 32 pages.
PerfX's Wireline Services, LLC; Exhibit A-5: Invalidity Chart for U.S. Pat. No. 10,844,697 in view of U.S. Pat. No. 5,042,594; dated Aug. 30, 2021; 27 pages.
PerfX's Wireline Services, LLC; Exhibit A-6: Invalidity Chart for U.S. Pat. No. 10,844,697 in view of U.S. Pat. No. 4,007,796; dated Aug. 30, 2021; 23 pages.
PerfX's Wireline Services, LLC; Exhibit A-7: Invalidity Chart for U.S. Pat. No. 10,844,697 in view of U.S. Pat. No. 9,145,764; dated Aug. 30, 2021; 36 pages.
PerfX's Wireline Services, LLC; Exhibit A-8: Invalidity Chart for U.S. Pat. No. 10,844,697 in view of U.S. Pat. No. 10,077,6414; dated Aug. 30, 2021; 29 pages.
PerfX's Wireline Services, LLC; Exhibit A-9: Invalidity Chart for U.S. Pat. No. 10,844,697 in view of the SafeJet System; dated Aug. 30, 2021; 18 pages.
PerfX's Wireline Services, LLC; Exhibit B-1: Invalidity Chart for U.S. Pat. No. D904,475 in view of the Dynawell Tandem Sub; dated Aug. 30, 2021; 10 pages.
PerfX's Wireline Services, LLC; Exhibit B-2: Invalidity Chart for U.S. Pat. No. D904,475 in view of the LRI Tandem Subassembly; dated Aug. 30, 2021; 12 pages.
PerfX's Wireline Services, LLC; Exhibit B-3: Invalidity Chart for U.S. Pat. No. D904,475 in view of the Owen Oil Tools Tandem Sub; dated Aug. 30, 2021; 10 pages.
PerfX's Wireline Services, LLC; Exhibit B-4: Invalidity Chart for U.S. Pat. No. D904,475 in view of the XConnect Tandem Sub; dated Aug. 30, 2021; 1 page.
PerfX's Wireline Services, LLC; Exhibit B-5: Invalidity Chart for U.S. Pat. No. D904,475 in view of the SafeJet Disposable Bulkhead; dated Aug. 30, 2021; 15 pages.
PerfX's Wireline Services, LLC; Exhibit B-6: Invalidity Chart for U.S. Pat. No. D904,475 in view of Chinese Patent Application No. CN110424930A; dated Aug. 30, 2021; 9 pages.
PerfX's Wireline Services, LLC; Exhibit B-7: Invalidity Chart for U.S. Pat. No. D904,475 in view of U.S. Patent Publication No. 2020/0308938; dated Aug. 30, 2021; 8 pages.
PerfX's Wireline Services, LLC; Xconnect, LLC's Preliminary Invalidity Contentions for Civil Action No. 6:21-cv-00371-ADA; dated Aug. 30, 2021; 7 pages.

(56) References Cited

OTHER PUBLICATIONS

Preiss Frank et al.; Lowering Total Cost of Operations Through Higher Perforating Efficiency while simultaneously enhancing safety; May 10, 2016; 26 pages.
Repeat Precision, LLC; Plaintiff Repeat Precision, LLC's Responsive Claim Construction Brief for Civil Action No. 6:21-cv-104-ADA, Public Version; dated Oct. 27, 2021; 21 pages.
Resilience Against Market Volatility Results Presentation; Exhibit 2015 of PGR No. 2020-00080; dated Jun. 30, 2020; 26 pages.
Robert Parrott, Case IPR2018-00600 for U.S. Pat. No. 9,581,422 B2, Declaration regarding Patent Invalidity, dated Jun. 29, 2020, 146 pages.
Rodgers, John; Claim Construction Declaration for Civil Action No. 3:21-cv-00185; dated Sep. 28, 2021; 41 pages.
Rodgers, John; Claim Construction Declaration for Civil Action No. 3:21-cv-00188; dated Sep. 28, 2021; 42 pages.
Rodgers, John; Declaration for Civil Action No. 3:20-CV-00376; dated Jul. 8, 2021; 32 pages.
Rodgers, John; Declaration for Civil Action No. 3:21-cv-00192-M; dated May 27, 2021; 42 pages.
Rodgers, John; Declaration for PGR No. 2021-00089; dated Sep. 16, 2021; 93 pages.
Rodgers, John; Declaration for PGR2020-00072; dated Oct. 23, 2020; 116 pages.
Rodgers, John; Declaration for PGR2020-00080; dated Nov. 18, 2020; 142 pages.
Rodgers, John; Declaration for PGR2021-00078; dated Aug. 19, 2021; 137 pages.
Rodgers, John; Declaration of John Rodgers, Ph.D for PGR Case No. PGR2021-00097; dated Oct. 28, 2021; 124 pages.
Rodgers, John; Videotaped Deposition of John Rodgers; dated Jul. 29, 2021; 49 pages.
Salt Warren et al.; New Perforating Gun System Increases Safety and Efficiency; dated Apr. 1, 2016; 11 pages.
Salt, et al.; New Perforating Gun System Increases Saftey and Efficiency; Journal of Petroleum Technology; dated Apr. 1, 2016; Weatherford; https://jpt.spe.org/new-perforating-gun-system-increases-safety-and-efficiency; 11 pages.
Scharf Thilo; Declaration for PGR2020-00080; dated Nov. 16, 2020; 16 pages.
Scharf, Thilo; Declaration for PGR No. 2021-00089; dated Sep. 16, 2021; 8 pages.
Hunting Energy Service, ControlFire RF Safe ControlFire® RF-Safe Manual, 33 pgs., Jul. 2016, http://www.hunting-intl.com/media/2667160/ControlFire%20RF_Assembly%20Gun%20Loading_Manual.pdf.
Hunting Titan Inc.; Petition for Post Grant Review of U.S. Pat. No. 10,429,161; dated Jun. 30, 2020; 109 pages.
Hunting Titan Inc.; Petition for Post Grant Review of U.S. Pat. No. 10,472,938; dated Aug. 12, 2020; 198 pages.
Hunting Titan Ltd,; Defendants' Answer and Counterclaims, Civil Action No. 4:19-cv-01611, consolidated to Civil Action No. 4:17-cv-03784; dated May 28, 2019; 21 pages.
Hunting Titan Ltd.; Petition for Inter Partes Review of U.S. Pat. No. 9,581,422 Case No. IPR2018-00600; dated Feb. 16, 2018; 93 pages.
Hunting Titan Ltd.; Defendants' Answer and Counterclaims, Civil Action No. 6:20-cv-00069; dated Mar. 17, 2020; 30 pages.
Hunting Titan Ltd.; Defendants' Answer to First Amended Complaint and Counterclaims, Civil Action No. 6:20-cv-00069; dated Apr. 6, 2020; 30 pages.
Hunting Titan Ltd.; Defendants' Answer to Second Amended Complaint and Counterclaims, Civil Action No. 6:20-cv-00069; dated May 12, 2020; 81 pages.
Hunting Titan Ltd.; Defendants Invalidity Contentions Pursuant to Patent Rule 3-3, Civil Action No. 4:17-cv-03784; dated Jul. 6, 2018; 29 pages.
Hunting Titan Ltd.; Defendants' Objections and Responses to Plaintiffs' First Set of Interrogatories, Civil Action No. 4:17-cv-03784; dated Jun. 11, 2018.
Hunting Titan Ltd.; Defendants' Opposition to Plaintiffs' Motion to Dismiss and Strike Defendants' Amended Counterclaim and Affirmative Defenses for Unenforceability due to Inequitable Conduct for Civil Action No. 4:17-cv-03784; dated Apr. 24, 2018; 8 pages.
Hunting Titan, Electrical Cable Heads, May 8, 2016, 4 pgs., http://www.hunting-intl.com/media/1967991/ElectricalCableHeads.pdf.
Hunting Titan, H-1 Perforating System, Sep. 1, 2017, 3 pgs., http://www.hunting-intl.com/titan/perforating-guns-and-setting-tools/h-1%C2%AE-perforating-system.
Hunting Titan, Inc.; Defendant Hunting Titan, Inc.'s Opposition to Plaintiff's Motion for Summary Judgement for Civil Action No. 4:20-cv-02123; dated Mar. 30, 2022; 37 pages.
Hunting Titan, Inc.; Defendant Hunting Titan, Inc.'s Opposed Motion for Leave to Amend Invalidity Contentions for Civil Action No. 4:20-cv-02123; dated Nov. 19, 2021; 17 pages.
Hunting Titan, Inc.; Defendant's Answer, Affirmative Defenses, and Counterclaims to Plaintiffs' Second Amended Complaint for Civil Action No. 4:20-cv-02123; dated Sep. 10, 2021; 77 pages.
Hunting Titan, Inc.; Defendant's Final Invalidity Contentions for Civil Action No. 4:20-cv-02123; dated Jan. 7, 2022; 54 pages.
Hunting Titan, Inc.; Defendant's Preliminary Invalidity Contentions for Civil Action No. 4:20-cv-02123; dated Aug. 6, 2021; 52 pages.
Hunting Titan, Inc.; Defendant's Responsive Claim Construction Brief for Civil Action No. 4:20-cv-02123; dated Oct. 1, 2021; 31 pages.
Hunting Titan, Inc.; Defendant's Supplemental Brief on Claim Construction; dated Nov. 5, 2021; 9 pages.
Hunting Titan, Inc.; Exhibit 1 to Defendant Hunting Titan, Inc.'s Opposed Motion for Leave to Amend Invalidity Contentions for Civil Action No. 4:20-cv-02123; dated Nov. 19, 2021; 64 pages.
Hunting Titan, Inc.; Exhibit 2 to Defendant Hunting Titan, Inc.'s Opposed Motion for Leave to Amend Invalidity Contentions for Civil Action No. 4:20-cv-02123; dated Nov. 19, 2021; 33 pages.
Hunting Titan, Inc.; Exhibit 3 to Defendant Hunting Titan, Inc.'s Opposed Motion for Leave to Amend Invalidity Contentions for Civil Action No. 4:20-cv-02123; dated Nov. 19, 2021; 24 pages.
Hunting Titan, Inc.; Exhibit 4 to Defendant Hunting Titan, Inc.'s Opposed Motion for Leave to Amend Invalidity Contentions for Civil Action No. 4:20-cv-02123; dated Nov. 19, 2021; 9 pages.
Hunting Titan, Inc.; Exhibit 5 to Defendant Hunting Titan, Inc.'s Opposed Motion for Leave to Amend Invalidity Contentions for Civil Action No. 4:20-cv-02123; dated Nov. 19, 2021; 5 pages.
Hunting Titan, Inc.; Exhibit 6 to Defendant Hunting Titan, Inc.'s Opposed Motion for Leave to Amend Invalidity Contentions for Civil Action No. 4:20-cv-02123; dated Nov. 19, 2021; 4 pages.
Hunting Titan, Inc.; Exhibit 7 to Defendant Hunting Titan, Inc.'s Opposed Motion for Leave to Amend Invalidity Contentions for Civil Action No. 4:20-cv-02123; dated Nov. 19, 2021; 6 pages.
Hunting Titan, Inc.; Exhibit A to Defendant's Preliminary Invalidity Contentions, Invalidity of U.S. Pat. No. 10,429,161; dated Aug. 6, 2021; 93 pages.
Hunting Titan, Inc.; Exhibit B to Defendant's Preliminary Invalidity Contentions, Invalidity of U.S. Pat. No. 10,472,938; dated Aug. 6, 2021; 165 pages.
Hunting Titan, Inc.; Exhibit C to Defendant's Final Invalidity Contentions, Invalidity of U.S. Pat. No. 10,429,161; dated Jan. 7, 2022; 3 pages.
Hunting Titan, Inc.; Exhibit D to Defendant's Final Invalidity Contentions, Invalidity of U.S. Pat. No. 10,472,938; dated Jan. 7, 2022; 6 pages.
Hunting Titan, Inc; Petitioner's Sur-Reply on Patent Owner's Motion to Amend for IPR No. 2018-00600; dated Apr. 11, 2019; 17 pages.
Hunting Titan, Wireline Hardware, Logging Instruments EBFire, TCB Systems, Gun Systems, Oct. 15, 2015, V.9.1, 72 pgs., http://www.hunting-intl.com/media/1305595/hunting-titan-complete-v9-1.pdf.
Hunting Titan, Wireline Top Fire Detonator Systems, Nov. 24, 2014, 2 pgs, http://www.hunting-intl.com/titan/perforating-guns-and-setting-tools/wireline-top-fire-detonator-systems.
Hunting Titan; Response to Canadian Office Action for CA App. No. 2,933,756; dated Nov. 23, 2017; 18 pages.

(56) References Cited

OTHER PUBLICATIONS

Industrial Property Office, Czech Republic; Office Action for CZ App. No. PV 2017-675; Jul. 18, 2018; 2 pages; Concise Statement of Relevance: Examiner's objection of CZ application claims 1, 7, and 16 based on US Pub No. 20050194146 alone or in combination with WO Pub No. 2001059401.
Industrial Property Office, Czech Republic; Office Action for CZ App. No. PV 2017-675; Oct. 26, 2018; 2 pages.
Industrial Property Office, Czech Republic; Office Action; CZ App. No. PV 2017-675; Dec. 17, 2018; 2 pages.
Intellectual Property India, Office Action of IN Application No. 201647004496, dated Jun. 7, 2019, 6 pgs.
International Bureau; International Preliminary Report on Patentability for PCT Application #PCT/EP2019/063214; dated Dec. 24, 2020; 9 pages.
International Searching Authority, International Preliminary Report on Patentability for PCT App. No. PCT/EP2014/065752; Mar. 1, 2016, 10 pgs.
International Searching Authority, International Search and Written Opinion of International App. No. PCT/EP2020/058241, dated Aug. 10, 2020, 18 pgs.
International Searching Authority, International Search Report for International App No. PCT/EP2020/063214, Jul. 29, 2020, 17 pages.
International Searching Authority; Communication Relating to the Results of the Partial International Search for PCT/EP2020/070291; Oct. 20, 2020; 8 pages.
International Searching Authority; International Preliminary Report on Patentability for PCT Appl. No. PCT/CA2014/050673; issued Jan. 19, 2016; 5 pages.
International Searching Authority; International Preliminary Report on Patentability for PCT Application No. PCT/EP2019/069165; mailed on Jan. 28, 2021; 9 pages.
International Searching Authority; International Preliminary Report on Patentability for PCT Application No. PCT/IB2019/000569; dated Jan. 28, 2021; 8 pages.
International Searching Authority; International Search Report and Written Opinion for International Application No. PCT/US19/15255; dated Apr. 23, 2019; 12 pages.
International Searching Authority; International Search Report and Written Opinion for International Application No. PCT/US2020/032879; dated Aug. 20, 2020; 9 pages.
International Searching Authority; International Search Report and Written Opinion for PCT App. No. PCT/CA2014/050673; mailed Oct. 9, 2014; 7 pages.
United States District Court for the Southern District of Texas Houston Division, Case 4:19-cv-01611 for U.S. Pat. No. 9,581,422B2, Defendant's Answers, Counterclaims and Exhibits, dated May 28, 2019, 135 pgs.
United States District Court for the Southern District of Texas Houston Division, Case 4:19-cv-01611 for U.S. Pat. No. 9,581,422B2, Plaintiff's Complaint and Exhibits, dated May 2, 2019, 26 pgs.
United States District Court for the Southern District of Texas Houston Division, Case 4:19-cv-01611 for U.S. Pat. No. 9,581,422B2, Plaintiffs' Motion to Dismiss and Exhibits, dated Jun. 17, 2019, 63 pgs.
United States District Court for the Southern District of Texas; Joint Claim Construction Statement for Civil Action No. 3:20-cv-00376; dated Jul. 8, 2021; 14 pages.
United States District Court for the Southern District of Texas; Joint Claim Construction Statement for Civil Action No. 4:20-cv-02123; dated Aug. 27, 2021; 14 pages.
United States District Court for the Western District of Texas; Order Granting in Part & Denying on Part Defendants' Motion to Dismiss for Improper Venue or to Transfer Venue Pursuant to 28 U.S.C. § 1404(a) for Civil Action No. 6:20-CV-01110-ADA; dated Aug. 5, 2021; 16 pages.
United States Patent and Trademark Office, Case IPR2018-00600 for U.S. Pat. No. 9,581,422 B2, Reply in Support of Patent Owner's Motion to Amend, dated Mar. 21, 2019, 15 pgs.
United States Patent and Trademark Office, Case IPR2018-00600 for U.S. Pat. No. 9,581,422 B2, Decision of Precedential Opinion Panel, Granting Patent Owner's Request for Hearing and Granting Patent Owner's Motion to Amend, dated Jul. 6, 2020, 27 pgs.
United States Patent and Trademark Office, Case IPR2018-00600 for U.S. Pat. No. 9,581,422 B2, DynaEnergetics GmbH & Co. KG's Patent Owner Preliminary Response, dated May 22, 2018, 47 pgs.
United States Patent and Trademark Office, Case IPR2018-00600 for U.S. Pat. No. 9,581,422 B2, Order Granting Precedential Opinion Panel, Paper No. 46, dated Nov. 7, 2019, 4 pgs.
United States Patent and Trademark Office, Case IPR2018-00600 for U.S. Pat. No. 9,581,422 B2, Patent Owner's Motion to Amend, dated Dec. 6, 2018, 53 pgs.
United States Patent and Trademark Office, Case IPR2018-00600 for U.S. Pat. No. 9,581,422 B2, Patent Owner's Opening Submission to Precedential Opinion Panel, dated Dec. 20, 2019, 21 pgs.
United States Patent and Trademark Office, Case IPR2018-00600 for U.S. Pat. No. 9,581,422 B2, Patent Owner's Request for Hearing, dated Sep. 18, 2019, 19 pgs.
United States Patent and Trademark Office, Case IPR2018-00600 for U.S. Pat. No. 9,581,422 B2, Patent Owner's Responsive Submission to Precedential Opinion Panel, dated Jan. 6, 2020, 16 pgs.
United States Patent and Trademark Office, Case IPR2018-00600 for U.S. Pat. No. 9,581,422 B2, Patent Owner's Sur-reply, dated Mar. 21, 2019, 28 pgs.
United States Patent and Trademark Office, Case IPR2018-00600 for U.S. Pat. No. 9,581,422 B2, Petitioner's Additional Briefing to the Precedential Opinion Panel, dated Dec. 20, 2019, 23 pgs.
United States Patent and Trademark Office, Case IPR2018-00600 for U.S. Pat. No. 9,581,422 B2, Petitioner's Opposition to Patent Owner's Motion to Amend, dated Mar. 7, 2019, 30 pgs.
United States Patent and Trademark Office, Case IPR2018-00600 for U.S. Pat. No. 9,581,422 B2, Petitioner's Reply Briefing to the Precedential Opinion Panel, dated Jan. 6, 2020, 17 pgs.
United States Patent and Trademark Office, Case IPR2018-00600 for U.S. Pat. No. 9,581,422 B2, Petitioner's Reply in Inter Partes Review of U.S. Pat. No. 9,581,422, dated Mar. 7, 2019, 44 pgs.
United States Patent and Trademark Office, Final Office Action of U.S. Appl. No. 16/359,540, dated Aug. 14, 2019, 9 pages.
United States Patent and Trademark Office, Final Written Decision of Case IPR2018-00600 for U.S. Pat. No. 9,581,422 B2, Paper No. 42, dated Aug. 20, 2019, 31 pgs.
United States Patent and Trademark Office, Non-Final Office Action of U.S. Appl. No. 16/451,440, dated Oct. 24, 2019, 22 pages.
United States Patent and Trademark Office, Non-Final Office Action of U.S. Appl. No. 14/767,058, dated Jul. 15, 2016, 9 pages.
United States Patent and Trademark Office, Non-Final Office Action of U.S. Appl. No. 15/117,228, dated May 31, 2018, 9 pages.
United States Patent and Trademark Office, Non-Final Office Action of U.S. Appl. No. 15/617,344, dated Jan. 23, 2019, 5 pages.
United States Patent and Trademark Office, Non-Final Office Action of U.S. Appl. No. 15/788,367, dated Oct. 22, 2018, 6 pages.
United States Patent and Trademark Office, Non-Final Office Action of U.S. Appl. No. 15/920,800, dated Dec. 27, 2019, 6 pages.
United States Patent and Trademark Office, Non-Final Office Action of U.S. Appl. No. 15/920,812, dated Dec. 27, 2019, 6 pages.
United States Patent and Trademark Office, Non-Final Office Action of U.S. Appl. No. 15/920,812, dated May 27, 2020, 5 pages.
United States Patent and Trademark Office, Non-Final Office Action of U.S. Appl. No. 16/026,431, dated Jul. 30, 2019, 10 pages.
United States Patent and Trademark Office, Non-Final Office Action of U.S. Appl. No. 16/359,540, dated May 3, 2019, 11 pages.
United States Patent and Trademark Office, Non-Final Office Action of U.S. Appl. No. 16/455,816, dated Nov. 5, 2019, 17 pages.
United States Patent and Trademark Office, Notice of Allowance for U.S. Appl. No. 15/920,800, dated Jul. 7, 2020, 7 pages.
United States Patent and Trademark Office, Notice of Allowance for U.S. Appl. No. 16/585,790, dated Jun. 19, 2020, 16 pages.
United States Patent and Trademark Office, Office Action of U.S. Appl. No. 16/540,484, dated Oct. 4, 2019, 12 pgs.
United States Patent and Trademark Office, Office Action of U.S. Appl. No. 16/585,790, dated Nov. 12, 2019, 9 pgs.

(56) References Cited

OTHER PUBLICATIONS

United States Patent and Trademark Office, Office Action of U.S. Appl. No. 16/809,729, dated Jun. 19, 2020, 9 pgs.
United States Patent and Trademark Office, Office Action of U.S. Appl. No. 29/733,080, dated Jun. 26, 2020, 8 pgs.
United States Patent and Trademark Office, U.S. Pat. No. 438305A, issued on Oct. 14, 1890 to T.A. Edison, 2 pages.
United States Patent and Trademark Office: U.S. Pat. No. 10,458,213; dated Feb. 11, 2019; 333 pages.
United States Patent and Trademark Office; Final Office Action of U.S. Appl. No. 16/809,729, dated Nov. 3, 2020; 19 pages.
United States Patent and Trademark Office; Decision Granting Institution of Post-Grant Review 35 U.S.C. § 324 for PGR2021-00078; dated Nov. 1, 2021; 87 pages.
United States Patent and Trademark Office; Ex Parte Quayle Action for U.S. Appl. No. 16/809,729; dated Jun. 20, 2022; 4 pages.
United States Patent and Trademark Office; Ex Parte Quayle Action for U.S. Appl. No. 16/924,504; dated Aug. 18, 2021; 9 pages.
United States Patent and Trademark Office; Ex Parte Quayle Action for U.S. Appl. No. 17/352,728; dated Jun. 20, 2022; 6 pages.
United States Patent and Trademark Office; Final Office Action for U.S. Appl. No. 17/221,219; dated Aug. 24, 2021; 14 pages.
United States Patent and Trademark Office; Final Office Action for U.S. Appl. No. 16/540,484; dated Apr. 27, 2022; 12 pages.
United States Patent and Trademark Office; Final Office Action for U.S. Appl. No. 16/540,484; dated Feb. 19, 2021; 12 pages.
United States Patent and Trademark Office; Final Office Action for U.S. Appl. No. 16/809,729; dated Nov. 18, 2021; 16 pages.
United States Patent and Trademark Office; Final Office Action for U.S. Appl. No. 17/004,966; dated Mar. 12, 2021; 18 pages.
Amit Govil, Selective Perforation: A Game Changer in Perforating Technology—Case Study, presented at the 2012 European and West African Perforating Symposium, Schlumberger, Nov. 7-9. 2012, 14 pgs.
Austin Powder Company; A—140 F & Block, Detonator & Block Assembly; Jan. 5, 2017; 2 pgs.; https://www.austinpowder.com/wp-content/uploads/2019/01/OilStar_A140Fbk-2.pdf.
Baker Hughes, Long Gun Deployment Systems IPS-12-28; 2012 International Perforating Symposium; Apr. 26-27, 2011; 11 pages.
Baker Hughes; SurePerf Rapid Select-Fire System Perforate production zones in a single run; 2012; 2 pages.
Bear Manufacturing, LLC; Defendant Bear Manufacturing, LLC's Answer, Affirmative Defenses and Counterclaim in response to Plaintiffs' Complaint for Civil Action No. 3:21-cv-00185-M; dated Mar. 22, 2021; 14 pages.
Bear Manufacturing, LLC; Defendant's Preliminary Invalidity Contentions; dated Aug. 4, 2021; 23 pages.
Bear Manufacturing, LLC; Exhibit A1 U.S. Pat. No. 5,155,293 to Barton vs. Asserted Claims of U.S. Pat. No. 10,844,697; dated Aug. 4, 2021; 21 pages.
Bear Mfg and Oso Perf, Invalidity Contentions in Litigation re Amit Govil, "Selective Perforation: A Game Changer in Perforating Technology—Case Study," 2012 European and West African Perforating Symposium ("EWAPS") vs. Asserted Claims of U.S. Pat. No. 10,844,697, dated as early as Aug. 4, 2021, 17 pgs.
Bear Mfg and Oso Perf, Invalidity Contentions in Litigation re U.S. Pat. No. 9,175,553 to McCann, et al. vs. Asserted Claims of U.S. Pat. No. 10,844,697, dated as early as Aug. 4, 2021, 26 pgs.
Bear Mfg, Oso Perf, Horizontal Wireline and Allied Horizontal, Invalidity Chart in Litigation re U.S. Pat. No. 10,844,697, U.S. Pat. No. 6,506,083 vs. Asserted Claims, dated as early as Aug. 4, 2021, 17 pgs.
Bear Mfg, Oso Perf, Horizontal Wireline and Allied Horizontal, Invalidity Contentions in Litigation re U.S. Pat. No. 10,844,697, "New Select-Fire System" Publication and Select-Fire System by BakerHughes vs. Asserted Claims, dated as early as Aug. 4, 2021, 14 pgs.
Bear Mfg, Oso Perf, Horizontal Wireline and Allied Wireline, Invalidity Chart in Litigation re U.S. Pat. No. 10,844,697, US Pub. No. 2012/0247771 vs. Asserted Claims, dated as early as Aug. 4, 2021, 26 pgs.
Bear Mfg, Oso Perf, Horizontal Wireline and Allied Wireline, Invalidity Contentions in Litigation re "3.12-in Frac Gun" Publication and 3.12-in Frac Gun System by Sclumberger vs. Asserted Claims of U.S. Pat. No. 10,844,697, dated as early as Aug. 4, 2021, 26 pgs.
Bear Mfg, Oso Perf, Horizontal Wireline and Allied Wireline, Invalidity Contentions in Litigation re Schlumberger SafeJet System vs. Asserted Claims of U.S. Pat. No. 10,844,697, dated as early as Aug. 4, 2021, 26 pgs.
Bear Mfg, Oso Perf, Horizontal Wireline and Allied Wireline, Invalidity Contentions in Litigation re U.S. Publication 2012/0199352 to Lanclos vs. Asserted Claims of U.S. Pat. No. 10,844,697, dated as early as Aug. 4, 2021, 24 pgs.
Bear Mfg, Oso Perf, Horizontal Wireline and Allied Wireline, Invalidity Contentions in Litigation re U.S. Publication No. 2008/0073081 to Frazier, et al vs. Asserted Claims of U.S. Pat. No. 10,844,697, dated as early as Aug. 4, 2021, 33 pgs.
Bear Mfg, Oso Perf, Horizontal Wireline and Allied Wireline, Invalidity Contentions in Litigation re U.S. Publication No. 2016/0084048 to Harrigan, et al vs. Asserted Claims of U.S. Pat. No. 10,844,697, dated as early as Aug. 4, 2021, 14 pgs.
Bear Mfg, Oso Perf, Horizontal Wireline and Allied Wireline, Invalidity Contentions in Litigation re U.S. Publication No. 2010/0065302 to Nesbitt vs. Asserted Claims of U.S. Pat. No. 10,844,697, dated as early as Aug. 4, 2021, 15 pgs.
Bear Mfg, Oso Perf, Horizontal Wireline and Allied Wireline, Invalidity Contentions in Litigation re U.S. Pat. No. 3,173,992 to Boop vs. Asserted Claims of U.S. Pat. No. 10,844,697, dated as early as Aug. 4, 2021, 17 pgs.
Bear Mfg, Oso Perf, Horizontal Wireline and Allied Wireline, Invalidity Contentions in Litigation re U.S. Pat. No. 4,457,383 to Boop. vs. Asserted Claims of U.S. Pat. No. 10,844,697, dated as early as Aug. 4, 2021, 22 pgs.
Bear Mfg, Oso Perf, Horizontal Wireline and Allied Wireline, Invalidity Contentions in Litigation re U.S. Pat. No. 6,582,251 to Burke, et al vs. Asserted Claims of U.S. Pat. No. 10,844,697, dated as early as Aug. 4, 2021, 15 pgs.
Bear Mfg, Oso Perf, Horizontal Wireline and Allied Wireline, Invalidity Contentions in Litigation re U.S. Pat. No. 7,762,331 to Goodman vs. Asserted Claims of U.S. Pat. No. 10,844,697, dated as early as Aug. 4, 2021, 28 pgs.
Bear Mfg, Oso Perf, Horizontal Wireline and Allied Wireline, Invalidity Contentions in Litigation re U.S. Pat. No. 7,901,247 to Ring vs. Asserted Claims of U.S. Pat. No. 10,844,697, dated as early as Aug. 4, 2021, 19 pgs.
Bear Mfg, Oso Perf, Horizontal Wireline and Allied Wireline, Invalidity Contentions in Litigation re U.S. Pat. No. 8,387,533 to Runkel vs. Asserted Claims of U.S. Pat. No. 10,844,697, dated as early as Aug. 4, 2021, 16 pgs.
Bear Mfg, Oso Perf, Horizontal Wireline and Allied Wireline, Invalidity Contentions in Litigation re U.S. Pat. No. 8,869,887 to Deere, et al vs. Asserted Claims of U.S. Pat. No. 10,844,697, dated as early as Aug. 4, 2021, 10 pgs.
Bear Mfg, Oso Perf, Horizontal Wireline and Allied Wireline, Invalidity Contentions in Litigation re U.S. Pat. No. 8,943,943 to Tassaroli vs. Asserted Claims of U.S. Pat. No. 10,844,697, dated as early as Aug. 4, 2021, 7 pgs.
Bear Mfg, Oso Perf, Horizontal Wireline and Allied Wireline, Invalidity Contentions in Litigation re U.S. Pat. No. 9,065,201 to Borgfeld, et al. vs. Asserted Claims of U.S. Pat. No. 10,844,697, dated as early as Aug. 4, 2021, 14 pgs.
Bear Mfg, Oso Perf, Horizontal Wireline and Allied Wireline, Invalidity Contentions in Litigation re U.S. Pat. No. 9,145,764 to Burton, et al. vs. Asserted Claims of U.S. Pat. No. 10,844,697, dated as early as Aug. 4, 2021, 18 pgs.
Bear Mfg, Oso Perf, Horizontal Wireline and Allied Wireline, Invalidity Contentions in Litigation re U.S. Pat. No. 9,689,223 to Schacherer, et al vs. Asserted Claims of U.S. Pat. No. 10,844,697, dated as early as Aug. 4, 2021, 8 pgs.

(56) References Cited

OTHER PUBLICATIONS

Brazilian Patent and Trademark Office; Search Report for BR Application No. BR112015033010-0; mailed May 5, 2020; (4 pages).
Brico Oil Tools; BT Tool Inspection, Care and Maintenance Guideline; Setting Tool Inspection Information Product Family No. 41-21; dated Jan. 11, 2014; https://www.bricooiltools.com/pdfs/Brico-Setting-Tool-Inspection-manual. pdf.
Brinsden, Mark; Declaration of Mark Brinsden; dated Sep. 30, 2021; 51 pages.
Buche & Associates, P.C.; Rule 501 Citation of Prior Art and Written "Claim Scope Statements" in U.S. Pat. No. 10,844,697; dated Mar. 3, 2021; 24 pages.
Burndy, Bulkhead Ground Connector, Mechanical Summary Sheet, The Grounding Superstore, Jul. 15, 2014, 1 page, https://www.burndy.com/docs/default-source/cutsheets/bulkhead-connect.
C&J Energy Services; Gamechanger Perforating System Description; 2018; 1 pages.
C&J Energy Services; Gamechanger Perforating System Press Release; 2018; 4 pages.
Canadian Intellectual Property Office, Office Action for CA App. No. 2923860 dated Jul. 14, 2017, 3 pages.
Canadian Intellectual Property Office, Office Action for CA App. No. 2923860 dated Nov. 25, 2016, 3 pages.
Canadian Intellectual Property Office; Notice of Allowance for CA Appl. No. 2,821,506; mailed Jul. 31, 2019; 1 page.
Canadian Intellectual Property Office; Office Action for CA Appl. No. 2,821,506; mailed Mar. 21, 2019; 4 pages.
Canadian Intellectual Property Office; Office Action for CA Application No. 2,941,648; dated Mar. 15, 2021; 3 pages.
Canadian Intellectual Property Office; Office Action for CA Application No. 3,070, 118; dated Mar. 16, 2021; 3 pages.
Canadian Intellectual Property Office; Office Action for CA Application No. 3,070, 118; dated Nov. 17, 2021; 3 pages.
Canadian Intellectual Property Office; Office Action for CA Application No. 3040648; dated Nov. 18, 2020; 4 pages.
ControlFire User Manual; Exhibit No. 2005 of PGR No. 2020-00072; 2014; 56 pages.
Corelab Owen Oil Tools; Expendable Perforating Guns Description; https://www.corelab.com/owen/cms/docs/Canada/10A_erhsc-01.0-c.pdf; 2008; 7 pages.
Dalia Abdallah et al., Casing Corrosion Measurement to Extend Asset Life, Dec. 31, 2013, 14 pgs., https://www.slb.com/-/media/files/oilfield-review/2-casing-corr-2-english.
Djresource, Replacing Signal and Ground Wire, May 1, 2007, 2 pages, http://www.djresource.eu/Topics/story/110/Technics-SL-Replacing-Signal-and-Ground-Wire/.
drillingmatters.org; Definition of "sub"; dated Aug. 25, 2018; 2 pages.
Dynaenergetics Europe Gmbh, Oso Perforating, LLC, SWM International, LLC and Bear Manufacturing, LLC; Joint Claim Construction Statement for Northern District of Texas Civil Action Nos. 3:21-cv-00188, 3:21-cv-00192 and 3:21-cv-00185; dated Sep. 28, 2021; 29 pages.
G&H Diversified Manufacturing, LP; Defendant G&H Diversified Manufacturing, LP's Opening Claim Construction Brief; dated Oct. 18, 2021; 25 pages.
G&H Diversified Manufacturing, LP; Defendants' Preliminary Invalidity Contentions for Civil Action No. 3:20-cv-00376; dated May 6, 2021; 20 pages.
G&H Diversified Manufacturing, LP; Plaintiff and Counterclaim Defendant G&H Diversified Manufacturing, LP and Counterclaim Defendant Yellow Jacket Oil Tools, LLC's First Supplemental Proposed Constructions; dated Jun. 24, 2021; 7 pages.
G&H Diversified Manufacturing, LP; Plaintiff and Counterclaim Defendant G&H Diversified Manufacturing, LP and Counterclaim Defendant Yellow Jacket Oil Tools, LLC's Proposed Constructions; dated Jun. 10, 2021; 7 pages.
G&H Diversified Manufacturing, LP; Redated Petition for Post Grant Review for PGR2021-00078; dated May 10, 2021; 20 pages.
G&H Diversified Manufacturing, LP; Reply to Preliminary Response for PGR No. PGR2021-00078; dated Sep. 14, 2021; 18 pages.
GB Intellectual Property Office, Combined Search and Examination Report for GB App. No. 1717516.7, dated Feb. 27, 2018, 6 pgs.
GB Intellectual Property Office, Combined Search and Examination Report for GB App. No. GB1700625.5, dated Jul. 7, 2017, 5 pages.
GB Intellectual Property Office, Examination Report for GB App. No. GB1600085.3, mailed Mar. 9, 2016, 1 pg.
GB Intellectual Property Office, Search Report for App. No. GB 1700625.5; dated Jul. 7, 2017; 5 pgs.
GB Intellectual Property Office; Examination Report for GB Appl. No. 1717516.7; Apr. 13, 2018; 3 pages.
GB Intellectual Property Office; Notification of Grant for GB Appl. No. 1717516.7; Oct. 9, 2018; 2 pages.
GB Intellectual Property Office; Office Action for GB App. No. 1717516.7; dated Feb. 27, 2018; 6 pages.
GB Intellectual Property Office; Search Report for GB. Appl. No. 1700625.5; mailed Dec. 21, 2017; 5 pages.
German Patent Office, Office Action for German Patent Application No. 10 2013 109 227.6, which is in the same family as PCT Application No. PCT/EP2014/065752, see p. 5 for references cited, May 22, 2014, 8 p. .
Gilliat et al.; New Select-Fire System: Improved Reliability and Safety in Select Fire Operations; 2012; 16 pgs.
Global Wireline Market; Exhibit 2010 of PGR 2020-00072; dated Oct. 15, 2019; 143 pages.
GR Energy Operating GP LLC, GR Energy Services Management, LP and GR Energy Services, LLC; Exhibit A U.S. Pat. No. 10,844,697 vs Castel; dated Aug. 30, 2021; 88 pages.
GR Energy Operating GP LLC, GR Energy Services Management, LP and GR Energy Services, LLC; Exhibit B U.S. Pat. No. 10,844,697 vs Goodman; dated Aug. 30, 2021; 36 pages.
GR Energy Operating GP LLC, GR Energy Services Management, LP and GR Energy Services, LLC; Exhibit C U.S. Pat. No. 10,844,697 vs Hromas; dated Aug. 30, 2021; 27 pages.
GR Energy Operating GP LLC, GR Energy Services Management, LP and GR Energy Services, LLC; Exhibit D U.S. Pat. No. 10,844,697 vs Boop 768; dated Aug. 30, 2021; 35 pages.
GR Energy Operating GP LLC, GR Energy Services Management, LP and GR Energy Services, LLC; Exhibit E U.S. Pat. No. 10,844,697 vs Boop 792; dated Aug. 30, 2021; 52 pages.
GR Energy Operating GP LLC, GR Energy Services Management, LP and GR Energy Services, LLC; Exhibit F U.S. Pat. No. 10,844,697 vs Boop 378; dated Aug. 30, 2021; 34 pages.
GR Energy Operating GP LLC, GR Energy Services Management, LP and GR Energy Services, LLC; Exhibit G U.S. Pat. No. 10,844,697 vs Bickford; dated Aug. 30, 2021; 7 pages.
GR Energy Operating GP LLC, GR Energy Services Management, LP and GR Energy Services, LLC; Exhibit H U.S. Pat. No. 10,844,697 vs Black; dated Aug. 30, 2021; 33 pages.
GR Energy Operating GP LLC, GR Energy Services Management, LP and GR Energy Services, LLC; Exhibit I U.S. Pat. No. 10,844,697 vs Rogman; dated Aug. 30, 2021; 59 pages.
GR Energy Operating GP LLC, GR Energy Services Management, LP and GR Energy Services, LLC; Exhibit J U.S. Pat. No. 10,844,697 vs Burton; dated Aug. 30, 2021; 57 pages.
GR Energy Operating GP LLC, GR Energy Services Management, LP and GR Energy Services, LLC; Exhibit K U.S. Pat. No. 10,844,697 vs Borgfeld; dated Aug. 30, 2021; 36 pages.
GR Energy Operating GP LLC, GR Energy Services Management, LP and GR Energy Services, LLC; Exhibit L U.S. Pat. No. 10,844,697 vs Boop '383; dated Aug. 30, 2021; 24 pages.
GR Energy Operating GP LLC, GR Energy Services Management, LP and GR Energy Services, LLC; Exhibit M U.S. Pat. No. 10,844,697 vs Boop '992; dated Aug. 30, 2021; 14 pages.
GR Energy Operating GP LLC, GR Energy Services Management, LP and GR Energy Services, LLC; Exhibit N U.S. Pat. No. 10,844,697 vs Deere; dated Aug. 30, 2021; 14 pages.
GR Energy Operating GP LLC, GR Energy Services Management, LP and GR Energy Services, LLC; Exhibit O U.S. Pat. No. 10,844,697 vs Harrigan Provisional; dated Aug. 30, 2021; 26 pages.

(56) References Cited

OTHER PUBLICATIONS

GR Energy Operating GP LLC, GR Energy Services Management, LP and GR Energy Services, LLC; Exhibit P U.S. Pat. No. 10,844,697 vs Burke '251; dated Aug. 30, 2021; 7 pages.
GR Energy Operating GP LLC, GR Energy Services Management, LP and GR Energy Services, LLC; Exhibit Q U.S. Pat. No. 10,844,697 vs Runkel; dated Aug. 30, 2021; 7 pages.
GR Energy Operating GP LLC, GR Energy Services Management, LP and GR Energy Services, LLC; Exhibit R U.S. Pat. No. 10,844,697 vs Tassaroli; dated Aug. 30, 2021; 10 pages.
GR Energy Operating GP LLC, GR Energy Services Management, LP and GR Energy Services, LLC; Exhibit S U.S. Pat. No. 10,844,697 vs Harrigan '048; dated Aug. 30, 2021; 7 pages.
GR Energy Operating GP LLC, GR Energy Services Management, LP and GR Energy Services, LLC; Exhibit T U.S. Pat. No. 10,844,697 vs Select-Fire System; dated Aug. 30, 2021; 36 pages.
GR Energy Operating GP LLC, GR Energy Services Management, LP and GR Energy Services, LLC; Exhibit U U.S. Pat. No. 10,844,697 vs New Select-Fire System; dated Aug. 30, 2021; 37 pages.
GR Energy Operating GP LLC, GR Energy Services Management, LP and GR Energy Services, LLC; Exhibit V U.S. Pat. No. 10,844,697 vs EWAPS; dated Aug. 30, 2021; 17 pages.
GR Energy Operating GP LLC, GR Energy Services Management, LP and GR Energy Services, LLC; Exhibit W U.S. Pat. No. 10,844,697 vs SafeJet System; dated Aug. 30, 2021; 17 pages.
GR Energy Operating GP LLC, GR Energy Services Management, LP and GR Energy Services, LLC; GR Energy's Preliminary Invalidity Contentions for Civil Action No. 6:21-cv-00085-ADA; dated Aug. 30, 2021; 18 pages.
GR Energy Services Operating GP LLC, GR Energy Services Management, LP and GR Energy Services, LLC; GR Energy's Opening Claim Construction Brief; dated Oct. 18, 2021; 23 pages.
Harrison Jet Guns; Image of "xtra penetrator".
Heard, Preston; Declaration for PGR2021-00078; dated Aug. 19, 2021; 5 pages.
Horizontal Wireline Services, LLC and Allied Wireline Services, LLC; Defendants' Opening Claim Construction Brief; dated Oct. 18, 2021; 27 pages.
Horizontal Wireline Services, LLC and Allied Wireline Services, LLC; Defendants' Preliminary Invalidity Contentions for Civil Action No. 6:21-cv-00349-ADA; dated Aug. 30, 2021; 22 pages.
Horizontal Wireline Services, LLC and Allied Wireline Services, LLC; Exhibit A1 U.S. Pat. No. 5,155,293 to Barton vs. Asserted Claims of U.S. Pat. No. 10,844,697; dated Aug. 30, 2021; 21 pages.
Horizontal Wireline Services, LLC and Allied Wireline Services, LLC; Exhibit A23 Amit Govil, "Selective Perforation: A Game Changer in Perforating Technology—Case Study," 2012 European and West African Perforating Symposium vs. Asserted Claims of U.S. Pat. No. 10,844,697; dated Aug. 30, 2021; 17 pages.
Horizontal Wireline Services, LLC and Allied Wireline Services, LLC; Exhibit A5 U.S. Pat. No. 9,175,553 to Mcann, et al. vs. Asserted Claims of U.S. Pat. No. 10,844,697; dated Aug. 30, 2021; 26 pages.
Horizontal Wireline Services, Presentation of a completion method of shale demonstrated through an example of Marcellus Shale, Pennsylvania, USA, Presented at 2012 International Perforating Symposium (Apr. 26-28, 2012), 17 pages.
Norwegian Industrial Property Office, Office Action for NO Patent App. No. 20171759, dated Jan. 14, 2020, 4 pgs.
Norwegian Industrial Property Office, Search Report for NO Patent App. No. 20171759, dated Jan. 14, 2020, 2 pgs.
Norwegian Industrial Property Office; Office Action for NO Application No. 20180507; dated Jan. 23, 2023; 3 pages.
Norwegian Industrial Property Office; Search Report for NO Application No. 20180507; dated Jan. 23, 2023; 2 pages.
United States Patent and Trademark Office; Non-Final Office Action for U.S. Appl. No. 17/951,606; dated Jan. 17, 2023; 11 pages.
United States Patent and Trademark Office; Notice of Allowance for U.S. Appl. No. 16/540,484; dated Jan. 5, 2023; 7 pages.
United States Patent and Trademark Office; Requirement for Restriction/Election for U.S. Appl. No. 17/223,899; dated Mar. 17, 2023; 5 pages.
United States Patent and Trial Appeal Board; Final Written Decision on PGR2021-00097; issued Jan. 3, 2023; 112 pages.
Scharf, Thilo; Declaration for PGR2020-00072; dated Oct. 22, 2020; 13 pages.
Schlumberger & Said Abubakr, Combining and Customizing Technologies for Perforating Horizontal Wells in Algeria, Presented at 2011 MENAPS, Nov. 28-30, 2011, 20 pages.
Schlumberger Technology Corporation, Defendant Schlumberger Technology Corporation's Opening Claim Construction Brief for Civil Action No. 6:21-cv-00225-ADA; dated Oct. 6, 2021; 27pages.
Schlumberger Technology Corporation; Defendant Schlumberger Technology Corporation's Reply to Plaintiffs' Responsive Claim Construction Brief; dated Nov. 10, 2021; 17 pages.
Schlumberger Technology Corporation; Defendant's Preliminary Invalidity Contentions; dated Aug. 19, 2021; 213 pages.
Schlumberger Technology Corporation; Exhibit A-01 to Defendant's Preliminary Invalidity Contentions Invalidity of U.S. Pat. No. 10,844,696 over WO20190148009; dated Aug. 19, 2021; 267 pages.
Schlumberger Technology Corporation; Exhibit A-02 to Defendant's Preliminary Invalidity Contentions Invalidity of U.S. Pat. No. 10,844,696 over U.S. Pat. No. 4,598,775; dated Aug. 19, 2021; 178 pages.
Schlumberger Technology Corporation; Exhibit A-03 to Defendant's Preliminary Invalidity Contentions Invalidity of U.S. Pat. No. 10,844,696 over U.S. Pat. No. 4,753,301; dated Aug. 19, 2021; 178 pages.
Schlumberger Technology Corporation; Exhibit A-04 to Defendant's Preliminary Invalidity Contentions Invalidity of U.S. Pat. No. 10,844,696 over U.S. Pat. No. 10,746,003; dated Aug. 19, 2021; 186 pages.
Schlumberger Technology Corporation; Exhibit A-05 to Defendant's Preliminary Invalidity Contentions Invalidity of U.S. Pat. No. 10,844,696 over WO2017/024266; dated Aug. 19, 2021; 247 pages.
Schlumberger Technology Corporation; Exhibit A-06 to Defendant's Preliminary Invalidity Contentions Invalidity of U.S. Pat. No. 10,844,696 over U.S. Pat. No. 4,479,556; dated Aug. 19, 2021; 250 pages.
Schlumberger Technology Corporation; Exhibit A-07 to Defendant's Preliminary Invalidity Contentions Invalidity of U.S. Pat. No. 10,844,696 over US2017/0145798; dated Aug. 19, 2021; 279 pages.
Schlumberger Technology Corporation; Petitioner's Reply to Patent Owner's Preliminary Response; dated Oct. 13, 2021; 14 pages.
Schlumberger; Field Test Database Print Out Showing uses of the SafeJet System; dated May 11, 2015; 10 pages.
Schlumberger; Lina Pradilla, Wireline Efficiency in Unconventional Plays—The Argentinean Experience, including excerpted image from slide 13; dated 2013; 16 pages http://www.perforators.org/wp-content/uploads/2015/10/SLAP_47_Wireline_Efficiency_Unconventional_Plays. pdf.
Schlumberger; Selective Perforation: A Game Changer in Perforating Technology—Case Study; issued 2012; 14 pages.
Sharma, Gaurav; Hunting PLC Is Not in a Race to the Bottom, Says Oilfield Services Firm's CEO; dated Sep. 10, 2019; retrieved on Nov. 18, 2020; 6 pages.
Shelby Sullivan; Declaration of Shelby Sullivan; dated Oct. 18, 2021; 9 pages.
SIPO, Search Report dated Mar. 29, 2017, in Chinese: See Search Report for CN App. No. 201480040456.9, 12 pgs. (English Translation 3 pgs.).
Smithson, Anthony; Declaration Declaration for IPR2021-00082; dated Oct. 16, 2020; 2 pages.
Smylie, Tom, New Safe and Secure Detonators for the Industry's consideration, presented at Explosives Safety & Security Conference, Marathon Oil Co, Houston; Feb. 23-24, 2005, 20 pages.
State Intellectual Property Office People's Republic of China; First Office Action for Chinese App. No. 201811156092.7; issued Jun. 16, 2020; 6 pages (Eng Translation 8 pages).
State Intellectual Property Office, P.R. China; First Office Action for Chinese App No. 201580011132.7; issued Jun. 27, 2018; 5 pages (Eng. Translation 9 pages).

(56) References Cited

OTHER PUBLICATIONS

State Intellectual Property Office, P.R. China; First Office Action for CN App. No. 201480047092.7; issued on Apr. 24, 2017.
State Intellectual Property Office, P.R. China; First Office Action with full translation for CN App. No. 201480040456.9; issued Mar. 29, 2017; 12 pages (English translation 17 pages).
State Intellectual Property Office, P.R. China; Notification to Grant Patent Right for Chinese App. No. 201580011132.7; issued Apr. 3, 2019; 2 pages (Eng. Translation 2 pages).
State Intellectual Property Office, P.R. China; Notification to Grant Patent Right for CN App. No. 201480040456.9; Jun. 12, 2018; 2 pages (English translation 2 pages).
State Intellectual Property Office, P.R. China; Second Office Action for CN App. No. 201480040456.9; issued Nov. 29, 2017; 5 pages (English translation 1 page).
State Intellectual Property Office, P.R. China; Second Office Action for CN App. No. 201480047092.7; issued Jan. 4, 2018; 3 pages.
Stifel; Why the Big Pause? Balancing Long-Term Value with Near-Term Headwinds. Initiating Coverage of Oilfield Svcs and Equipment; dated Sep. 10, 2018; 207 pages.
SWM International, LLC and Nextier Completion Solutions LLC; Petitioner's Preliminary Reply to Patent Owner's Preliminary Response for Case No. PGR2021-00097; dated Nov. 15, 2021; 11 pages.
SWM International, LLC and Nextier Oil Completion Solutions, LLC; Petition for Post Grant Review PGR No. 2021-00097; dated Jul. 20, 2021; 153 pages.
SWM International, LLC; Defendant's P.R. 3-3 and 3-4 Preliminary Invalidity Contentions; dated Aug. 4, 2021; 28 pages.
SWM International, LLC; Defendant's P.R. 4-1 Disclosure of Proposed Terms and Claim Elements for Construction for Civil Action No. 3:21-cv-00192-M; dated Aug. 24, 2021; 5 pages.
SWM International, LLC; Ex. A-1 Invalidity of U.S. Pat. No. 10,844,697 Over the SafeJet System; dated Aug. 4, 2021; 15 pages.
SWM International, LLC; Ex. A-1A Invalidity of U.S. Pat. No. 10,844,697 Over the SafeJet System in view of Backhus; dated Aug. 4, 2021; 4 pages.
SWM International, LLC; Ex. A-1B Invalidity of U.S. Pat. No. 10,844,697 Over the SafeJet System in view of Harrigan; dated Aug. 4, 2021; 3 pages.
SWM International, LLC; Ex. A-2 Invalidity of U.S. Pat. No. 10,844,697 Over Goodman; dated Aug. 4, 2021; 11 pages.
SWM International, LLC; Ex. A-2A Invalidity of U.S. Pat. No. 10,844,697 Over Goodman in view of Backhus; dated Aug. 4, 2021; 3 pages.
SWM International, LLC; Ex. A-2B Invalidity of U.S. Pat. No. 10,844,697 Over Goodman in view of Harrigan; dated Aug. 4, 2021; 3 pages.
SWM International, LLC; Ex. A-3 Invalidity of U.S. Pat. No. 10,844,697 Over Harrigan; dated Aug. 4, 2021; 13 pages.
SWM International, LLC; Ex. A-4 Invalidity of U.S. Pat. No. 10,844,697 Over Burton; dated Aug. 4, 2021; 11 pages.
SWM International, LLC; Ex. A-5 Invalidity of U.S. Pat. No. 10,844,697 Over Rogman; dated Aug. 4, 2021; 10 pages.
SWM International, LLC; Exhibit B: DynaEnergetics' Infringement of U.S. Pat. No. 11,078,762 for Civil Action No. 6:21-cv-00804; dated Aug. 3, 2021; 22 pages.
SWM International; Drawing of SafeJet System; dated Jul. 20, 2021; 1 page.
SWM International; Photographs of SafeJet System; dated Jul. 20, 2021; 9 pages.
Tolteq; iSeries MWD System; dated 2021; 9 pages.
U.S. Patent Trial and Appeal Board, Institution of Inter Partes Review of U.S. Pat. No. 9,581,422, Case IPR2018-00600,Aug. 21, 2018, 9 pages.
United States District Court for the Northern District of Texas Dallas Division; Memorandum Opinion and Order in Civil Action No. 3:21-cv-00188-M; Mar. 23, 2022; 35 pages (order is redacted to protect confidential information; redacted order has not yet been filed by the Court).
United States District Court for the Northern District of Texas Dallas Division; Memorandum Opinion and Order in Civil Action No. 3:21-cv-00192-M; Mar. 23, 2022; 34 pages (order is redacted to protect confidential information; redacted order has not yet been filed by the Court).
International Searching Authority; International Search Report and Written Opinion for PCT App. No. PCT/EP2015/059381; Nov. 23, 2015; 14 pages.
International Searching Authority; International Search Report and Written Opinion for PCT App. No. PCT/EP2019/072064; Nov. 20, 2019; 15 pages.
International Searching Authority; International Search Report and Written Opinion for PCT App. No. PCT/US2015/018906; Jul. 10, 2015; 12 pages.
International Searching Authority; International Search Report and Written Opinion for PCT Application No. EP2020066327; mailed on Jan. 11, 2021; 17 pages.
International Searching Authority; International Search Report and Written Opinion of the International Searching Authority for PCT/EP2020/085622; mailed on Apr. 1, 2021; 10 pages.
International Searching Authority; International Search Report and Written Opinion of the International Searching Authority for PCT/EP2021/057570; mailed on Sep. 13, 2021; 21 pages.
International Searching Authority; International Search Report and Written Opinion of the International Searching Authority for PCT/EP2021/057148; mailed on Jul. 5, 2021; 11 pages.
International Searching Authority; International Search Report and Written Opinion of the International Searching Authority for PCT/EP2021/058182; mailed on Aug. 26, 2021; 16 pages.
International Searching Authority; International Search Report and Written Opinion of the International Searching Authority for PCT/EP2020/085624; mailed on Apr. 12, 2021; 11 pages.
International Searching Authority; International Searching Authority Partial Search Report and Invitation to Pay Additional Search Fees for PCT/EP2021/057570; mailed on Jul. 22, 2021; 17 pages.
Jet Research Center Inc., JRC Catalog, 2008, 36 pgs., https://www.jetresearch.com/content/dam/jrc/Documents/Books_Catalogs/06_Dets.pdf.
Jet Research Center Inc., Red RF Safe Detonators Brochure, 2008, 2 pages, www.jetresearch.com.
Jet Research Centers, Capsule Gun Perforating Systems, Alvarado, Texas, 27 pgs., Jun. 12, 2019 https://www.jetresearch.com/content/dam/jrc/Documents/Books_Catalogs/07_Cap_Gun.pdf.
Johnson, Bryce; Citation of Prior Art and Written Statements in Patent Files for U.S. Pat. No. 10,844,697; dated Apr. 29, 2021; 2 pages.
Johnson, Bryce; Rule 501 citation of prior art and written "claim scope statements" in U.S. Pat. No. 10,844,697; dated Apr. 29, 2021; 18 pages.
Lehr, Doug; Declaration of Doug Lehr in Supprt of Repeat Precision's Response Claim Construction Brief; dated Oct. 27, 2021; 35 pages.
Logan, et al.; International Patent Application No. PCT/CA2013/050986; dated Dec. 18, 2013; 54 pages.
Markel, Dan; Declaration regarding the SafeJet System for PGR2021-00097; dated Jul. 15, 2021; 21 pages.
McNelis et al.; High-Performance Plug-and-Perf Completions in Unconventional Wells; Society of Petroleum Engineers Annual Technical Conference and Exhibition; Sep. 28, 2015.
Meehan, Nathan; Declaration of D. Nathan Meehan, Ph.D, P.E; dated Oct. 18, 2021; 86 pages.
merriam-webster.com, Insulator Definition, https://www.merriam-webster.com/dictionary/insulator, Jan. 31, 2018, 4 pages.
Nextier Completion Solutions Inc.; Defendant NexTier Completion Solution Inc.'s Opening Claim Construction Brief; dated Oct. 18, 2021; 26 pages.
Nextier Completion Solutions Inc.; Defendant Nextier Completion Solutions Inc.'s First Amended Answer and Counterclaims to Plaintiffs' First Amended Complaint for Civil Action No. 6:20-CV-01201; dated Jun. 28, 2021; 17 pages.
Nextier Completion Solutions Inc.; Defendant's Preliminary Invalidity Contentions for Civil Action No. 6:20-cv-01201-ADA; dated Aug. 30, 2021; 21 pages.

(56) References Cited

OTHER PUBLICATIONS

Nextier Completion Solutions Inc.; Exhibit A-9 Selective perforation: A Game Changer in Peforating Technology—Case Study; dated Aug. 30, 2021; 13 pages.
Nextier Completion Solutions; Plaintiffs Preliminary Invalidity Contentions for Civil Action No. 4:21-cv-01328; dated Jun. 30, 2021; 19 pages.
Nextier Oilfield Solutions Inc; Petition for Inter Partes Review No. IPR2021-00082; dated Oct. 21, 2020; 111 pages.
Nexus Perforating LLC; Answer to DynaEnergetics Europe GMBH and DynaEnergetics US Inc/'s Complaint and Counterclaims; dated Apr. 15, 2021; 10 pages.
Nexus Perforating LLC; Complaint and Demand for Jury Trial for Civil Case No. 4:20-cv-01539; dated Apr. 30, 2020; 11 pages.
Nexus Perforating LLC; Invalidity Contentions for Civil Action No. 4:21-cv-00280; dated Jun. 30, 2021; 44 pages.
Nexus Perforating LLC; Nexus Perforating LLC's Responsive Claim Construction Brief for Civil Action No. 4:21-cv-00280; dated Nov. 3, 2021; 31 pages.
Nexus Perforating LLC; Nexus Preliminary Claim Construction and Extrinsic Evidence for Civil Action No. 4:21-cv-00280; dated Aug. 4, 2021; 6 pages.
Norwegian Industrial Property Office; Notice of Allowance for NO Application No. 20171759; dated Apr. 23, 2021; 2 pages.
Norwegian Industrial Property Office; Office Action and Search Report for NO App. 20/160,017; Jun. 15, 2017; 5 pages.
Norwegian Industrial Property Office; Office Action and Search Report for NO App. No. 20171759; Jan. 14, 2020; 6 pages.
Norwegian Industrial Property Office; Office Action for NO Appl. No. 20160017; mailed Dec. 4, 2017; 2 pages.
Norwegian Industrial Property Office; Office Action for NO Appl. No. 20171759; mailed Oct. 30, 2020; 2 pages.
Norwegian Industrial Property Office; Office Action for NO Application No. 20210799; dated Oct. 30, 2021; 2 pages.
Norwegian Industrial Property Office; Opinion for NO Appl. No. 20171759; mailed Apr. 5, 2019; 1 page.
Oilfield Glossary; Definition of Perforating Gun; dated Feb. 26, 2013; 2 pages.
oilgasglossary.com; Definition of "sub"; dated Nov. 20, 2008; 1 page.
Olsen, Steve; Declaration regarding the SafeJet System for PGR2021-00097; dated Jul. 16, 2021; 25 pages.
Oso Perforating, LLC; Defendant's Preliminary Invalidity Contentions for Civil Action No. 3:21-cv-00188-M; dated Aug. 4, 2021; 23 pages.
Oso Perforating, LLC; Exhibit A1 U.S. Pat. No. 5,155,293 to Barton vs. Asserted Claims of U.S. Pat. No. 10,844,697; dated Aug. 4, 2021; 21 pages.
Owen Oil Tools & Pacific Scientific; RF-Safe Green Det, Side Block for Side Initiation, Jul. 26, 2017, 2 pgs.
Owen Oil Tools, E & B Select Fire Side Port, Tandem Sub, Apr. 2010, 2 pgs., https://www.corelab.com/owen/cms/docs/Canada/10A_eandbsystem-01.0-c.pdf.
Owen Oil Tools, Expendable Perforating Guns, Jul. 2008, 7 pgs., https://www.corelab.com/owen/cms/docs/Canada/10A_erhsc-01.0-c.pdf.
Owen Oil Tools, Recommended Practice for Oilfield Explosive Safety, Presented at 2011 MENAPS Middle East and North Africa Perforating Symposium, Nov. 28-30, 2011, 6 pages.
Owens Oil Tools, E & B Select Fire Side Port Tandem Sub Assembly Man-30-XXX-0002-96, revised Dec. 2012, 9 pgs., https://www.corelab.com/owen/CMS/docs/Manuals/gunsys/MAN-30-XXX-0002-96-R00.pdf.
Parrot, Robert; Declaration, PGR 2020-00080; dated Aug. 11, 2020; 400 pages.
United States Patent and Trademark Office; Final Office Action for U.S. Appl. No. 17/162,579; dated Jul. 15, 2022; 15 pages.
United States Patent and Trademark Office; Final Office Action for U.S. Appl. No. 17/352,728; dated Mar. 9, 2022; 9 pages.
United States Patent and Trademark Office; Final Office Action of U.S. Appl. No. 16/540,484; dated Mar. 30, 2020; 12 pgs.
United States Patent and Trademark Office; U.S. Pat. No. 9,581,422 as of Aug. 23, 2017.
United States Patent and Trademark Office; Information Disclosure Statement for U.S. Appl. No. 16/293,508; dated Dec. 10, 2020; 7 pages.
United States Patent and Trademark Office; Non-Final Office Action for U.S. Appl. No. 16/542,890; issued Nov. 4, 2019; 16 pages.
United States Patent and Trademark Office; Non-Final Office Action for U.S. Appl. No. 15/920,812; dated Feb. 3, 2021; 7 pages.
United States Patent and Trademark Office; Non-Final Office Action for U.S. Appl. No. 16/540,484; dated Aug. 9, 2021; 12 pages.
United States Patent and Trademark Office; Non-Final Office Action for U.S. Appl. No. 16/809,729; dated Feb. 3, 2022; 6 pages.
United States Patent and Trademark Office; Non-Final Office Action for U.S. Appl. No. 16/809,729; dated Jun. 22, 2021; 15 pages.
United States Patent and Trademark Office; Non-Final Office Action for U.S. Appl. No. 16/819,270; dated Feb. 10, 2021; 13 pages.
United States Patent and Trademark Office; Non-Final Office Action for U.S. Appl. No. 17/007,574; dated Jan. 29, 2021; 11 pages.
United States Patent and Trademark Office; Non-Final Office Action for U.S. Appl. No. 17/007,574; dated May 6, 2022; 10 pages.
United States Patent and Trademark Office; Non-Final Office Action for U.S. Appl. No. 17/123,972; dated Mar. 3, 2022; 9 pages.
United States Patent and Trademark Office; Non-Final Office Action for U.S. Appl. No. 17/162,579; dated Feb. 28, 2022; 16 pages.
United States Patent and Trademark Office; Non-Final Office Action for U.S. Appl. No. 17/181,280; dated Apr. 19, 2021; 18 pages.
United States Patent and Trademark Office; Non-Final Office Action for U.S. Appl. No. 17/206,416; dated May 19, 2021; 10 pages.
United States Patent and Trademark Office; Non-Final Office Action for U.S. Appl. No. 17/221,219; dated Jun. 17, 2021; 10 pages.
United States Patent and Trademark Office; Non-Final Office Action for U.S. Appl. No. 17/352,728; dated Oct. 25, 2021; 9 pages.
United States Patent and Trademark Office; Non-Final Office Action for U.S. Appl. No. 17/383,816; dated Jan. 25, 2022; 23 pages.
United States Patent and Trademark Office; Non-Final Office Action of U.S. Appl. No. 15/920,800; dated Dec. 9, 2020; 6 pages.
United States Patent and Trademark Office; Notice of Allowance for U.S. Appl. No. 29/733,080; Oct. 20, 2020; 9 pages.
United States Patent and Trademark Office; Notice of Allowance for U.S. Appl. No. 16/858,041; dated Oct. 22, 2020; 10 pages.
United States Patent and Trademark Office; Notice of Allowance for U.S. Appl. No. 29/733,325; dated Oct. 23, 2020; 7 pages.
United States Patent and Trademark Office; Notice of Allowance for U.S. Appl. No. 15/920,812, mailed Aug. 18, 2020; 5 pages.
United States Patent and Trademark Office; Notice of Allowance for U.S. Appl. No. 16/387,696; issued on Jan. 29, 2020; 7 pages.
United States Patent and Trademark Office; Notice of Allowance for U.S. Appl. No. 14/904,788; dated Jul. 6, 2016; 8 pages.
United States Patent and Trademark Office; Notice of Allowance for U.S. Appl. No. 16/379,341; dated Jan. 19, 2021; 8 pages.
United States Patent and Trademark Office; Notice of Allowance for U.S. Appl. No. 16/423,789; dated Jul. 23, 2020 7 pages.
United States Patent and Trademark Office; Notice of Allowance for U.S. Appl. No. 16/511,495; dated Dec. 15, 2020; 9 pages.
United States Patent and Trademark Office; Notice of Allowance for U.S. Appl. No. 16/585,790, dated Aug. 5, 2020; 15 pages.
United States Patent and Trademark Office; Notice of Allowance for U.S. Appl. No. 16/809,729; dated Jan. 26, 2021; 9 pages.
United States Patent and Trademark Office; Notice of Allowance for U.S. Appl. No. 16/886,257; dated Sep. 15, 2021; 9 pages.
United States Patent and Trademark Office; Notice of Allowance for U.S. Appl. No. 17/004,966; dated Nov. 8, 2021; 12 pages.
United States Patent and Trademark Office; Notice of Allowance for U.S. Appl. No. 17/007,574; dated May 21, 2021; 8 pages.
United States Patent and Trademark Office; Notice of Allowance for U.S. Appl. No. 17/176,335; dated Jul. 13, 2022; 7 pages.
United States Patent and Trademark Office; Notice of Allowance for U.S. Appl. No. 17/181,280; dated Sep. 15, 2021; 14 pages.
United States Patent and Trademark Office; Notice of Allowance for U.S. Appl. No. 17/206,416; dated Sep. 9, 2021; 8 pages.

(56) References Cited

OTHER PUBLICATIONS

United States Patent and Trademark Office; Notice of Allowance for U.S. Appl. No. 17/221,219; dated Jan. 13, 2022; 11 pages.
United States Patent and Trademark Office; Notices of Allowabilty for U.S. Appl. No. 16/585,790; dated Jul. 31, 2020 and Mar. 18, 2020; Response to Office Action for U.S. Appl. No. 16/585,790; dated Nov. 12, 2019; 26 pages.
United States Patent and Trademark Office; Office Action and Response to Office Action for U.S. Appl. No. 16/585,790; dated Nov. 12, 2019 and Feb. 12, 2020; 21 pages.
United States Patent and Trademark Office; Office Action for U.S. Appl. No. 17/004,966; dated Dec. 8, 2020; 30 pages.
United States Patent and Trademark Office; Office Action in Ex Parte Reexamination for U.S. Pat. No. 10,844,697; mailed Jan. 26, 2022; 10 pages.
United States Patent and Trademark Office; Office Action of U.S. Appl. No. 16/540,484, dated Aug. 20, 2020, 10 pgs.
United States Patent and Trademark Office; Order Granting Request for Ex Parte Reexamination; dated Nov. 1, 2021; 14 pages.
United States Patent and Trademark Office; Patent Assignment for U.S. Appl. No. 61/733,129; dated Jan. 25, 2013; 2 pages.
United States Patent and Trademark Office; Prosecution History for U.S. Pat. No. 10,352,136 as of Jul. 16, 2019; 206 pages.
United States Patent and Trademark Office; Restriction Requirement for U.S. Appl. No. 17/007,574; dated Oct. 23, 2020; 6 pages.
United States Patent and Trademark Office; U.S. Appl. No. 61/739,592; dated Dec. 19, 2012; 65 pages.
Dynaenergetics Europe GMBH; Complaint and Demand for Jury Trial for Civil Action No. 4:21-cv-00280; dated Jan. 28, 2021; 55 pages.
Dynaenergetics Europe GMBH; Exposed Gun Subs & Accessories; dated May 23, 2017; https://www.dynaenergetics.com/products/hardware-and-tcp/perforating-gun-systems/exposed-gun-subs-accessories.
Dynaenergetics Europe GMBH; Patent Owner's Preliminary Response for PGR No. 2021-00089; dated Sep. 16, 2021; 106 pages.
Dynaenergetics Europe GMBH; Patent Owner's Preliminary Response for PGR2020-00072; dated Oct. 23, 2020; 108 pages.
Dynaenergetics Europe GMBH; Patent Owner's Preliminary Response for PGR2020-00080; dated Nov. 18, 2020; 119 pages.
Dynaenergetics Europe GMBH; Patent Owner's Preliminary Response for PGR2021-00078; dated Aug. 19, 2021; 114 pages.
Dynaenergetics Europe GMBH; Plaintiff's Preliminary Infringement Contentions for Civil Action No. 6:21-cv-01110; dated Jul. 6, 2021; 6 pages.
Dynaenergetics Europe GMBH; Principal and Response Brief of Cross-Appellant for United States Court of Appeals case No. 2020-2163, -2191; dated Jan. 11, 2021; 95 pages.
Dynaenergetics Europe GMBH; Reply Under 37 C.F.R. §1.111 Amendment Under 37 C.F.R. §1.121 for U.S. Appl. No. 16/585,790; dated Feb. 20, 2020; 18 pages.
Dynaenergetics Europe, GMBH; DynaEnergetics' Preliminary Claim Construction and Extrinsic Evidence for Civil Action No. 4:21-cv-00280; dated Aug. 4, 2021; 10 pages.
Dynaenergetics Europe, GMBH; Patent Owner's Preliminary Response for PGR No. 2021-00097; dated Oct. 29, 2021; 110 pages.
Dynaenergetics Europe; Defendants' Preliminary Infringement Contentions for Civil Action No. 3:20-CV-00376; dated Mar. 25, 2021; 22 pages.
Dynaenergetics Europe; DynaEnergetics Celebrates Grand Opening of DynaStage Manufacturing and Assembly Facilities in Blum, Texas; dated Nov. 16, 2018; 3 pages.
Dynaenergetics Europe; DynaEnergetics Europe GMBH and DynaEnergetics US, Inc.'s Answer to Complaint and Counterclaim Civil Action No. 3:20-cv-000376; dated Mar. 8, 2021; 23 pages.
Dynaenergetics Europe; Exhibit B Invalidity Claim Chart for Civil Action No. 4:19-cv-01611; dated May 2, 2019; 52 pages.
Dynaenergetics Europe; Petition to Correct Inventorship in Patent under 37 C.F.R § 1.324; dated Oct. 13, 2020; 21 pages.
Dynaenergetics Europe; Plaintiffs' Local Patent Rule 3-1 Infringement Contentions for Civil Action No. 4:19-cv-01611; dated May 25, 2018; 10 Pages.
Dynaenergetics Europe; Plaintiffs' Pending Motion for Reconsideration for Civil Action No. 4:17-cv-03784; dated Jan. 21, 2021; 4 pages.
Dynaenergetics Europe; Plaintiffs' Preliminary Claim Constructions and Identification of Extrinsic Evidence Civil Action No. 4:17-cv-03784; dated Aug. 3, 2018; 9 pages.
Dynaenergetics Europe; Plaintiffs' Preliminary Infringement Contentions, Civil Action No. 6:20-cv-00069-ADA; dated Apr. 22, 2020; 32 pages.
Dynaenergetics Europe; Plaintiff's Preliminary Infringment Contentions Civil Action No. 3:21-cv-00192-M; dated Jun. 18, 2021; 15 pages.
Dynaenergetics Europe; Plaintiffs' Reply in Support of Motion to Dismiss and Strike for Civil Action No. 6:20-cv-00069-ADA; dated Apr. 29, 2020; 15 pages.
Dynaenergetics Europe; Plaintiffs Response to Defendant Hunting Titan Ins' Inoperative First Amended Answer, Affirmative Defenses, and Counterclaims for Civil Action No. 6:20-cv-00069-ADA; dated May 13, 2020.
Dynaenergetics Europe; Plaintiffs' Response to Defendants' Answer to Second Amended Complaint Civil Action No. 6:20-cv-00069-ADA; dated May 26, 2020; 18 pages.
DynaEnergetics exhibition and product briefing; Exhibit 2006 of PGR No. 2020-00072; dated 2013; 15 pages.
Dynaenergetics GMBH & Co. KG, Patent Owner's Response to Hunting Titan's Petition for Inter Parties Review—Case IPR2018-00600, filed Dec. 6, 2018, 73 pages.
Dynaenergetics GmbH & Co. KG; Patent Owner's Precedential Opinion Panel Request for Case IPR2018-00600; Sep. 18, 2019, 2 pg.
Dynaenergetics, DYNAselect Electronic Detonator 0015 SFDE RDX 1.4B, Product Information, Dec. 16, 2011, 1 pg.
Dynaenergetics, DYNAselect Electronic Detonator 0015 SFDE RDX 1.4S, Product Information, Dec. 16, 2011, 1 pg.
Dynaenergetics, DYNAselect System, information downloaded from website, Jul. 3, 2013, 2 pages, http://www.dynaenergetics.com/.
Dynaenergetics, Electronic Top Fire Detonator, Product Information Sheet, Jul. 30, 2013, 1 pg.
Dynaenergetics, Gun Assembly, Product Summary Sheet, May 7, 2004, 1 page.
Dynaenergetics, No Debris Gun System (NDG), Hamburg, Germany, Feb. 6, 2008, 26 pgs.
Dynaenergetics, Selective Perforating Switch, information downloaded from website, Jul. 3, 2013, 2 pages, http://www.dynaenergetics.com/.
Dynaenergetics, Selective Perforating Switch, Product Information Sheet, May 27, 2011, 1 pg.
Dynaenergetics; DynaStage Solution—Factory Assembled Performance-Assured Perforating Systems; 6 pages.
DynaStage Gun System; Exhibit 2009 of PGR No. 2020-00080; dated May 2014; 2 pages.
Entchev et al., Autonomous Perforating System for Multizone Completions, SPE International, 2011, 7 pgs., https://www.onepetro.org/conference-paper/SPE-147296-MS.
EP Patent Office—International Searching Authority, PCT Search Report and Written Opinion for PCT Application No. PCT/EP2014/065752, mailed May 4, 2015, 12 pgs.
Eric H. Findlay, Jury Trial Demand in Civil Action No. 6:20-cv-00069-ADA, dated Apr. 22, 2020, 32 pages.
European Patent Office; Invitation to Correct Deficiencies noted in the Written Opinion for European App. No. 15721178.0; issued Dec. 13, 2016; 2 pages.
European Patent Office; Office Action for EP App. No. 15721178.0; issued Sep. 6, 2018; 5 pages.
Fayard, Alfredo; Declaration of Alfredo Fayard; dated Oct. 18, 2021; 13 pages.
Federal Institute of Industrial Property; Decision of Granting for RU Appl. No. 2016104882/03(007851); May 17, 2018; 15 pages (English translation 4 pages).

(56) References Cited

OTHER PUBLICATIONS

Federal Institute of Industrial Property; Decision on Granting a Patent for Invention Russian App. No 2016139136/03(062394); issued Nov. 8, 2018; 20 pages (Eng Translation 4 pages); Concise Statement of Relevance: Search Report at 17-18 of Russian-language document lists several 'A' references based on RU application claims.
Federal Institute of Industrial Property; Inquiry for RU App. No. 2016104882/03(007851); dated Feb. 1, 2018; 7 pages, English Translation 4 pages.
Federal Institute of Industrial Property; Inquiry for RU Application No. 2016110014/03(015803); issued Feb. 1, 2018; 6 pages (Eng. Translation 4 pages).
G&H Diversified Manufacturing LP; Petition for Post Grant Review PGR No. 2021-00078; dated May 10, 2021; 122 pages.
G&H Diversified Manufacturing, LP and Dynaenergetics Europe GMBH; Joint Claim Construction Statement for Civil Action No. 3:20-cv-00376; dated Jul. 8, 2021; 14 pages.
G&H Diversified Manufacturing, LP; Defendant G&H Diversified Manufacturing, LP's Answer to Counter-Claim Plaintiffs' Counter-Claims for Civil Action No. 3:20-cv-00376; dated Apr. 19, 2021; 13 pages.
European Patent Office; International Search Report and Written Opinion issued for PCT/EP2022/055014 dated Jul. 4, 2022; 15 pages.
United States Patent and Trademark Office; Non-Final Rejection issued in U.S. Appl. No. 18/336,830 dated Jan. 19, 2024; 10 pages.

* cited by examiner

MODULAR PERFORATING GUN SYSTEM

This application is a national stage entry of International PCT Patent Application PCT/EP2022/055014 filed Feb. 28, 2022, which claims the benefit of U.S. Provisional Patent Application 63/155,902 filed Mar. 3, 2021, U.S. Provisional Patent Application 63/166,720 filed Mar. 26, 2021, U.S. Provisional Patent Application 63/271,846 filed Oct. 26, 2021, U.S. Provisional Patent Application 63/276,103 filed Nov. 5, 2021, and U.S. Provisional Patent Application 63/309,674 filed Feb. 14, 2022, the entire contents of each of which are incorporated herein by reference.

BACKGROUND OF THE DISCLOSURE

Hydrocarbons, such as fossil fuels (e.g. oil) and natural gas, are extracted from underground wellbores extending deeply below the surface using complex machinery and explosive devices. Once the wellbore is established by placement of casing pipes after drilling and cementing the casing pipe in place, a perforating gun assembly, or train or string of multiple perforating gun assemblies, are lowered into the wellbore, and positioned adjacent one or more hydrocarbon reservoirs in underground formations.

Assembly of a perforating gun may require assembly of multiple parts. Such parts typically include a housing or outer gun barrel containing or connected to perforating gun internal components such as: an electrical wire for relaying an electrical control signal such as a detonation signal from the surface to electrical components of the perforating gun; an electrical, mechanical, and/or explosive initiator such as a percussion initiator, an igniter, and/or a detonator; a detonating cord; one or more explosive and/or ballistic charges which are held in an inner tube, strip, or other carrying device; and other known components including, for example, a booster, a sealing element, a positioning and/or retaining structure, a circuit board, and the like. The internal components may require assembly including connecting electrical components within the housing and confirming and maintaining the connections and relationships between internal components. The assembly procedure may be difficult within the relatively small free space within the housing. Typical connections may include connecting the electrical relay wire to the detonator or the circuit board, coupling the detonator and the detonating cord and/or the booster, and positioning the detonating cord in a retainer at an initiation point of each charge. In addition, typical perforating guns may not provide components that are size-independent and therefore available for use in different perforating guns with, e.g., different gun housing inner diameters.

The housing may also be connected at each end to a respective adjacent wellbore tool or other component of the tool string such as a firing head, tandem seal adapter or other sub assembly, or the like. Connecting the housing to the adjacent component(s) typically includes screwing the housing and the adjacent component(s) together via complementary threaded portions of the housing and the adjacent components and forming a connection and seal therebetween.

Known perforating guns may further include explosive charges, typically shaped, hollow, or projectile charges, which are initiated, e.g., by the detonating cord, to perforate holes in the casing and to blast through the formation so that the hydrocarbons can flow through the casing. In other operations, the charges may be used for penetrating just the casing, e.g., during abandonment operations that require pumping concrete into the space between the wellbore and the wellbore casing, destroying connections between components, severing a component, and the like. The exemplary embodiments in this disclosure may be applicable to any operation consistent with this disclosure. For purposes of this disclosure, the term "charge" and the phrase "shaped charge" may be used interchangeably and without limitation to a particular type of explosive, charge, or wellbore operation, unless expressly indicated.

The perforating guns may be utilized in initial fracturing process or in a refracturing process. Refracturing serves to revive a previously abandoned well in order to optimize the oil and gas reserves that can be obtained from the well. In refracturing processes, a smaller diameter casing is installed and cemented in the previously perforated and accessed well. The perforating guns must fit within the interior diameter of the smaller diameter casing, and the shaped charges installed in the perforating guns must also perforate through double layers of casing and cement combinations in order to access oil and gas reserves.

The explosive charges may be arranged and secured within the housing by the carrying device which may be, e.g., a typical hollow charge carrier or other holding device that receives and/or engages the shaped charge and maintains an orientation thereof. Typically, the charges may be arranged in different phasing, such as 60°, 90°, 120°, 180°, 270°, etc. along the length of the charge carrier, so as to form, e.g., a helical pattern along the length of the charge carrier. Charge phasing generally refers to the radial distribution of charges throughout the perforating gun, or, in other words, the angular offset between respective radii along which successive charges in a charge string extend in a direction away from an axis of the charge string. An explosive end of each charge points outwardly along a corresponding radius to fire an explosive jet through the gun housing and wellbore casing, and/or into the surrounding rock formation. Phasing the charges therefore generates explosive jets in a number of different directions and patterns that may be variously desirable for particular applications. On the other hand, it may be beneficial to have each charge fire in the same radial direction. A charge string in which each charge fires in the same radial direction would have zero-degree (0°) phasing. Still further, a gravitationally oriented shaped charge may be beneficial in certain applications. Ensuring the orientation of the shaped charges before firing may also be a critical step for ensuring accurate and effective perforating and therefore eliminating the need for multiple perforating operations for a single section of the wellbore.

Once the perforating gun(s) is properly positioned, a surface signal actuates an ignition of a fuse or detonator, which in turn initiates the detonating cord, which detonates the explosive charges to penetrate/perforate the housing and wellbore casing, and/or the surrounding rock formation to allow formation fluids to flow through the perforations thus formed and into a production string.

Typical perforating guns may suffer from shortcomings with respect to, for example, simplifying the assembly procedures for components, providing size-independent components that may be used in various gun housings having different inner diameters, and achieving the potential benefits of adaptable charge phasing including accurate orientation of shaped charges once the perforating gun is downhole (i.e., deployed within the wellbore). For example, various components of the perforating gun may require assembly and wiring on site and certain components must be specific to the perforating gun housing with the particular inner diameter that is being assembled. Metal charge tubes and other charge carriers that are not easily reconfigurable are not easily adaptable for use with different numbers of charges in different phasing and/or may not be capable of gravitational orientation. The number and phasing of charges in such rigid carriers may be limited by the number and orientation of charge holes/receivers in the particular charge carrier. Machining different charge carriers for every possible desired arrangement and number of charges in the perforating gun is not practically desirable.

In addition, a charge carrier that provides a very high charge phasing (i.e., a relatively severe angle between successive charges in the charge carrier) requires that a detonating cord make relatively drastic bends, especially for charges arranged with a relatively short distance between them, as it is routed between the initiating end of successive shaped charges. The detonating cord must be precisely positioned on the initiating end, above an initiation point, of the shaped charge to ensure that the detonating cord initiates detonation of the shaped charge. The detonating cord is retained at the initiation point of the shaped charge by a variety of known detonating cord retaining components. Typically, the forces and stresses on the detonating cord, especially at the detonating cord retaining components, increases as the phasing increases and the distance decreases between successive charges. The forces and stresses may damage the detonating cord and/or cause the detonating cord to become misaligned with the initiation point either to a side of the initiation point or in a direction away from the initiation point in which the detonating cord is pulling away from the retaining component.

Accordingly, a modular perforating gun platform system and corresponding perforating gun that may address one or more of the above shortcomings would be beneficial.

BRIEF DESCRIPTION OF THE EXEMPLARY EMBODIMENTS

An exemplary embodiment of a system for use within a gun housing of a perforating gun may include a centralizer and a detonator holder. The centralizer may include a centralizer body and a centralizer bore extending through the centralizer body. The detonator holder may be disposed within the centralizer bore and may include a first detonator holder end configured to receive a detonator and a second detonator holder end comprising a detonator holder coupling. The detonator holder may extend through the centralizer and may be mechanically coupled to the centralizer. The centralizer may be configured to engage with an inner surface of the gun housing.

An exemplary embodiment of perforating gun may include a gun housing, a centralizer disposed within the gun housing, a charge holder module having a first end coupled to the detonator holding coupling, and an end connector coupled to a second end of the shaped charge module opposite the first end of the shaped charge module. The centralizer may include a centralizer body and a centralizer bore extending through the centralizer body. The detonator holder may include a first detonator holder end configured to receive a detonator, a second detonator holder end comprising a detonator holder coupling, a feedthrough contact plate configured to be in electrical communication with a feedthrough terminal of the detonator, and a ground contact plate configured to be in electrical communication with a ground terminal of the detonator, the ground contact plate being in electrical communication with an inner surface of the gun housing. The end connector may include a conductive end contact. A signal relay wire may be provided in electrical communication with the feedthrough contact plate and the conductive end contact. The detonator holder may extend through the centralizer and may be mechanically coupled to the centralizer. The centralizer may be configured to engage with an inner surface of the gun housing.

An exemplary embodiment of a detonator holder for use in a perforating gun may include a detonator holder cap, a detonator holder stem extending from the detonator holder cap along a longitudinal axis, a detonator holder bore extending through the detonator holder stem, a ground plate slot formed in the detonator holder, a ground contact plate having a first portion disposed within the detonator holder cap and a second portion extending through the ground plate slot, a feedthrough plate slot formed in the detonator holder; and a feedthrough contact plate having a first portion disposed within the detonator holder cap and a second portion extending through the feedthrough plate slot.

BRIEF DESCRIPTION OF THE DRAWINGS

A more particular description will be rendered by reference to specific embodiments thereof that are illustrated in the appended drawings. Understanding that these drawings depict only typical embodiments thereof and are not therefore to be considered to be limiting of its scope, exemplary embodiments will be described and explained with additional specificity and detail through the use of the accompanying drawings in which.

Figure 1:
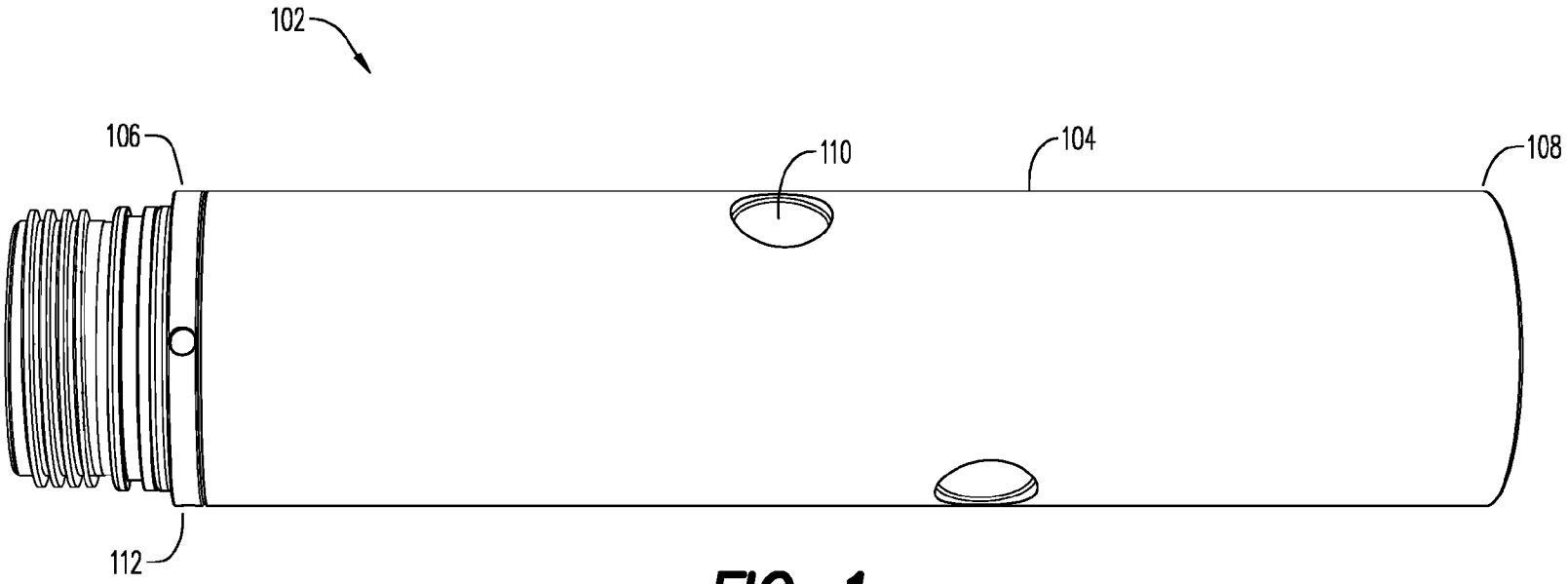
FIG. 1 is a side elevation view of an exemplary embodiment of a perforating gun in accordance with an aspect of the disclosure.

Various features, aspects, and advantages of the exemplary embodiments will become more apparent from the following detailed description, along with the accompanying drawings in which like numerals represent like components throughout the figures and detailed description. The various described features are not necessarily drawn to scale in the drawings but are drawn to aid in understanding the features of the exemplary embodiments.

The headings used herein are for organizational purposes only and are not meant to limit the scope of the disclosure or the claims. To facilitate understanding, reference numerals have been used, where possible, to designate like elements common to the figures.

DETAILED DESCRIPTION

Reference will now be made in detail to various exemplary embodiments. Each example is provided by way of explanation and is not meant as a limitation and does not constitute a definition of all possible embodiments. It is understood that reference to a particular "exemplary embodiment" of, e.g., a structure, assembly, component, configuration, method, etc. includes exemplary embodiments of, e.g., the associated features, subcomponents, method steps, etc. forming a part of the "exemplary embodiment".

For purposes of this disclosure, the phrases "devices," "systems," and "methods" may be used either individually or in any combination referring without limitation to disclosed components, grouping, arrangements, steps, functions, or processes.

A modular perforating gun platform and system according to the exemplary embodiments discussed throughout this disclosure may generally include, without limitation, separate and variously connectable or interchangeable (i.e., modular) perforating gun components. The modular components may include size-independent components configured for use with all variants of variable components, each variable component having variants for particular applications and configured for use with the size-independent component(s). Variants may have varying dimensions, geometries, structures, etc. However, each modular component may include standard features and structures (i.e., a platform) for, without limitation, connecting together in various configurations for particular applications.

The application incorporates by reference the following pending patent application in its entirety, to the extent not inconsistent with or incompatible with the present disclosure: U.S. Provisional Patent Application No. 63/166,720, filed Mar. 26, 2021.

Figure 2:
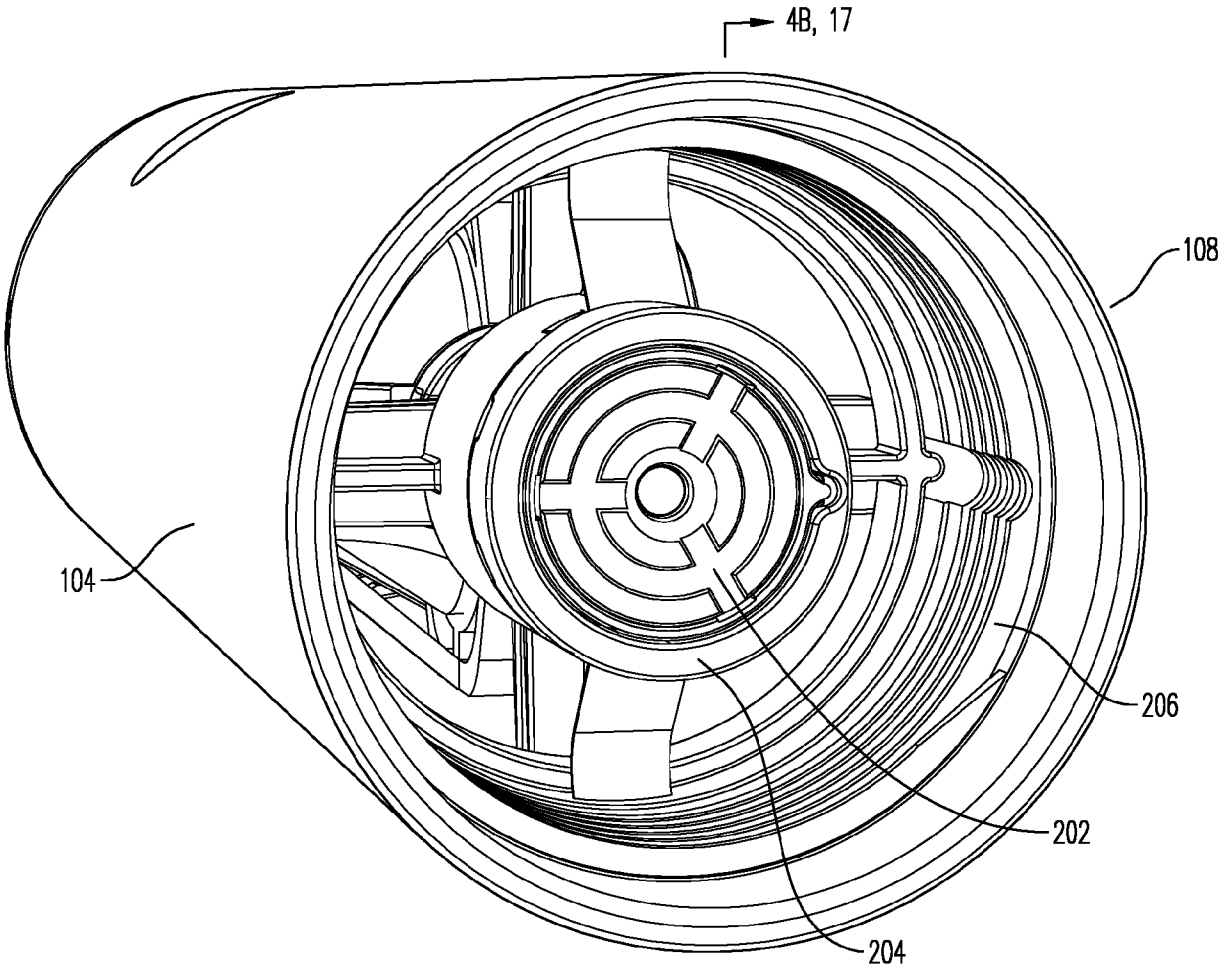
FIG. 2 is a perspective view of the perforating gun shown in FIG. 1.

With reference now to FIG. 1 and FIG. 2, an exemplary embodiment of a perforating gun 102 and perforating gun system, as discussed throughout this disclosure, includes a housing 104 with a housing first end 106 and a housing second end 108. Each of the housing first end 106 and the housing second end 108 may include inner threads 206 for connecting to, without limitation, a tandem seal adapter 112 as shown in FIG. 1, or other wellbore tools or tandem/connector subs. In an aspect, the housing first end 106 may connect to the tandem seal adapter 112 that is configured for connecting to each of the housing first end 106 of the perforating gun 102, and a housing second end of an adjacent perforating gun, thus connecting adjacent housings/perforating guns and sealing, at least in part, each housing from an external environment and from each other.

In other embodiments, a housing may have a male connection end at a housing first end. The male connection end may have an external threaded portion corresponding to and configured for connecting to the inner (i.e., female) threads 206 of the housing second end 108. The connection between the male connection end external threads and the internal threads 206 of the housing second end 108 may connect adjacent housings/perforating guns. A tandem seal adapter may not be required or used between adjacent housings with respective male and female connecting ends, or may be an internal, baffle-style tandem seal adapter. In other embodiments, each of the housing first end 106 and the housing second end 108 may have external threads for connecting to other tandem/connector subs or adjacent wellbore tools, as applications dictate. A perforating gun housing including respective male and female connecting ends may be such as disclosed in U.S. Pat. No. 10,920,543 issued Feb. 16, 2021, which is commonly owned by DynaEnergetics Europe GmbH and incorporated by reference herein, to the extent not incompatible or inconsistent with this disclosure. An internal, baffle-style tandem seal adapter may be such as disclosed in U.S. Pat. No. 10,844,697 issued Nov. 24, 2020, which is commonly owned by DynaEnergetics Europe GmbH and incorporated by reference herein, to the extent not incompatible or inconsistent with this disclosure With reference back to FIG. 1, one or more scallops 110 may be positioned along the exterior surface of the housing 104 and aligned with shaped charges positioned within an interior of the housing 104. Scallops 110 are well known as portions of a perforating gun housing at which the housing 104 has, e.g., a reduced thickness and/or additional machining to prevent potentially damaging burrs from forming when the shaped charge fires through the housing 104. Accordingly, perforating guns incorporating a housing with scallops 110 such as those shown in FIG. 1 must lock or otherwise ensure that an orientation of the shaped charges within the housing aligns with the scallops 110, if the scallops 110 are to be used.

With additional reference to FIG. 2, the exemplary embodiments include a detonator 202 retained in a detonator holder or sleeve 204 that is positioned within the housing 104 and at or near the housing second end 108. For purposes of this disclosure, the phrase "at or near" and other terms/phrases describing, for example, a position, proximity, dimension, geometry, configuration, relationship, or order, are used to aid in understanding the exemplary embodiments and without limitation to, e.g., particular boundaries, delineations, ranges or values, etc., unless expressly provided. Further, the phrase "housing second end" may be used interchangeably with the phrase "housing detonator end" with reference to an end of the housing 104 at which the detonator 202 is positioned or nearest in an assembled perforating gun 102, to aid in understanding, e.g., the position and relationship between components.

With additional reference to FIG. 3, FIG. 4A, FIG. 4B, FIG. 5, FIG. 6, and FIG. 7, the detonator holder 204 is retained and centralized within the housing 104 by a centralizer 302. The exemplary centralizer 302 as shown in, for example, FIGS. 3-5, has a ring 304 encircling a centralizer body such as an axially oriented center tube 320. The center tube 320 may define a centralizer bore such as a center tube passage 506 extends through the center tube 320. The center tube 320 may receive a detonator holder stem 514 of the detonator holder 204. In other words, the centralizer 302 may be slid over the detonator holder stem 514 to adjoin a cap 516 of the detonator holder 204. The detonator holder stem 514 may extend from the detonator holder cap 516 along a longitudinal axis.

Figure 3:
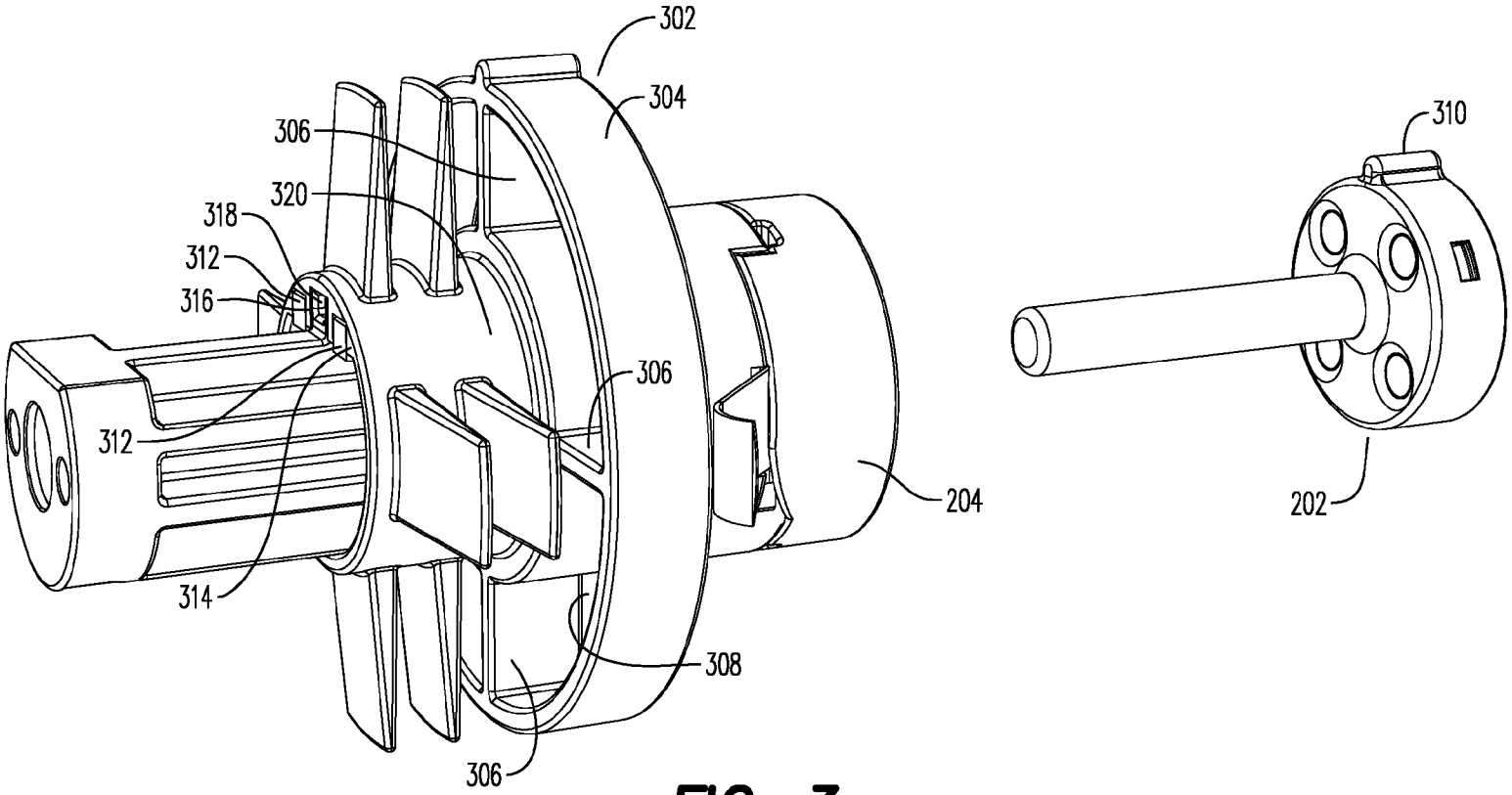
FIG. 3 is a perspective view of an assembly of a centralizer and a detonator holder, shown with a detonator in accordance with an aspect of the disclosure.
Figure 5:
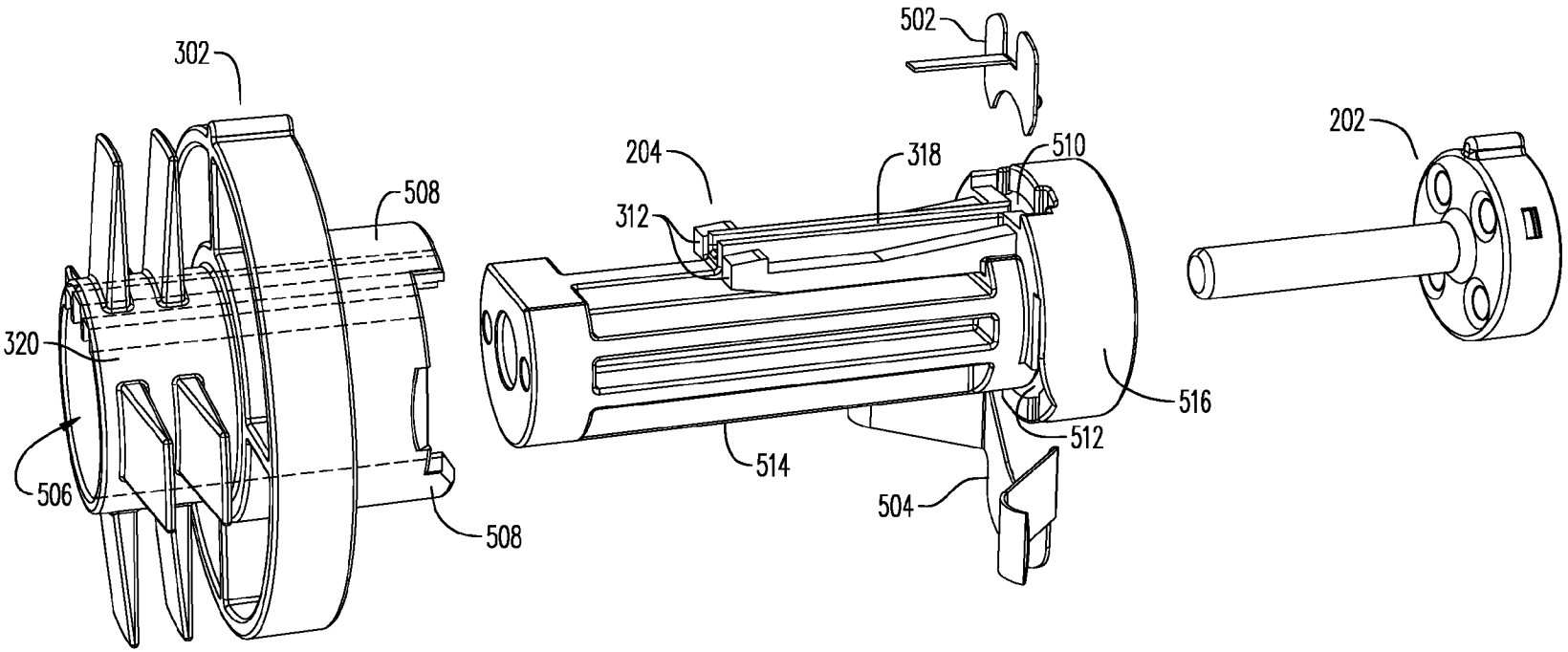
FIG. 5 is an exploded assembly view of the centralizer, detonator holder, and detonator shown in FIG. 3.

With specific reference to FIG. 3 and FIG. 5, the detonator holder 204 includes a relay wire channel 318 and two locking tabs 312 extending axially along the detonator holder stem 514. A signal relay wire 816 (FIG. 8) is routed out of the detonator holder 204 via the relay wire channel 318. When the centralizer 302 is slid over the detonator holder stem 514, such that the detonator holder 204 extends through the centralizer 302, the center tube 320 covers the relay wire channel 318 to hold the signal relay wire 816 in place. The center tube 320 includes a relay signal outlet 316 for the relay wire channel 318, thereby allowing the signal relay wire 816 to pass through. The center tube 320 includes tab locking structures 314 for positively locking against the locking tabs 312, to hold the detonator holder 204 in the centralizer 302. In other words, the detonator holder 204 may be mechanically coupled to the centralizer 302.

Figure 4A:
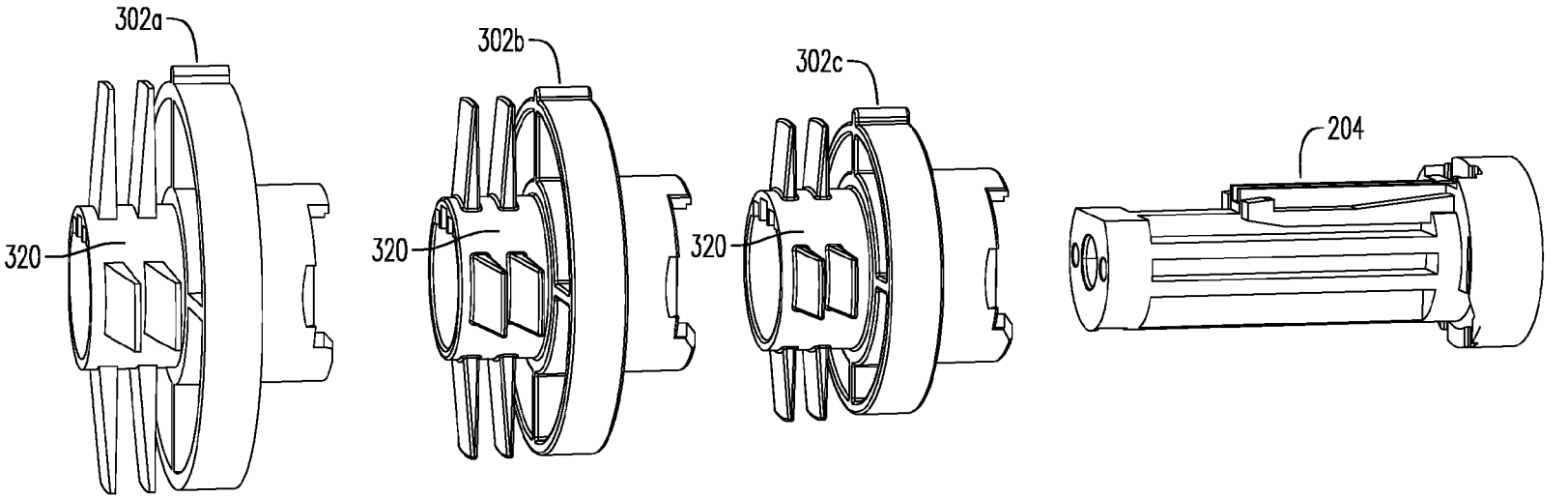
FIG. 4A is a perspective view of various sizes of centralizers that can be used with the detonator holder shown in FIG. 3 in accordance with an aspect of the disclosure.
Figure 4B:
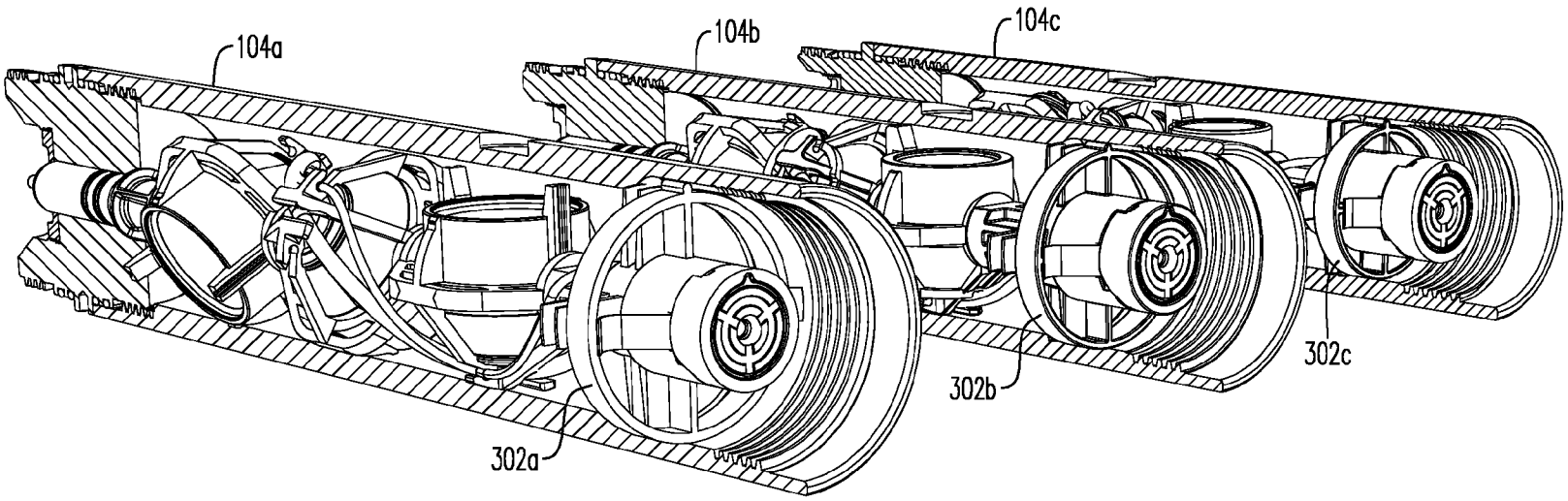
FIG. 4B shows cutaways of three sizes of perforating guns using the various sizes of centralizers and detonator holder shown in FIG. 4A in accordance with an aspect of the disclosure.

With reference specifically to FIG. 4A and FIG. 4B, the detonator holder 204 according to the exemplary embodiments is, in an aspect, a component that is configured for use with, e.g., a variety of centralizers 302*a*, 302*b*, 302*c*. Each of the centralizers 302*a*, 302*b*, 303*c* is correspondingly configured for use with the detonator holder 204. For example, each of the centralizers 302*a*, 302*b*, 302*c* will assemble to the detonator holder 204, and position the detonator holder 204 within a perforating gun housing 104*a*, 104*b*, 104*c*, in a similar manner. In an exemplary modular perforating gun platform and without limitation, each of the centralizers 302*a*, 302*b*, 302*c* may be configured, i.e., dimensioned, for use with a particular perforating gun size. The detonator holder 204 and a corresponding centralizer may be used for each of gun sizes (i.e., housing internal diameters) 3.5" (104*a*, 302*a*), 3⅛" (104*b*, 302*b*), and 2¾" (104*c*, 302*c*). For example, a corresponding centralizer 302*a*, 302*b*, 302*c* may have an outer diameter at the ring 304 that is substantially equal to the housing internal diameter. For purposes of this disclosure, "substantially equal" is used, without limitation, to aid in the understanding of the exemplary embodiments in which, for example, the inner diameter of the housing 104 provides a barrier against the centralizer 302 to prevent the centralizer 302 from tilting or radial misalignment. In an aspect, parts configured for particular gun sizes may be color coded to enhance a production process, while using a detonator holder 204 with each size variant may improve production logistics. For example, size-independent parts such as the detonator holder 204 may be a first color such as yellow. Parts corresponding to a 3.5" gun size system (e.g., centralizer 302*a*) may be a second color such as cyan, parts for a 3⅛" gun size system (e.g, centralizer 302*b*) may be third color such as blue, and parts for a 2¾" gun size system (e.g., centralizer 302*c*) may be a fourth color such as green.

Figure 6:
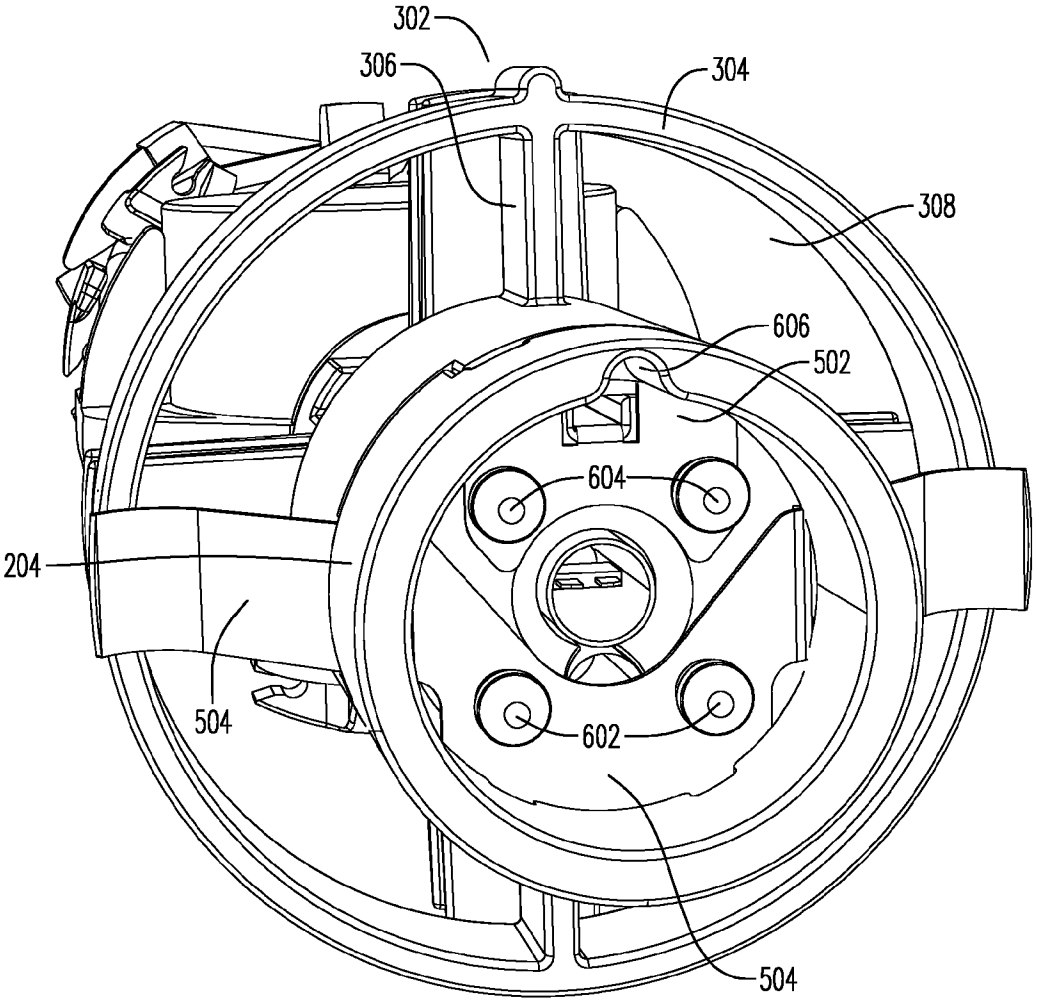
FIG. 6 is a perspective view of an internal gun assembly according to an exemplary embodiment.

With additional reference to FIG. 6, the ring 304, in an aspect, is connected to the center tube 320 by spokes 306, thereby forming open areas 308 that add to the free gun volume (i.e., volume not occupied by a physical component within the housing 104) when the centralizer 302 is positioned within the housing 104.

Figure 7:
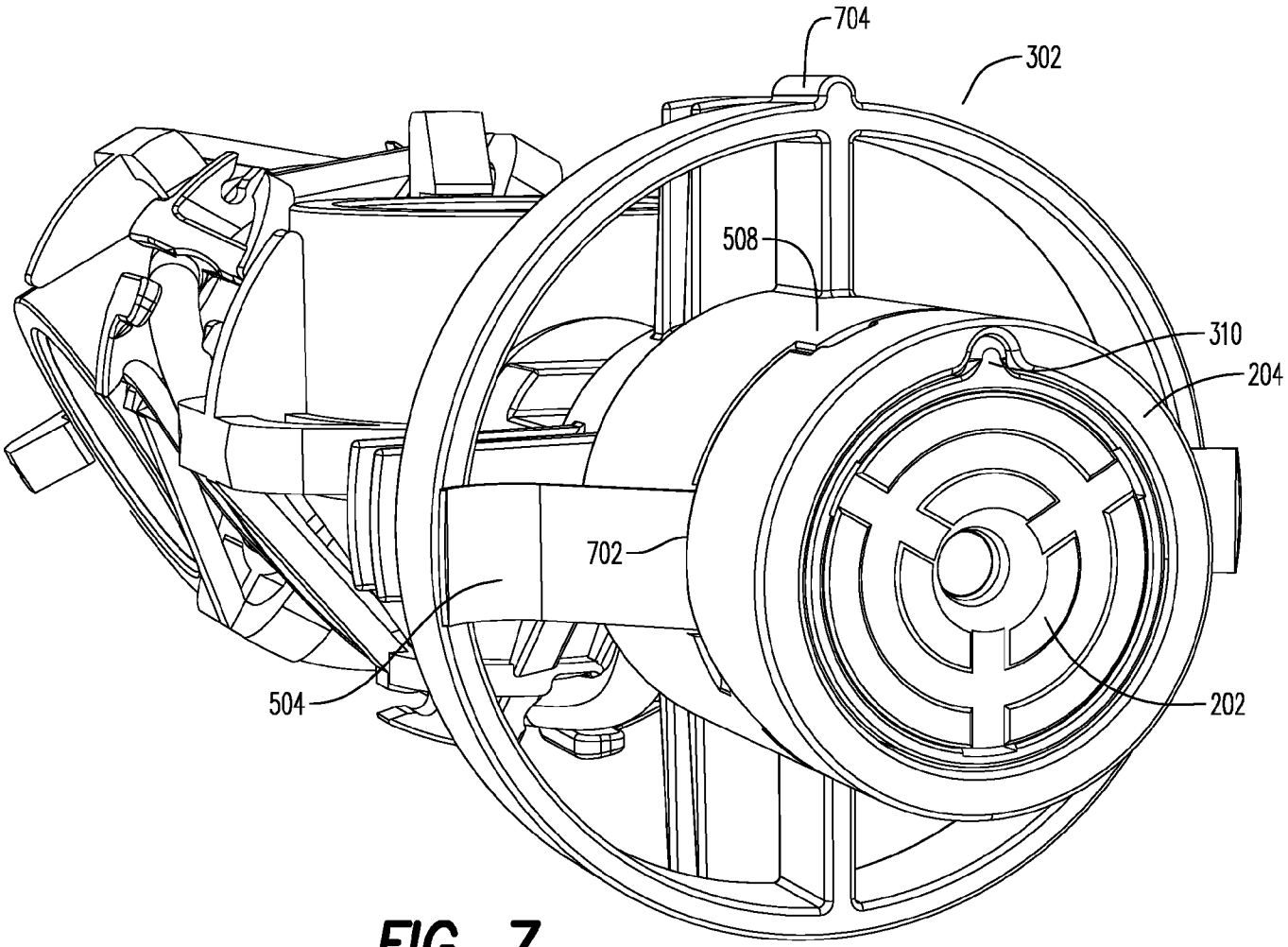
FIG. 7 is a perspective view of the internal gun assembly shown in FIG. 6, shown with a detonator according to an aspect of the disclosure.

With reference to FIG. 5, FIG. 6, and FIG. 7, the detonator holder 204 receives and houses the detonator 202 in a first detonator holder end. In an aspect, inserting the detonator 202 into the detonator holder 204 automatically makes various wireless electrical connections between electrical contacts on the detonator 202 and corresponding electrical contacts on the detonator holder 204, as explained further below. For purposes of this disclosure, "wireless electrical connection" means an electrical connection formed by physical contact between conductive components, without any wires electrically connecting the conductive components. "Electrical contact" means either a conductive component for making a wireless electrical connection, or a state of physical, conductive contact between conductive components, as the context makes clear.

In an aspect and as illustrated in FIG. 5 and FIG. 6, the detonator holder 204 includes a feedthrough contact plate 502 positioned and exposed within the detonator holder cap 516. The feedthrough contact plate 502 includes one or more feedthrough contact pins 604 for establishing electrical communication with a feedthrough terminal of the detonator. The multiple feedthrough contact pins 604 may provide redundancy to insure a stable connection to the feedthrough terminal of the detonator. The feedthrough contact plate may include a first portion disposed within the detonator holder cap 516 and a second portion extending through the feedthrough plate slot 510.

A ground contact plate 504 is also positioned within the detonator holder cap 516 and includes one or more ground contact pins 602 for establishing electrical communication with a ground terminal of the detonator. The ground contact plate 504 may include a first portion disposed within the detonator holder cap 516 and a second portion extending through the ground plate slot 512. The second portion of the ground contact plate 504 may be configured to provide an electrical path to ground, and may be in electrical communication with an inner surface of the gun housing 104.

Sliding the centralizer 302 over the detonator holder stem 514 secures each of the feedthrough contact plate 502 and the ground contact plate 504 in position within a respective feedthrough plate slot 510 and ground contact ground plate slot 512 formed in the detonator holder 204. The feedthrough contact plate 502 and the ground contact plate 504 are secured by corresponding contact plate securing structures 508 on the centralizer 302. The contact plate securing structures 508 are configured, i.e., positioned and dimensioned, to cover the feedthrough plate slot 510 and the ground contact ground plate slot 512 when the centralizer 302 adjoins the detonator holder cap 516. In an aspect, the feedthrough contact plate 502 is completely covered by the contact plate securing structure 508, and not exposed to another outside surface or body above the feedthrough plate slot 510. Accordingly, the need for a protective shield component for isolating the feedthrough contact plate 502 may be eliminated. In another aspect and as illustrated in FIG. 7, the ground contact plate 504 extends out of the detonator holder 204 through a gap 702 between the contact plate securing structures 508, and is configured for making grounding contact with the housing 104 when the centralizer 302 and detonator holder 204 are received within the housing 104. The feedthrough contact plate 502 and ground contact plate 504 are not limited to the "plate" configuration of the exemplary embodiments and may respectively take any form, configuration, shape, etc. consistent with this disclosure. With specific reference to FIG. 3, FIG. 6, and FIG. 7, the detonator 202 according to the exemplary embodiments includes a detonator alignment key 310 for properly orienting the detonator 202 within the detonator holder 204. The detonator alignment key 310 is positionable within a key slot 606 in the detonator holder 204, to orient the detonator 202 within the detonator holder 204. The centralizer 302 includes a centralizer alignment key 704 for orienting the detonator holder 204 and the detonator 202 within the housing 104. In an aspect, the detonator 202 includes an orientation sensor. Thus, the orientation of the detonator 202 within the housing 104 must be properly established as a reference for the orientation sensor to correctly determine whether the perforating gun 102 is in a desired orientation within the wellbore.

In various aspects, the detonator 202, detonator holder 204, and centralizer 302 may individually and via their interaction provide a relatively short assembly for positioning the detonator 202 within the housing 104, as discussed further below. Thus, the overall length of the perforating gun 102 may be reduced, and more perforating guns connected as part of a tool string and deployed during one perforation run into the wellbore, because, e.g., perforating gun tool string length may be limited by the cable strength, and rig-up height at the well surface.

Figure 8:
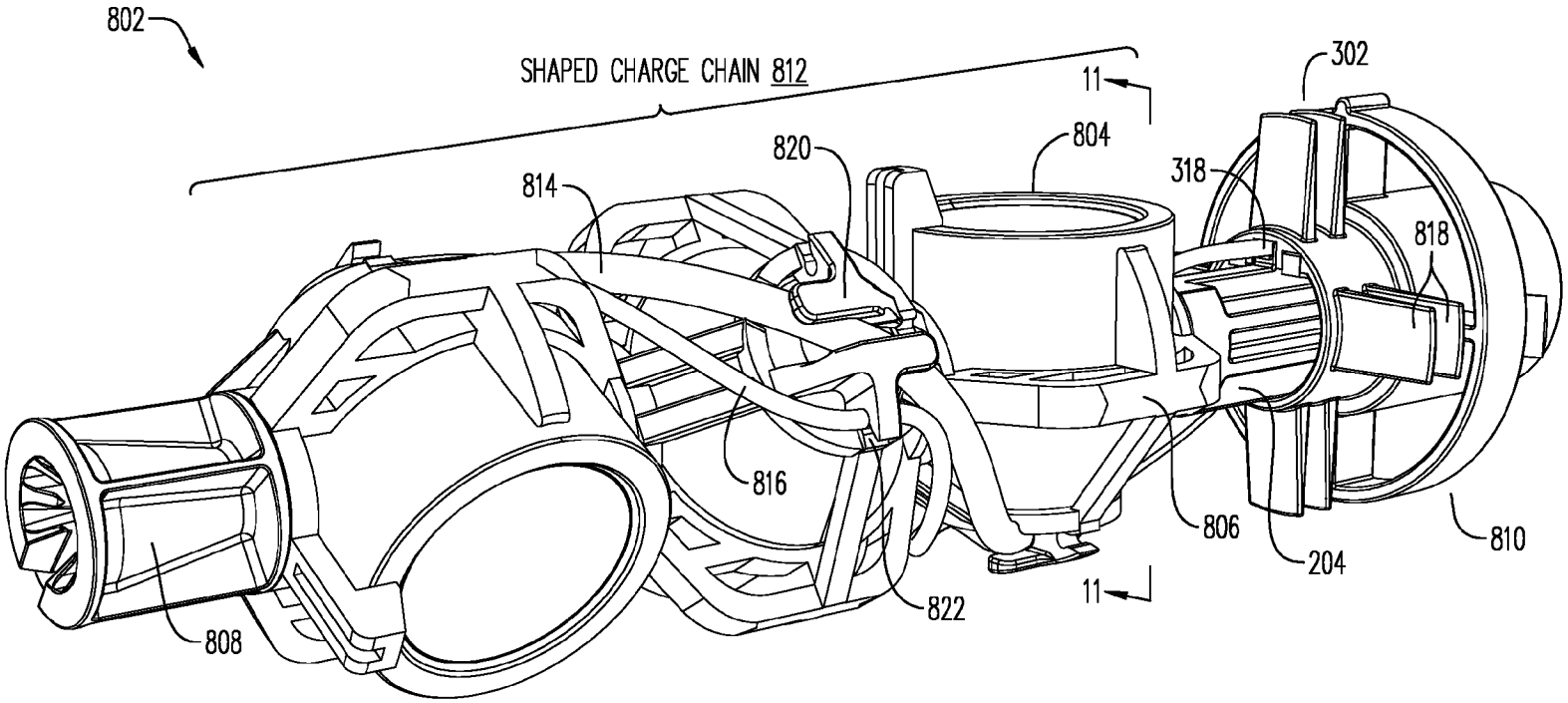
FIG. 8 is another perspective view of the internal gun assembly shown in FIG. 6.
Figure 9:
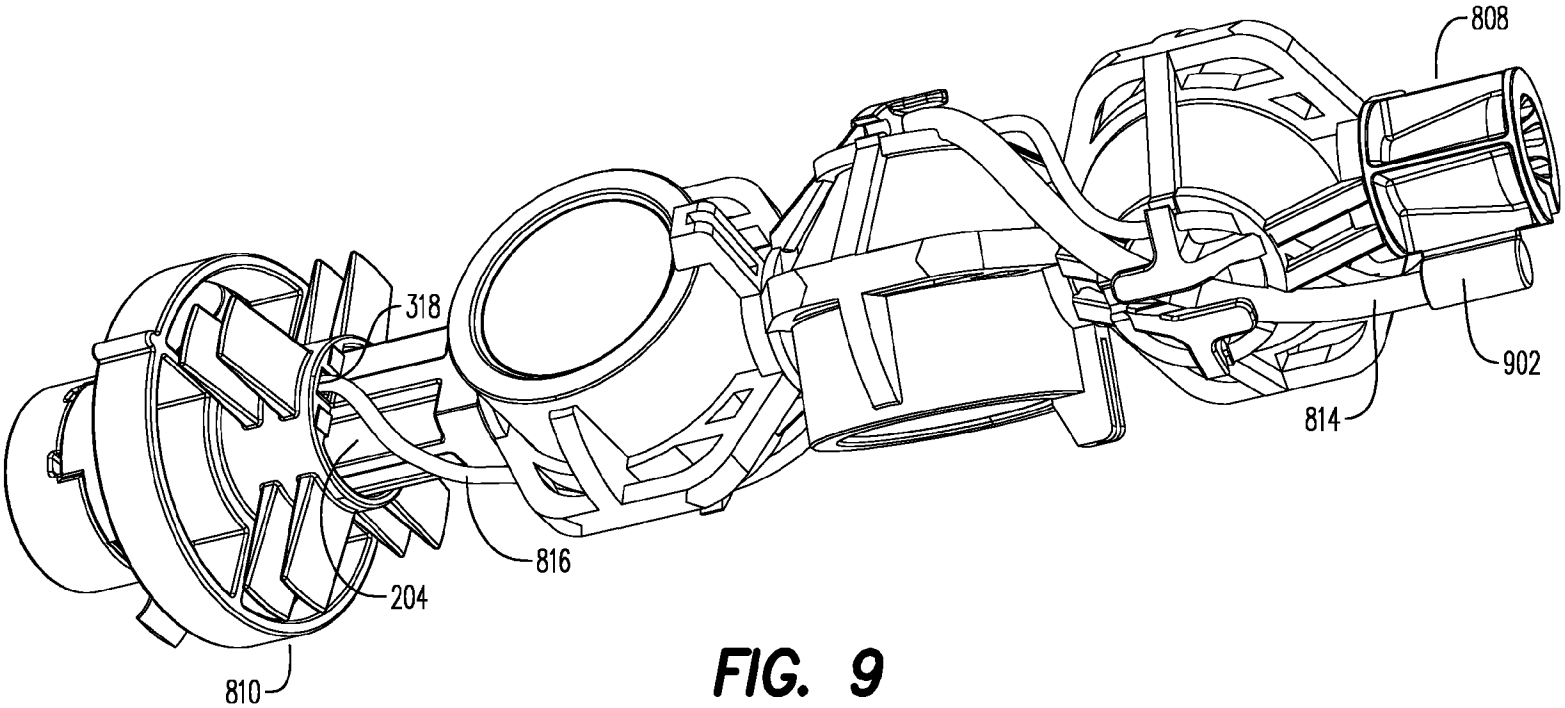
FIG. 9 is a perspective view of an internal gun assembly according to an exemplary embodiment.
Figure 10:
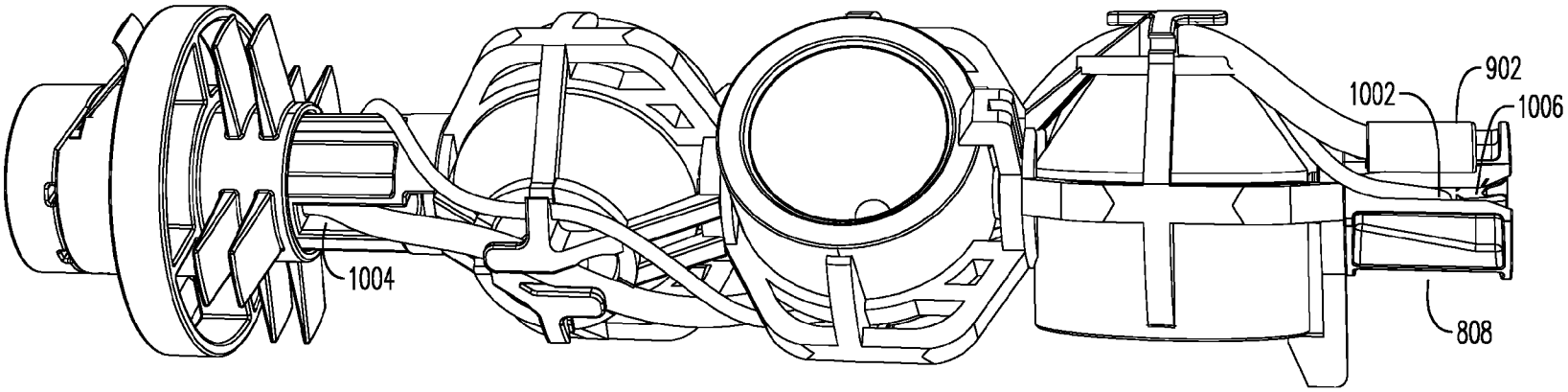
FIG. 10 is a perspective view of an internal gun assembly according to an exemplary embodiment.

With reference to FIG. 8, FIG. 9, and FIG. 10, an exemplary internal gun assembly 802 that is positioned within the housing 104 of the perforating gun 102 includes shaped charges 804 respectively received and retained in corresponding shaped charge holders 806 that are connected together in a chain 812. For the sake of this disclosure, a charge holder module may be considered to be either a single shaped charge holder 806 or the chain 812 of multiple shaped charge holders. The charge holder module may be coupled to the detonator holder coupling at a first end of the charge holder module. Each shaped charge 804 may be configured to form a perforation tunnel in a well, and may include a shaped charge case that forms a hollow cavity. Each shaped charge 804 typically includes an explosive load, for example positioned in the cavity of the shaped charge case. In some embodiments, the explosive load is disposed within the hollow cavity of the shaped charge case, and a liner is disposed adjacent to the explosive load (for example with the explosive load disposed between the liner and the shaped charge case). The liner may be configured to retain the explosive load in the hollow cavity of the shaped charge case. Some shaped charge 804 embodiments may also include a shaped charge inlay, which may be disposed on top of at least a portion of the liner (e.g. such that at least a portion of the liner is between the inlay and the explosive load). Each shaped charge 804 is typically configured to form a perforating jet for creating perforation holes in a target (e.g. the casing and/or rock formation of the well). Further details regarding shaped charges 804 are described in U.S. application Ser. No. 17/383,816. Filed Jul. 23, 2021, and U.S. Pat. No. 11,053,782, issued Jul. 6, 2021, which are hereby incorporated by reference in their entirety to the extent not inconsistent or incompatible with this disclosure.

Figure 17:
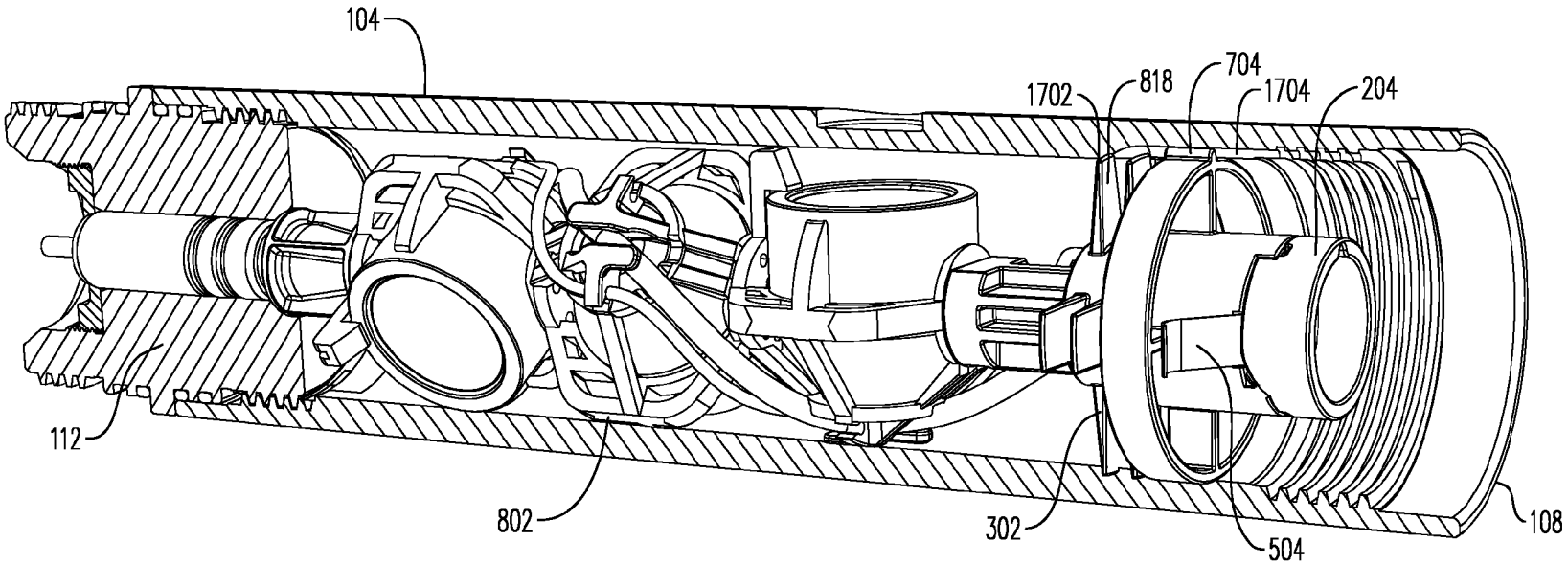
FIG. 17 is a perspective, cutaway view of an exemplary embodiment of a perforating gun in accordance with an aspect of the disclosure.
Figure 18:
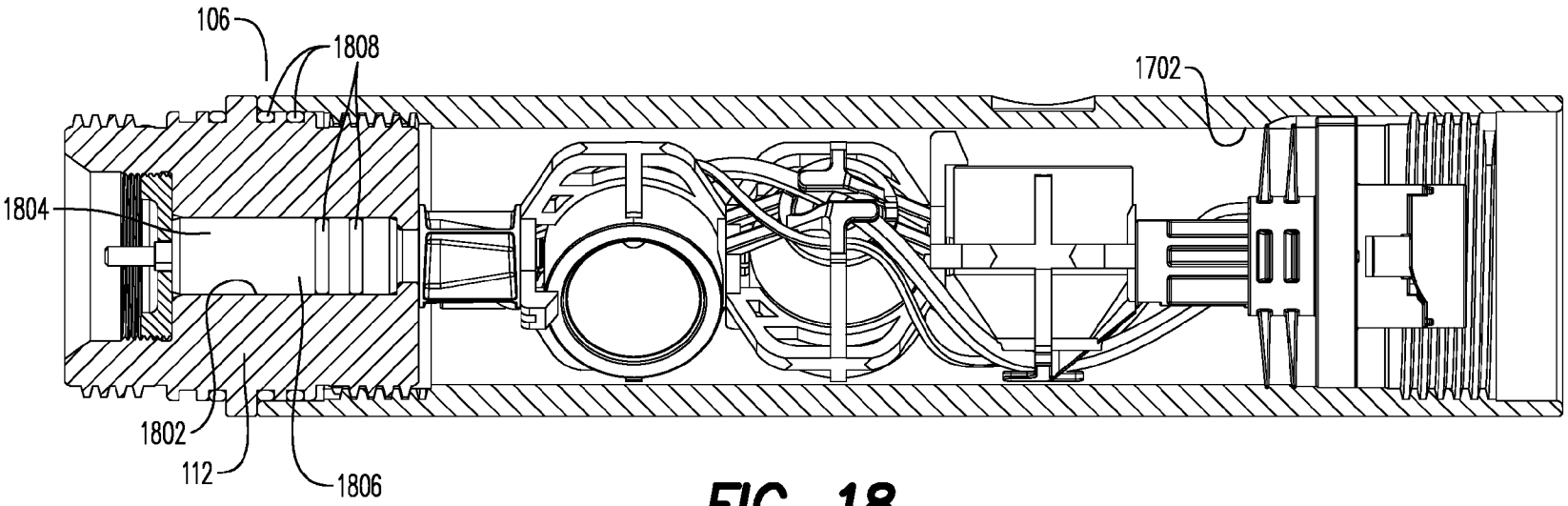
FIG. 18 is a side, cutaway view of the perforating gun shown in FIG. 17.

The detonator holder 204 is connected via the detonator holder stem 514 to a shaped charge holder 806 at a first end of the shaped charge chain 812. To aid in understanding the exemplary embodiments, this disclosure may refer to the detonator holder 204 and the centralizer 302 together, without limitation, as a detonator end assembly 810 of the internal gun assembly 802. In an aspect, the centralizer 302 includes one or more fins 818 extending radially outwardly from an exterior of the center tube 320, for contacting and pressing against an inner surface 1702 (FIG. 17) of the housing 104 to prevent axial movement of the centralizer 302 and thereby the internal gun assembly 802 within the housing 104. A conductive end connector 808 is connected to a shaped charge holder 806 at a second end of the shaped charge chain 812, opposite the first end.

In an aspect, the detonator end assembly 810 is configured for connecting to a component of the internal gun assembly 802 and being housed, as part of the internal gun assembly 802, within the housing 104. According to the exemplary embodiments, the detonator end assembly 810 is configured for connecting to the shaped charge holder 806 at the first end of the shaped charge chain 812. In other embodiments, the detonator end assembly 810 may connect to another component of the internal gun assembly 802, such as a spacer (not shown) configured for, e.g., connecting to components of the internal gun assembly 802 according to the exemplary embodiments.

A detonating cord 814 extends from the detonator holder 204 within which it is positioned and held in sufficiently close proximity (i.e., "ballistic proximity") to the detonator 202, or a ballistic transfer such as a booster in ballistic proximity to each of the detonator 202 and the detonating cord 814, such that the detonating cord 814 will initiate in response to the detonator 202 initiating. The detonating cord 814 exits the detonator holder 204 via a detonating cord channel 1004 which extends into the detonator holder 204 in a configuration that provides the ballistic proximity between a portion of the detonating cord 814 that is within the detonating cord channel 1004 within the detonator holder 204. In the exemplary embodiments, without limitation, the detonating cord channel 1004 is adjacent to a detonator bore 1106 (FIG. 11) within which the detonator 202 is housed as explained further below.

The detonating cord 814 extends along the shaped charge chain 812 and connects to each shaped charge holder 806 at a cord clip 820 that holds the detonating cord 814 in position for initiating the shaped charge 804. The detonating cord 814 is ultimately held by a terminal cord retainer 902 that serves to hold the detonating cord 814 at or near an end of the detonating cord 814 and to keep the detonating cord 814 from interfering with the assembly, or insertion into the housing 104, of the internal gun assembly 802. In the exemplary embodiment, the terminal cord retainer 902 is a blind cylindrical container on the conductive end connector 808, but may take any form consistent with this disclosure.

The signal relay wire 816 extends via the relay wire channel 318 out of the detonator holder 204, within which it is positioned and held in electrical contact with the feedthrough contact plate 502 or an electrical relay in electrical contact with each of the feedthrough contact plate 502 and the signal relay wire 816. In an exemplary embodiment, the signal relay wire 816 may be in electrical communication with the second portion of the feedthrough contact plate 502. The signal relay wire 816 extends along the shaped charge chain 812 and is routed through cord slots 822 on each shaped charge holder 806. The signal relay wire 816 extends to the conductive end connector 808 and relays and electrical signal between the feedthrough contact plate 502 and the conductive end connector 808. The signal relay wire 816 is inserted, via a relay wire slot 1002, into the conductive end connector 808, and positioned in electrical contact with a conductive end contact 1006 that is also positioned within the conductive end connector 808.

Figure 11:
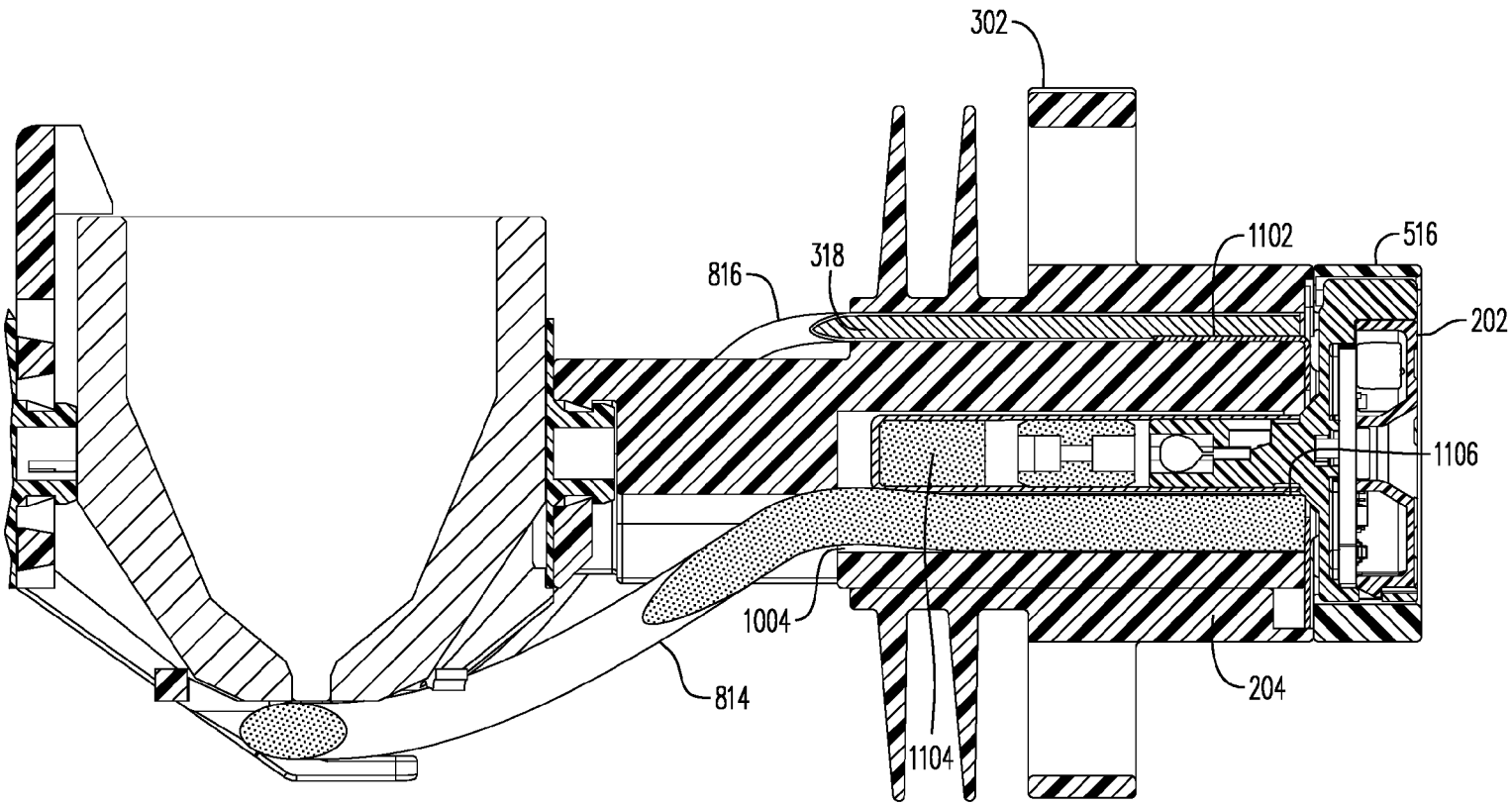
FIG. 11 is a cross section of an exemplary embodiment of a shaped charge holder, detonator holder, and centralizer in accordance with an aspect of the disclosure.

With reference to FIG. 11, a cross-section of the detonator holder 204, among other things, is shown. The signal relay wire 816 is positioned in the relay wire channel 318 that extends to the feedthrough plate slot 510, and a feedthrough contact plate leg 1102 of the feedthrough contact plate 502 extends into or adjacent to the relay wire channel 318. In an aspect, the signal relay wire 816 may be welded to the feedthrough contact plate leg 1102. The detonating cord 814 enters the detonator holder 204 via the detonating cord channel 1004 which extends into the detonator holder 204 in a position that puts the detonating cord 814 in ballistic proximity to an explosive portion 1104 of the detonator 202.

Figure 12:
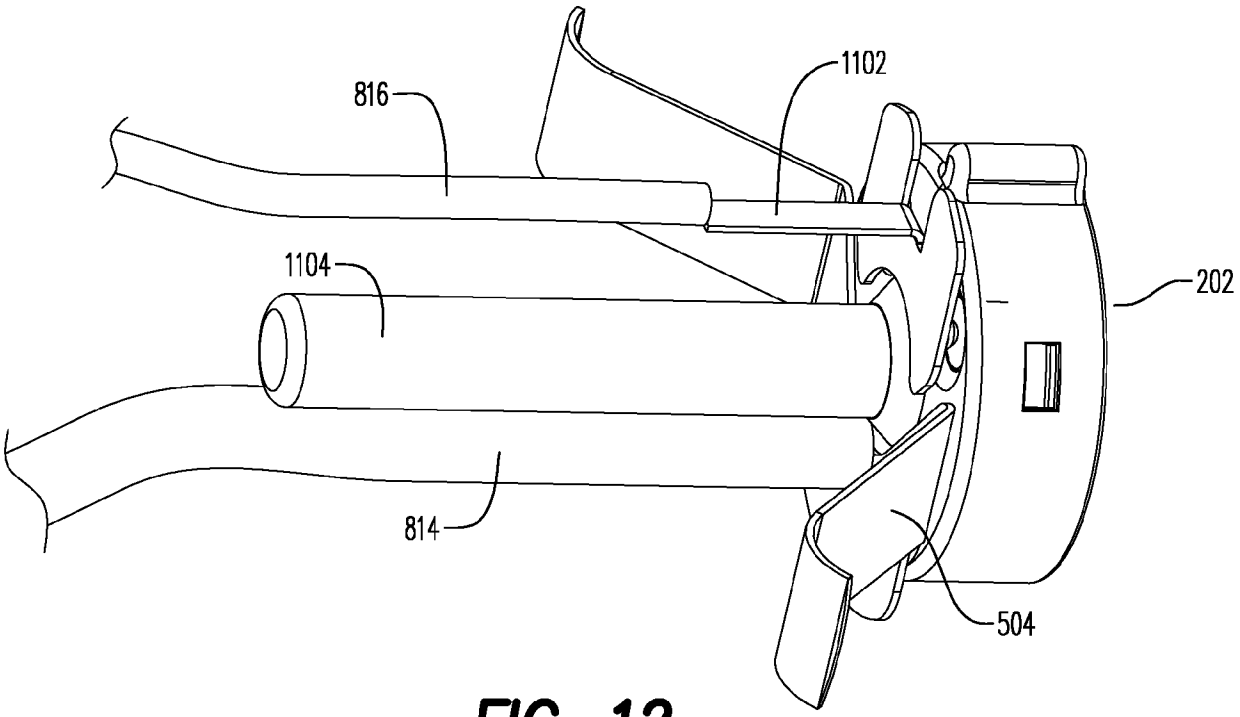
FIG. 12 is a perspective view of an arrangement of certain components within a detonator holder in accordance with an aspect of the disclosure.

FIG. 12 shows an arrangement of certain components within the detonator holder 204, in isolation. The detonator explosive portion 1104 is in ballistic proximity to the detonating cord 814, and the signal relay wire 816 is connected to the feedthrough contact plate leg 1102.

Figure 13:
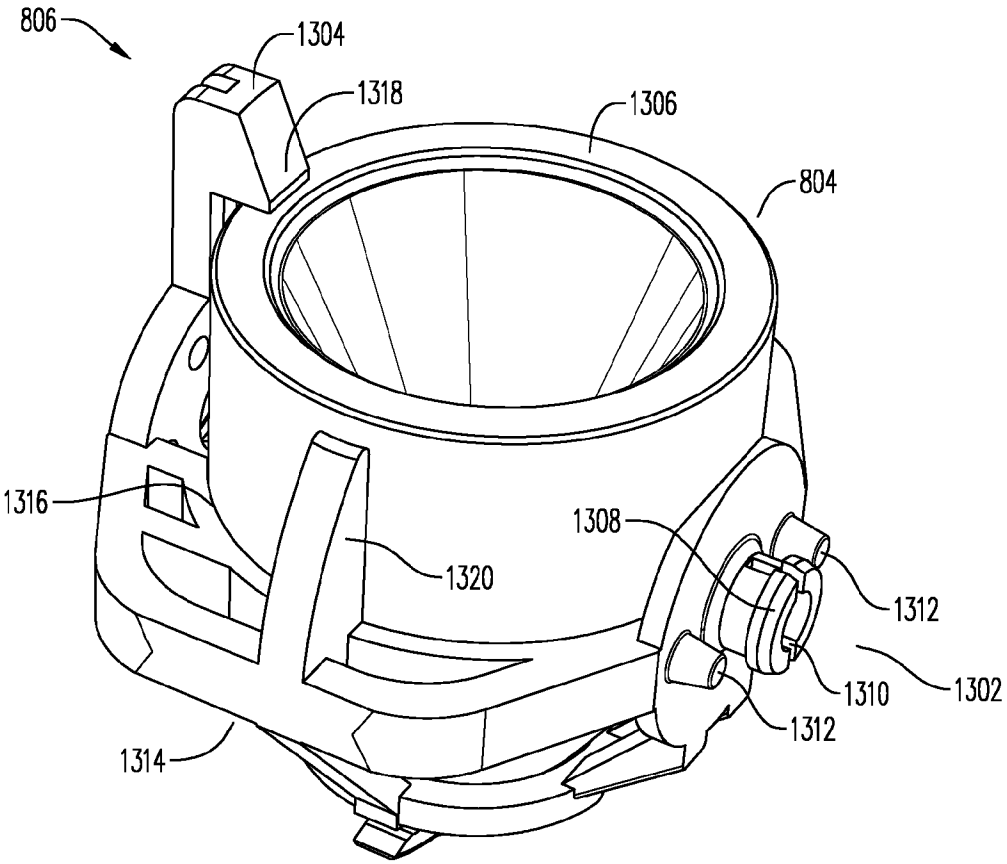
FIG. 13 is a perspective view of a shaped charge holder and shaped charge in accordance with an aspect of the disclosure.
Figure 14:
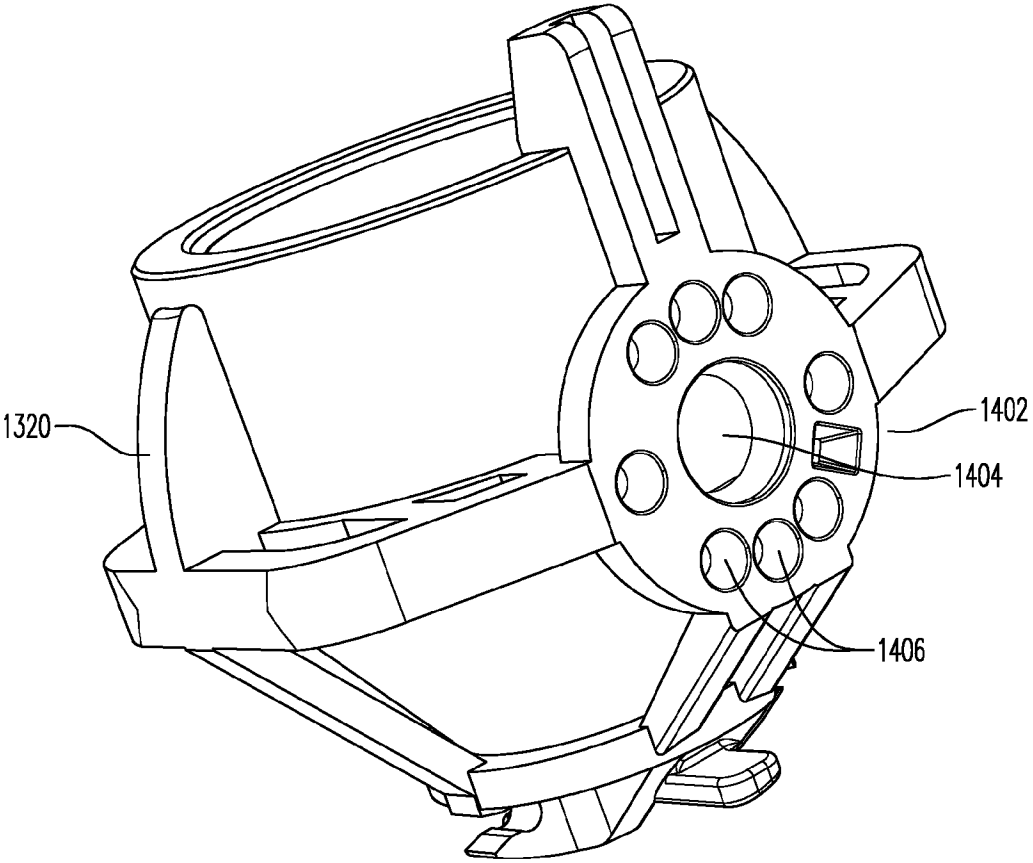
FIG. 14 is a perspective view of a shaped charge holder and shaped charge in accordance with an aspect of the disclosure.
Figure 15:
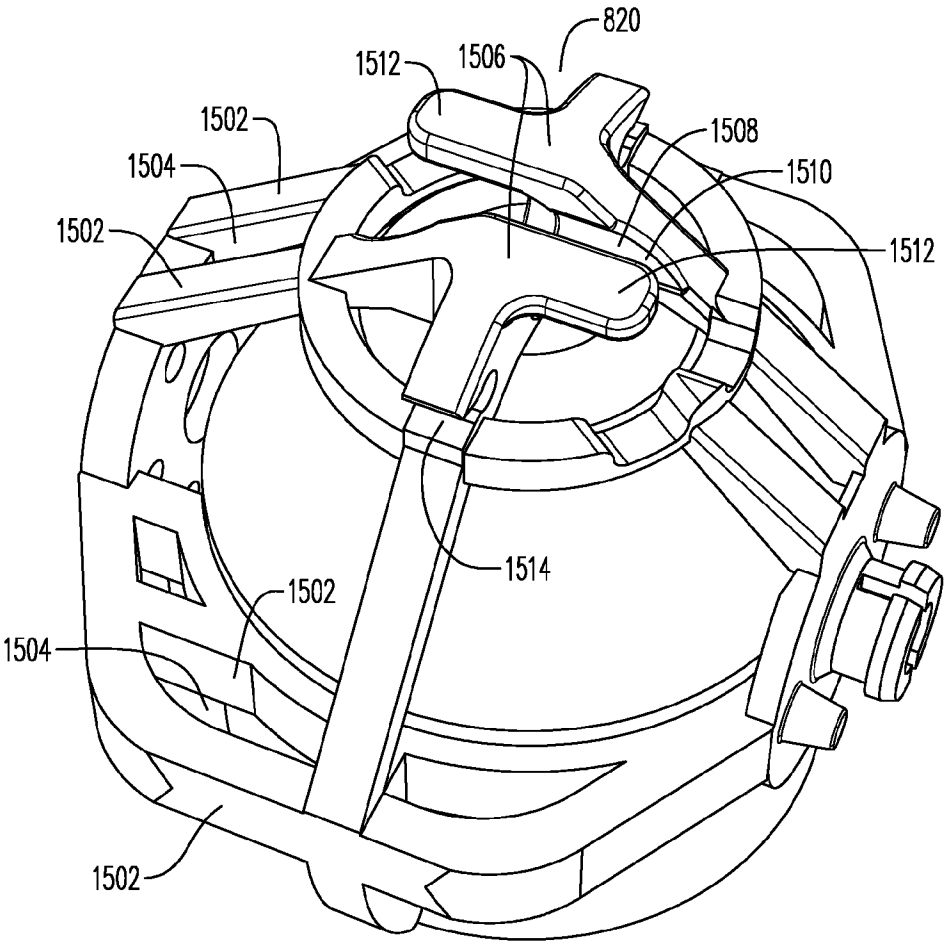
FIG. 15 is a perspective view of a shaped charge holder and shaped charge in accordance with an aspect of the disclosure.

With reference to FIG. 13, FIG. 14, and FIG. 15, an exemplary shaped charge holder 806 for use with the modular perforating gun platform is shown. Like the detonator holder 204 and the centralizer 302, the shaped charge holder 806 may be color coded according to the gun size with which it is used. The shaped charge holder 806 may include a shaped charge holder body 1314 defining a shaped charge holder receptacle 1316 in which the shaped charge 804 is inserted. One or more alignment posts 1320 may guide and orient the shaped charge 804 in the shaped charge holder receptacle 1316. One or more retention clips 1304 may extend from the shaped charge holder body 1314, in a direction that is away from the shaped charge holder receptacle 1316, and may be resilient to move out of the way when the shaped charge 804 is inserted. The retention clip(s) 1304 may be configured to move back into place once the shaped charge 804 is inserted and may be configured, i.e., positioned and dimensioned, to extend above a height of the shaped charge 804 positioned within the shaped charge holder receptacle 1316. The one or more retention clips 1304 may each include a retention tab 1318 that snaps into a depression or divot formed in the external surface of a case 1306 of the shaped charge 804, to retain the shaped charge 804 within the shaped charge holder receptacle 1316.

The shaped charge holder 806 may have a male connecting side 1302 for connecting to e.g., an adjacent shaped charge holder 806, the detonator holder 204, or an additional component, such as a spacer, of the internal gun assembly 802. The connections may be standardized between different components. The male connecting side 1302 may include a knob connector 1308 that may be a cylindrical extension and include an area of increased diameter at its top, and a slit 1310 extending along its length. The area of increased diameter and the slit 1310 provide a structure and resiliency for the knob connector 1308 to engage and positively lock against a corresponding structure formed within, e.g., a central bore 1404 of a female connecting side 1402 opposite the male connecting side 1302. The male connecting side 1302 may include phasing protrusions 1312 that may fit within phasing holes 1406 arranged around the female connecting side 1402, such that adjacent shaped charge holders 806 (or other components) may be oriented at a desired phasing relative to one another by "clocking" (i.e., rotating) adjacent shaped charge holders through the different positions, such as numbers arranged around a clock face, corresponding respectively to different phasing.

Figure 16:
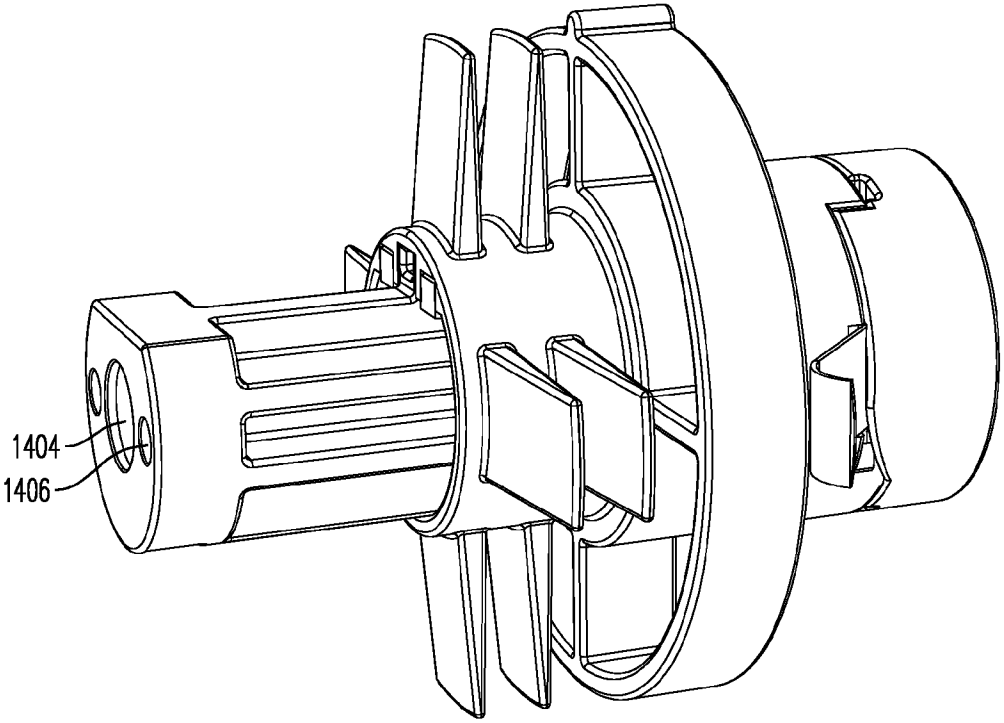
FIG. 16 is a perspective view of an assembly of a centralizer and a detonator holder according to an exemplary embodiment.

As shown in FIG. 16, the detonator holder 204 may also include a central bore 1404 and two or more phasing holes 1406 for connecting to the male connecting side 1302 of a shaped charge holder 806. In other words, the phasing holes 1406 provided in the detonator holder 204 may be a detonator holder coupling provided at a second end of the detonator holder 204. The central bore 1404 may serve as a detonator holder bore extending through the detonator holder stem and configured to receive at least a portion of the detonator.

The cord clip 820 for holding the detonating cord 814 in position for initiating the shaped charge 804 may include oppositely disposed retention arms 1506 that form a detonating cord receptacle 1508 contoured for retaining the detonating cord 814 in a manner to increase the locking force on the detonating cord 814 as the phasing between adjacent charge holders increases. For example, each oppositely disposed retention arm 1506 includes a shaped sidewall portion 1510 and a corresponding flange 1512 extending transversely from a top section of the retention arm 1506.

The shaped charge holder 806 may have a cage structure in which portions of the shaped charge holder 806 are configured with cage bars 1502 with cage voids 1504 between the cage bars 1502, rather than fully solid pieces. For example, the shaped charge holder 806 may be configured without solid wall elements, to increase free gun volume. The cage structure may impart a high mechanical strength while increasing the amount of free volume (without limitation, by up to 30% or more) within the housing 104 and decreasing the amount of material required to form the shaped charge holder 806. Injection molding processes may run more efficiently, and the final product given increased mechanical strength, when a single part is broken up into separate parts with their own thickness. In addition, smaller portions may have a decreased cool-down time, which may benefit injection molding production capacity.

The shaped charge holder 806 may further include one or more relay wire clips 1514 (e.g. also termed cord slots 822, in FIG. 8) extending transversely from the detonating cord receptacle 1508. The relay wire clip 1514 may be configured to hold the signal relay wire 816 as it is routed across the shaped charge holders 806. The internal gun assembly 802 may therefore provide additional flexibility in assembling the internal gun assembly 802 because each of the detonating cord 814 and the signal relay wire 816 may be connected to the shaped charge holders 806 after the detonator end assembly 810, shaped charge holders 806, and conductive end connector 808 are assembled together. For example, the detonator end assembly 810 may be provided assembled with the signal relay wire connected to the feedthrough contact plate 502 and extending out of the detonator end assembly 810, and the shaped charges 804 connected to the detonator end assembly 810, each other, and the conductive end connector 808. The signal relay wire 816 and the detonating cord 814 may then be connected to each shaped charge holder 806 as discussed above (the detonating cord 814 may first be inserted into the detonating cord channel 1004), and then inserted respectively into the relay wire slot 1002 and terminal cord retainer 902, because each connection (except for the signal relay wire connection to the feedthrough contact plate 502) is exposed for connections. Increased mechanical strength of the shaped charge holders 806 may also eliminate the need to place the shaped charges 804 in the shaped charge holders 806 before the detonating cord 814 and signal relay wire 816 are connected.

With reference to FIG. 17, FIG. 18, FIG. 19, and FIG. 20, and the exemplary embodiments shown therein, the internal gun assembly 802 is received within the gun housing 104. According to an aspect, the internal gun assembly 802 is housed within the housing 104. The centralizer 302 and the detonator holder 204 (i.e., the detonator end assembly 810) is positioned nearest the housing second end 108 (i.e., the housing detonator end 108). The tandem seal adapter 112 is connected to the housing first end 106. Fins 818 on the centralizer 302 may contact and press against the housing inner surface 1702 to lock the internal gun assembly 802 in position within the housing 104. In an aspect, the fins 818 contact a portion of the housing inner surface 1702 that is not machined and therefore has a relatively rough texture. The rough texture may aid in, e.g., preventing axial movement of the fins 818 and thereby the internal gun assembly 802. In an aspect, the ground contact plate 504 may extend to make grounding contact with the housing inner surface 1702 at a machined portion of the surface, which may be required for effective grounding contact. In an aspect, the internal gun assembly 802 may be assembled as discussed above and inserted into the housing 104 as a modular piece, locked in position by the fins 818, and therefore able to be delivered assembled and wired, to, e.g., a wellbore site, where the detonator 202 is inserted into the detonator holder 204 and electrical connections made by connecting the housing second end 108 to, without limitation, a tandem seal adapter connected to an adjacent perforating gun, as discussed further below. The centralizer alignment key 704 may be received by a centralizer key slot 1704 formed in the housing inner surface 1702, to orient the internal gun assembly 802 within the housing 104. In other words, the centralizer 302 may be engaged with the inner surface of the gun housing 104 via the centralizer alignment key 704. Alternatively, the centralizer 302 may be engaged with the inner surface of the gun housing 104 via contact between the centralizer ring 304 and the inner surface of the gun body 104.

In the exemplary embodiments, the tandem seal adapter 112 includes a tandem seal adapter bore 1802 extending through the tandem seal adapter 112. A bulkhead 1804 is sealingly received within the tandem seal adapter bore 1802. The bulkhead 1804 includes a bulkhead body 1806 that may be in contact with an inner circumferential surface bounding the tandem seal adapter bore 1802 within the tandem seal adapter 112. The bulkhead 1804 may further include one or more sealing assemblies 1808 positioned on the bulkhead body 1806 and in contact with the inner circumferential surface and forming a seal between the bulkhead body 1806 and the inner circumferential surface. For example, as shown in the exemplary embodiment, the sealing assembly 1808 may include one or more sealing mechanisms, such as elastomeric o-rings, respectively positioned in corresponding recesses on the bulkhead body 1806 and compressed against the inner circumferential surface. The sealing assembly 1808 may alone, or in combination with the bulkhead body 1806, seal the tandem seal adapter bore 1802, to isolate the interior of the housing 104 from, e.g., pressure or fluid from an interior of an adjacent, connected perforating gun housing. In addition, sealing assemblies 1808 on the tandem seal adapter 112 may create a seal against the housing inner surface 1702 at the housing first end 106, to seal the interior of the housing 104 from, e.g., wellbore fluid or other materials in the environment outside of the housing 104.

Figure 19:
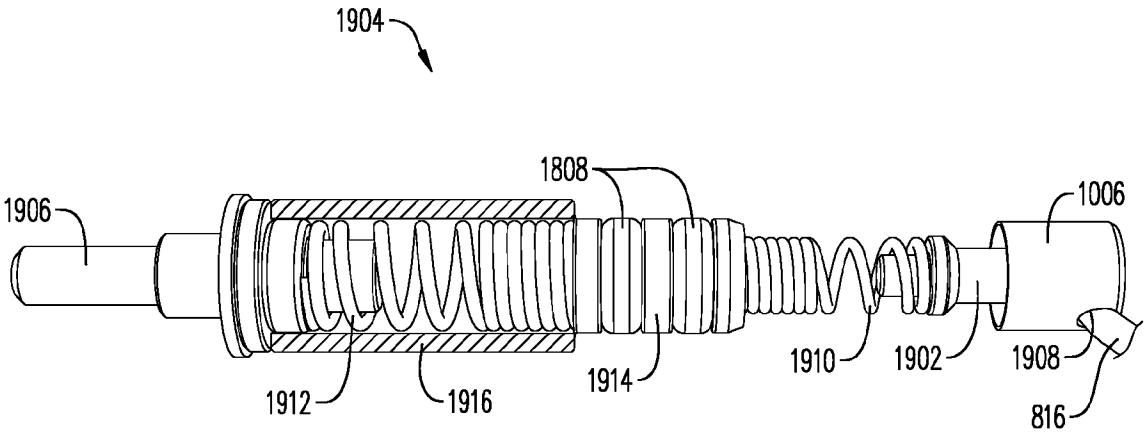
FIG. 19 is a side view an exemplary embodiment of a bulkhead electrical feedthrough in accordance with an aspect of the disclosure.
Figure 20:
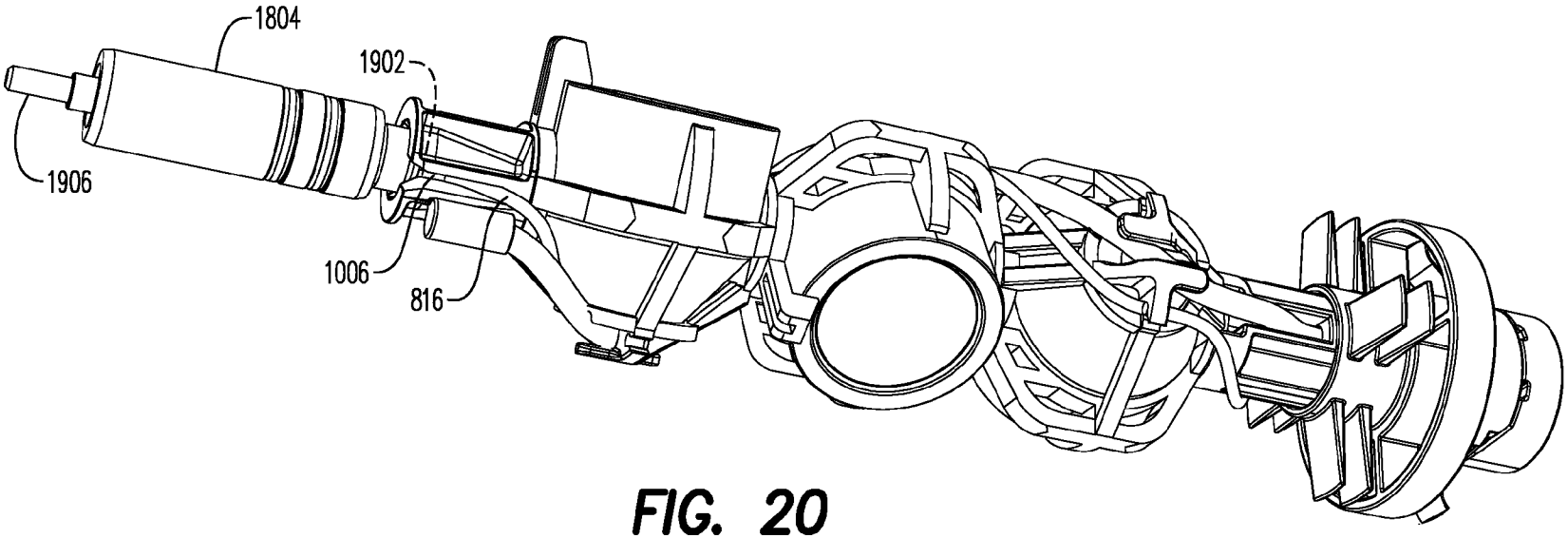
FIG. 20 is a perspective view of an exemplary embodiment of an internal gun assembly and a bulkhead in accordance with an aspect of the disclosure.

The bulkhead body 1806 houses at least a portion of a bulkhead electrical feedthrough 1904 for relaying electrical signals, such as an addressable detonation signal, a diagnostic signal, and the like, between respective electrical connections in adjacent perforating guns. The bulkhead electrical feedthrough 1904 may include, for example and as illustrated in FIG. 19, a first pin connector 1902 and a second pin connector 1906. The first pin connector 1902 may be positioned and dimensioned (i.e., configured) such that when the tandem seal adapter 112 is connected to the housing 104, the first pin connector 1902 is automatically placed in electrical contact with the conductive end contact 1006, at an end of the first pin connector 1902. The conductive end contact 1006 and/or the first pin connector 1902 may be in electrical contact with the signal relay wire 816 which may be inserted into a connecting hole 1908 on the conductive end contact 1006 or otherwise in electrical contact therewith, by known techniques. The second pin connector 1906 may be in electrical contact with an electrical connector in an adjacent perforating gun 102, as described below, at an end of the second pin connector.

FIG. 19 shows an interior of the bulkhead body 1806. The bulkhead electrical feedthrough 1904 may further include a first spring connector 1910 biasing the first pin connector 1902 towards the conductive end contact 1006. The first spring connector 1910 may be conductive and relay a signal from the first pin connector 1902 to a first intermediate conductive body 1914 within the bulkhead body 1806, and the first intermediate conductive body 1914 may be electrically connected to, or integrally formed with, a second intermediate conductive body 1916. Positioned adjacent to and in contact with the first intermediate conductive body 1916, and within the second intermediate conductive body 1916, may be a second spring connector 1912 biasing the second pin connector 1906 in a direction opposite the first pin connector 1902. The second spring connector 1912 is similarly conductive such that the first pin connector 1902 and the second pin connector 1906 are in electrical communication. In other embodiments, a solid piece of conductive metal may connect the first pin connector 1902 and the second pin connector 1906. In still other embodiments, the second intermediate conductive body 1916 may provide the electrical connection between the first pin connector 1902 and the second pin connector 1906. In embodiments in which the bulkhead electrical feedthrough 1904 includes a solid piece of conductive metal forming the first pin connector 1902, the second pin connector 1906, and an intermediate body, electrical contacts with which the pin connectors 1902, 1906 are in electrical contact within the perforating gun housings may be spring loaded.

In an aspect, the tandem seal adapter 112, bulkhead 1804, detonator holder 204, and detonator 202 are collectively configured and positioned such that when the tandem seal adapter 112 is connected to a housing detonator end 108 of an adjacent housing, the second pin connector 1906 of the bulkhead electrical feedthrough 1904 automatically makes wireless electrical contact with a line-in contact of the detonator 202. The detonator line-in contact receives the electrical signal that is relayed from the conductive end connector 808, through the bulkhead electrical feedthrough 1904.

Features and functions of the tandem seal adapter 112 and the bulkhead 1804 may be according to those disclosed in U.S. Pat. No. 10,844,697 issued Nov. 24, 2020, which is commonly owned by DynaEnergetics Europe GmbH and incorporated by reference herein, to the extent not incompatible or inconsistent with this disclosure.

Figure 21:
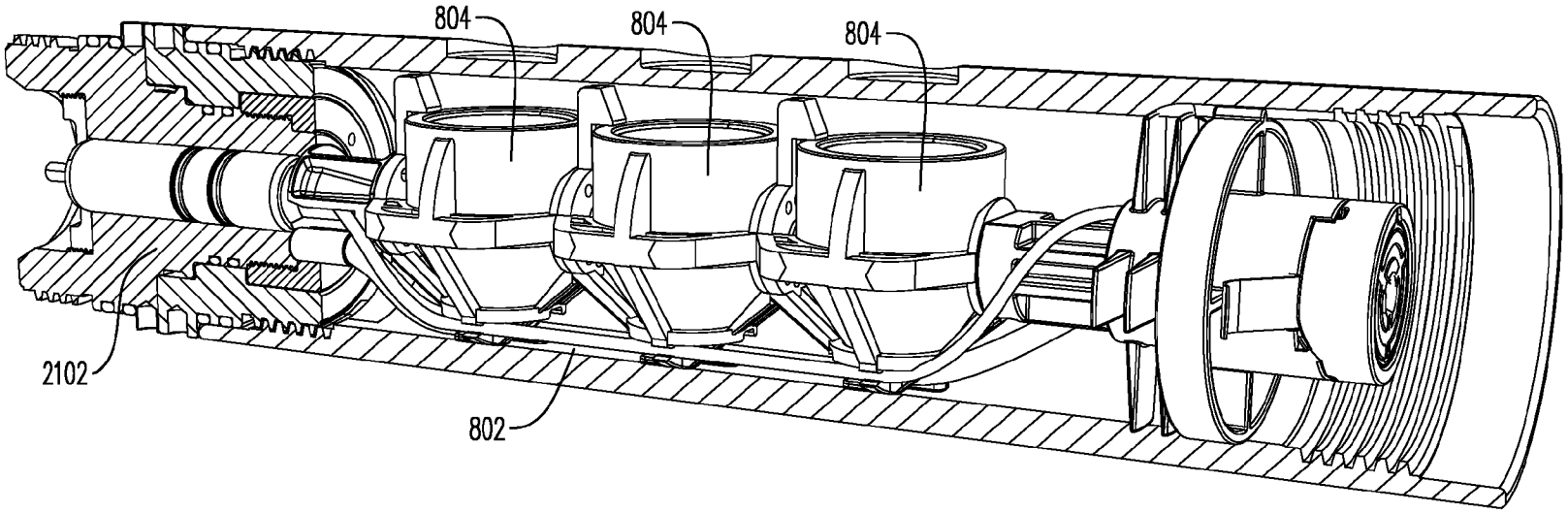
FIG. 21 is a perspective cutaway view of an exemplary embodiment of a modular platform perforating gun system according to an aspect of the disclosure.

FIG. 21 shows a modular platform perforating gun system according to the exemplary embodiments, in this case implemented with an alignment sub 2102 that functions according to the general principles of the exemplary tandem seal adapter 112 discussed above but also allows for adjacent housings to be oriented with respect to one another. In the exemplary embodiment shown in FIG. 21, each of the shaped charges 804 of the internal gun assembly 802 is pointing in the same direction, representing a zero-degree phasing.

Figure 22:
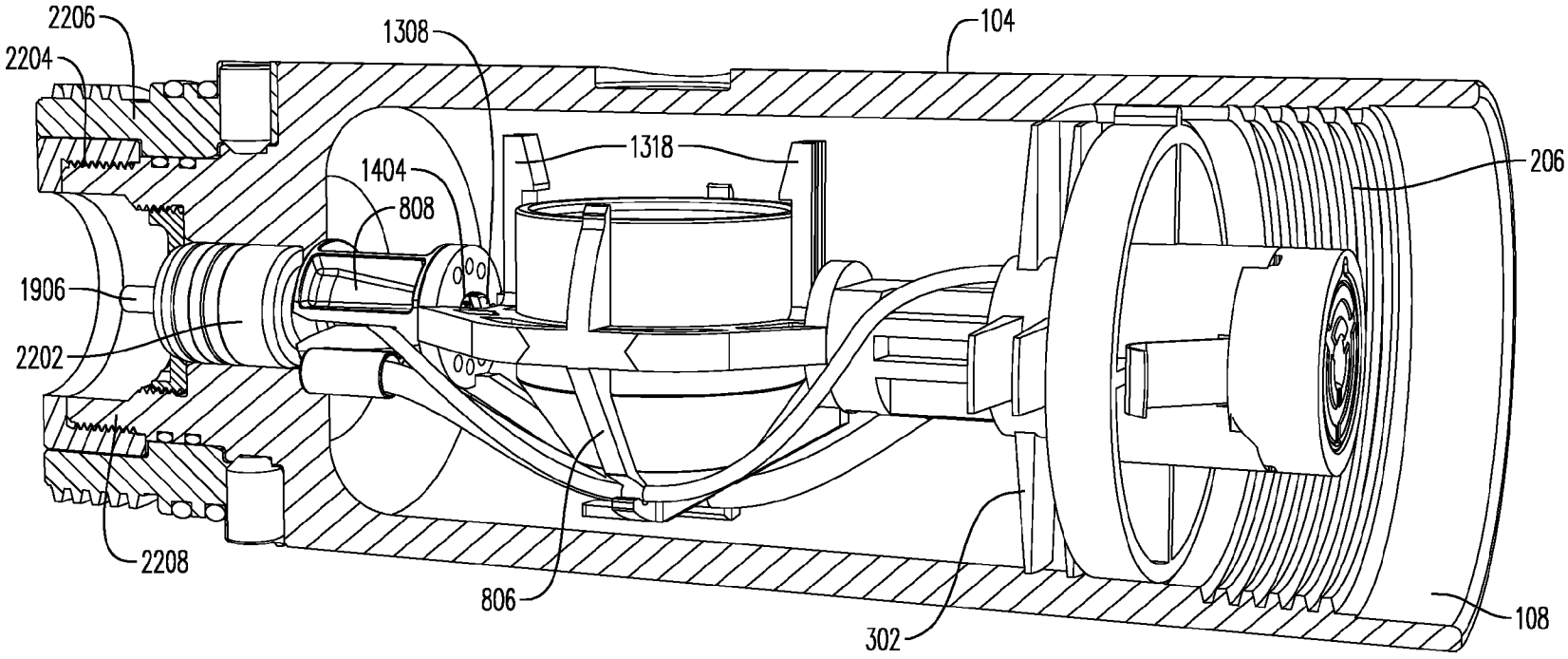
FIG. 22 is a perspective cutaway view of an exemplary embodiment of a modular platform perforating gun system according to an aspect of the disclosure.

FIG. 22 shows a modular perforating gun platform system according to the exemplary embodiments applied to a perforating gun having single shaped charge holder 806 positioned within a housing 104 including a housing detonator end 108 with internal threads 206 and a housing male end 2208 including external threads 2204 for connecting to an alignment sub 2206. The centralizer 302 and shaped charge holder 806 are green to indicate that the housing is a 2¾" housing 104*c*. In the exemplary embodiment shown in FIG. 22, a shortened bulkhead 2202 is used. The shortened bulkhead 2202 may be shorter in an axial direction but otherwise similar in form and function to the bulkhead 1804 discussed above. The shortened bulkhead 2202 includes a bulkhead electrical feedthrough including, among other things, second pin connector 1906. The shortened bulkhead 2202 may be used where, e.g., the perforating gun design including a tandem seal adapter or sub is dimensioned for a bulkhead with a shorter axial length than the exemplary bulkhead 1804 discussed with respect to, e.g., FIG. 17 and FIG. 18.

In an aspect, the shaped charge holder 806 includes two retention tabs 1318 for retaining a shaped charge in the shaped charge holder 806.

FIG. 22 further shows how, in an aspect, conductive end connector 808 includes a knob connector 1308 for connecting the conductive end connector 808 to the central bore 1404 of the shaped charge holder female connecting side 1402, and thereby the shaped charge holder 806.

Figure 23:
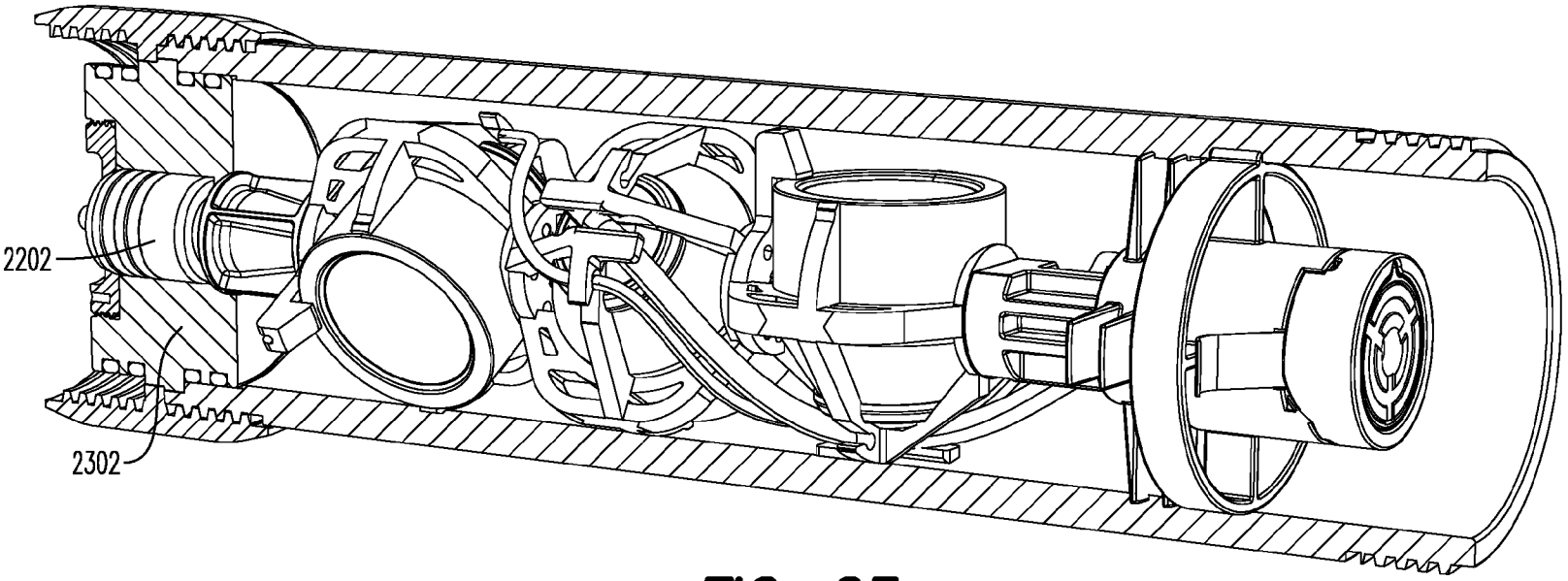
FIG. 23 is a perspective cutaway view of an exemplary embodiment of a modular platform perforating gun system according to an aspect of the disclosure.
Figure 24:
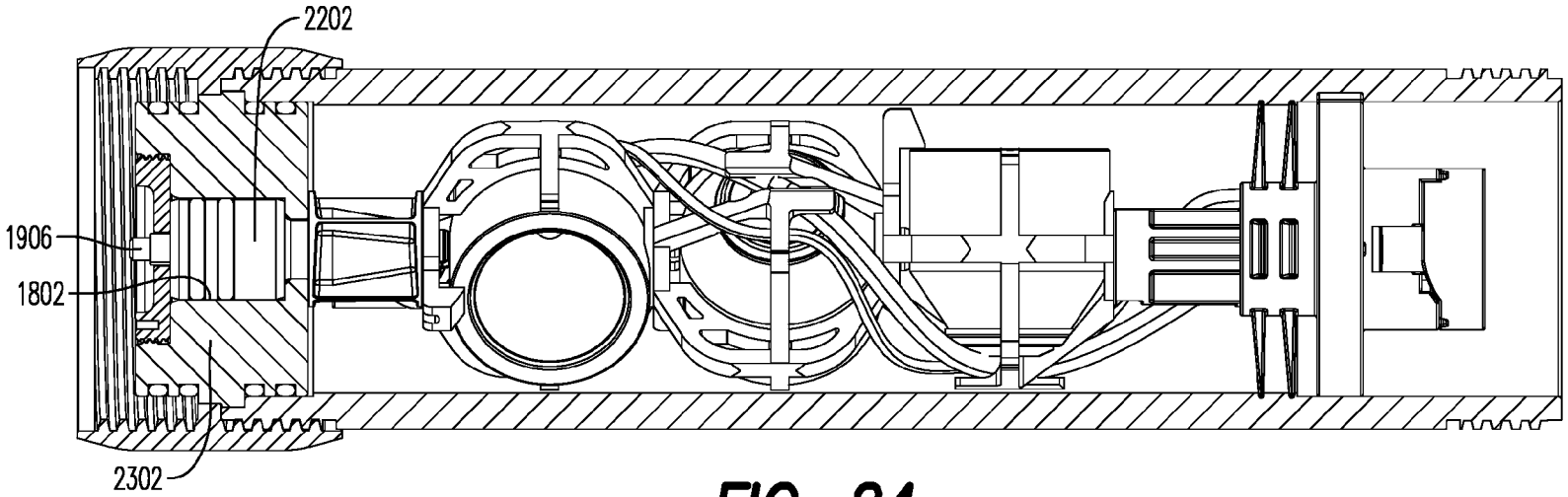
FIG. 24 is a side cutaway view of the exemplary embodiment of a modular platform perforating gun system shown in FIG. 23.

With reference to FIG. 23 and FIG. 24, the exemplary modular perforating gun platform system is shown applied to a perforating gun having a two-piece tandem seal adapter 2302. In an aspect, the exemplary embodiment of FIG. 23 and FIG. 24 also includes the shortened bulkhead 2202 with bulkhead electrical feedthrough including second pin connector 1906.

Figure 25:
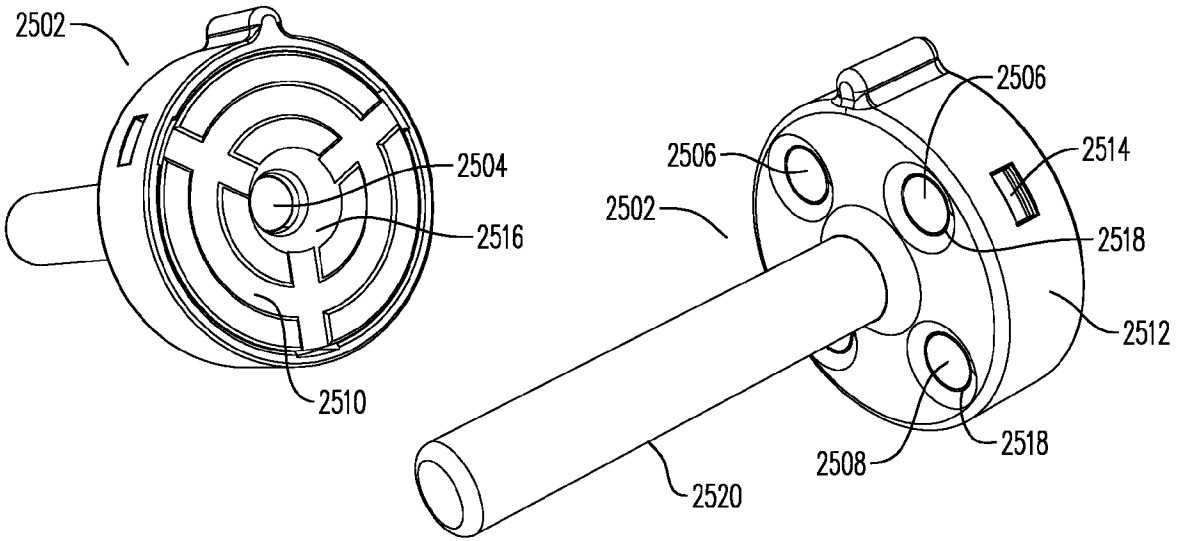
FIG. 25 shows perspective views of an exemplary embodiment of a detonator according to an aspect of the disclosure.
Figure 26:
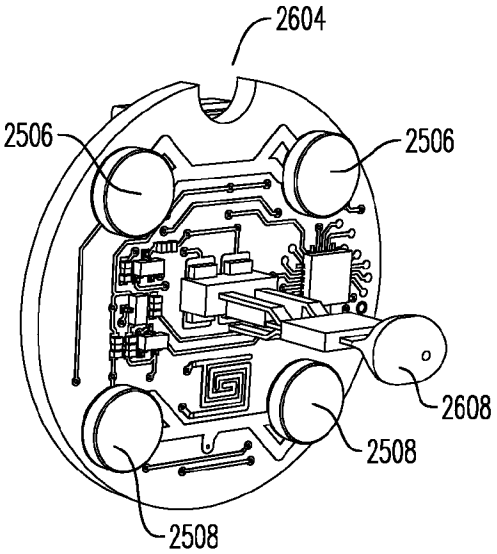
FIGS. 26 and 27 are perspective views of an exemplary embodiment of an initiator head according to an aspect of the disclosure.
Figure 26:
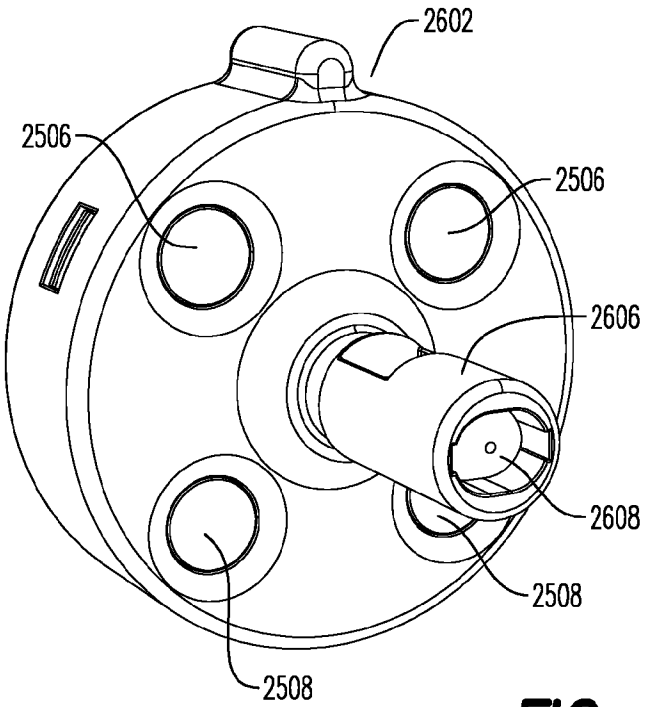
Figure 27:
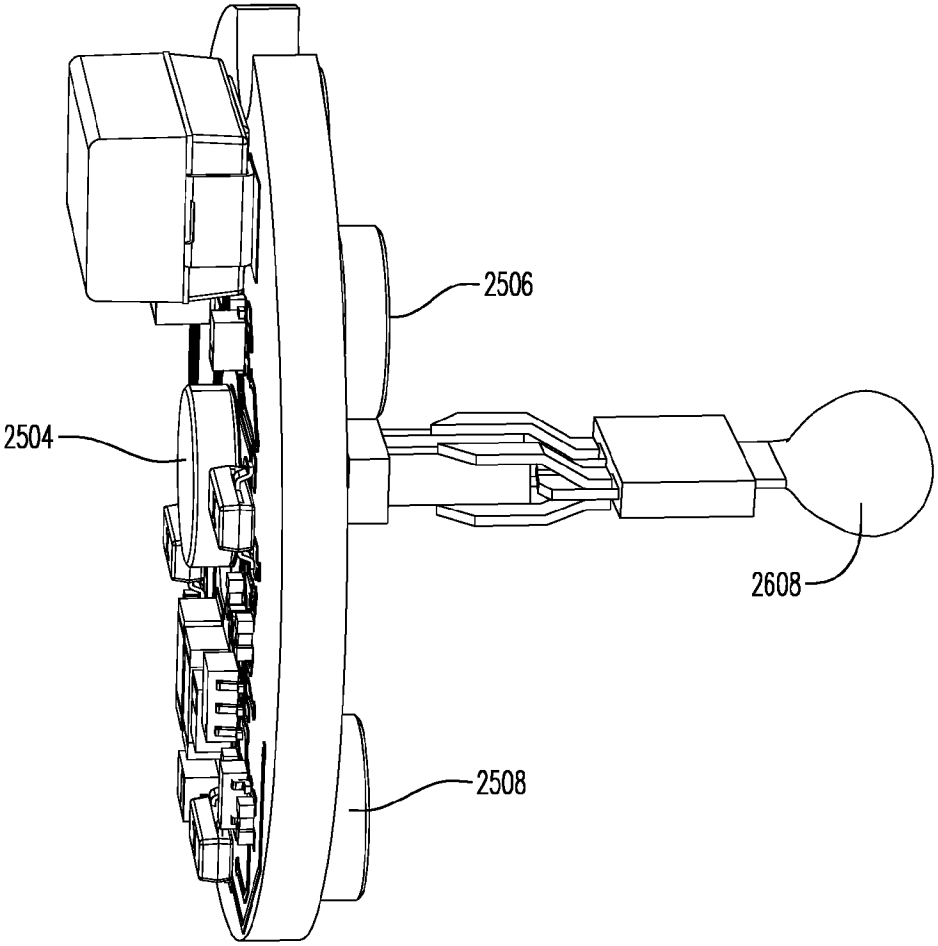

With reference to FIG. 25, FIG. 26, and FIG. 27, an exemplary embodiment of a detonator 202, such as an orienting detonator, for use with the exemplary modular platform perforating gun system is shown. FIG. 25 and FIG. 26 show, among other things, an exemplary embodiment of an initiator head 2502. The initiator head may include an initiator head housing 2602, a circuit board 2604, a line-in terminal 2504, a feedthrough (or, "line-out") terminal 2506, a ground terminal 2508, an initiator stem 2606, and a fuse 2608.

The initiator head housing 2602 may be formed of an insulating material, by, e.g., molding, 3D-printing, additive manufacturing, subtractive manufacturing, or any other suitable method. The initiator head housing 2602 may include a first housing piece 2510 and a second housing piece 2512 engaged together by a latch 2514. The initiator head housing 2602 may define an interior space within the first housing piece 2510 and the second housing piece 2512 within which the circuit board 2604 is positioned. Alternatively, the initiator head housing 2602 may be an integral or monolithic piece molded or additively manufactured around the circuit board 2604.

A through hole 2516 in the first housing piece 2510 may be structured to expose the line-in terminal 2504 to an exterior of the initiator head housing 2502. The second housing piece 2512 may include contact through holes 2518 structured to expose the feedthrough terminals 2506 and the ground terminals 2508 to an exterior of the initiator head housing 2502. The line-in terminal 2504, the feedthrough terminals 2506, the ground terminals 2508, and the fuse 2608 may be in electrical communication with the circuit board 2604. The line-in terminal 2504 may be provided on an opposite side of the circuit board 2604 from the feedthrough terminals 2506 and the ground terminals 2508. The circuit board 2604 may further include surface mounted components such as a temperature sensor, an orientation sensor, a safety circuit, a capacitor, and the like. Readings from one of these components may be used by a microprocessor on the circuit board 2604 to determine when it is appropriate to activate the fuse 2608 to detonate the detonator 202.

The fuse 2608 may be positioned within a hollow interior of the initiator stem 2606. The initiator stem 2606 may be received within a hollow initiator shell 2520 and crimped therein. The detonator explosive portion 1104 may be an explosive load positioned within the hollow initiator shell 2520 and configured for initiation by the fuse 2608. With reference back to FIG. 11, the hollow initiator shell 2520 is received within the detonator bore 1106, when the detonator 202 is inserted into the detonator holder 204. The detonator bore 1106, hollow initiator shell 2520, initiator head housing 2602, and detonator holder cap 516 are together configured for the initiator head housing 2602 to be received in the detonator holder cap 516 when the detonator 202 is inserted into the detonator holder 204, including when the hollow initiator shell 2520 is pushed into the detonator bore 1106. Upon inserting the detonator 202 into the detonator holder 204, feedthrough terminals 2506 and ground terminals 2508 are respectively positioned for automatically making wireless electrical contact with the feedthrough contact pins 604 and the ground contact pins 602.

Accordingly, as discussed above, when, e.g., a pin connector such as second pin connector 1906 from a bulkhead electrical feedthrough 1904 makes wireless electrical contact with the line-in terminal 2504, an electrical signal from the bulkhead electrical feedthrough 1904 may be relayed to the circuit board 2604 which may, e.g., detonate the detonator 202 and/or relay the signal, via the feedthrough terminal(s) 2506, feedthrough contact plate 502, signal relay wire 816, and conductive end contact 1006, to a next bulkhead or electrical feedthrough assembly.

This disclosure, in various embodiments, configurations and aspects, includes components, methods, processes, systems, and/or apparatuses as depicted and described herein, including various embodiments, sub-combinations, and subsets thereof. This disclosure contemplates, in various embodiments, configurations and aspects, the actual or optional use or inclusion of, e.g., components or processes as may be well-known or understood in the art and consistent with this disclosure though not depicted and/or described herein.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

In this specification and the claims that follow, reference will be made to a number of terms that have the following meanings. The terms "a" (or "an") and "the" refer to one or more of that entity, thereby including plural referents unless the context clearly dictates otherwise. As such, the terms "a" (or "an"), "one or more" and "at least one" can be used interchangeably herein. Furthermore, references to "one embodiment", "some embodiments", "an embodiment" and the like are not intended to be interpreted as excluding the existence of additional embodiments that also incorporate the recited features. Approximating language, as used herein throughout the specification and claims, may be applied to modify any quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Terms such as "first," "second," "upper," "lower" etc. are used to identify one element from another, and unless otherwise specified are not meant to refer to a particular order or number of elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of." Where necessary, ranges have been supplied, and those ranges are inclusive of all sub-ranges therebetween. It is to be expected that the appended claims should cover variations in the ranges except where this disclosure makes clear the use of a particular range in certain embodiments.

The terms "determine", "calculate" and "compute," and variations thereof, as used herein, are used interchangeably and include any type of methodology, process, mathematical operation or technique.

Reference to a "detonator holder and/or detonator" herein refers to at least one of a detonator holder and a detonator, and may be termed a detonation-related element for more convenient reference.

This disclosure is presented for purposes of illustration and description. This disclosure is not limited to the form or forms disclosed herein. In the Detailed Description of this disclosure, for example, various features of some exemplary embodiments are grouped together to representatively describe those and other contemplated embodiments, configurations, and aspects, to the extent that including in this disclosure a description of every potential embodiment, variant, and combination of features is not feasible. Thus, the features of the disclosed embodiments, configurations, and aspects may be combined in alternate embodiments, configurations, and aspects not expressly discussed above. For example, the features recited in the following claims lie in less than all features of a single disclosed embodiment, configuration, or aspect. Thus, the following claims are hereby incorporated into this Detailed Description, with each claim standing on its own as a separate embodiment of this disclosure.

Advances in science and technology may provide variations that are not necessarily express in the terminology of this disclosure although the claims would not necessarily exclude these variations.

What is claimed is:

1. A system for use within a gun housing of a perforating gun, the system comprising:

a centralizer comprising:

a centralizer body; and a centralizer bore extending through the centralizer body;

a detonator holder disposed within the centralizer bore, the detonator holder comprising:

a first detonator holder end configured to receive a detonator;

a second detonator holder end comprising a detonator holder coupling;

a detonator holder cap provided at the first detonator holder end and protruding from a first end of the centralizer body;

a ground plate slot formed in the detonator holder; and a ground contact plate having a first portion disposed within the detonator holder cap and a second portion extending through the ground plate slot;

wherein the first portion of the ground contact plate is configured to be in electrical communication with a ground terminal of the detonator; and wherein the detonator holder extends through the centralizer and is mechanically coupled to the centralizer; and the centralizer is configured to engage with an inner surface of the gun housing.

2. The system of claim 1, wherein the detonator holder comprises:

a detonator holder stem extending from the detonator holder cap along a longitudinal axis and protruding from a second end of the centralizer body; and a detonator holder bore extending through the detonator holder stem, the detonator holder bore being configured to receive at least a portion of the detonator;

wherein the second detonator holder end is provided at an end of the detonator holder stem opposite the detonator holder cap.

3. The system of claim 2, further comprising:

a feedthrough plate slot formed in the detonator holder; and a feedthrough contact plate having a first portion disposed within the detonator holder cap and a second portion extending through the feedthrough plate slot;

wherein the first portion of the feedthrough contact plate is configured to be in electrical communication with a feedthrough terminal of the detonator.

4. The system of claim 3, further comprising a signal relay wire having a first end in electrical communication with the second portion of the feedthrough contact plate.

5. The system of claim 2, wherein the detonator holder further comprises a locking tab protruding axially from the detonator holder cap, the locking tab being configured to couple with a tab locking structure of the centralizer body.

6. The system of claim 1, wherein the second portion of the ground contact plate is in electrical contact with the inner surface of the gun housing.

7. The system of claim 1, further comprising a charge holder module coupled to the detonator holder coupling at a first end of the charge holder module, the charge holder module being configured to receive a shaped charge.

8. The system of claim 7, wherein the charge holder module comprises a shaped charge holder comprising:

a first shaped charge holder coupling provided at a first end of the shaped charge holder;

a second shaped charge holder coupling provided at a second end of the shaped charge holder; and a receptacle for receiving the shaped charge;

wherein the first shaped charge holder coupling is configured to detachably couple with the detonator holder coupling and rotationally fix the first shaped charge holder relative to the detonator holder.

9. The system of claim 7, wherein the charge holder module comprises a plurality of shaped charge holders, each shaped charge holder of the plurality of shaped charge holders comprising:

a first shaped charge holder coupling provided at a first end of the shaped charge holder;

a second shaped charge holder coupling provided at a second end of the shaped charge holder; and a receptacle for receiving a first shaped charge;

wherein the first shaped charge holder coupling of a first shaped charge holder of the plurality of shaped charge holders is coupled with the detonator holder coupling, and the first shaped charge holder coupling of a second shaped charge holder adjacent to the first shaped charge holder is coupled with the second shaped charge holder coupling of the first shaped charge holder.

10. The system of claim 9, wherein the first shaped charge holder coupling and the second shaped charge holder coupling are configured such that a phasing between the first shaped charge holder and the second shaped charge holder is selectable by a user.

11. The system of claim 10, wherein:

the first shaped charge holder coupling comprises a protrusion;

the second shaped charge holder coupling comprises a plurality of holes arranged circumferentially around a longitudinal axis; and each hole of the plurality of holes is dimensioned to receive the protrusion.

12. The system of claim 7, further comprising an end connector coupled to a second end of the charge holder module opposite the first end of the charge holder module, the end connector comprising a conductive end contact.

13. The system of claim 12, wherein:

the detonator holder further comprises a feedthrough contact plate configured to be in electrical communication with a feedthrough terminal of the detonator; and a signal relay wire is connected between the feedthrough contact plate and the conductive end contact.

14. The system of claim 1, wherein:

the centralizer is one of set of a plurality of centralizers;

each centralizer of the plurality of centralizers has a different outer diameter configured to fit different sizes of perforating gun housings; and each centralizer of the plurality of centralizers is configured to receive the detonator holder.

15. The system of claim 1, wherein the centralizer further comprises:

an outer centralizer ring; and a plurality of spokes extending from the centralizer body to the outer centralizer ring;

wherein the outer centralizing ring is configured to engage with the inner surface of the gun housing.

16. A perforating gun comprising:

a gun housing:

a centralizer disposed within the gun housing, the centralizer comprising:

a centralizer body; and a centralizer bore extending through the centralizer body;

a detonator holder disposed within the centralizer bore, the detonator holder comprising:

a first detonator holder end configured to receive a detonator;

a second detonator holder end comprising a detonator holder coupling;

a detonator holder cap provided at the first detonator holder end and protruding from a first end of the centralizer body;

a feedthrough contact plate configured to be in electrical communication with a feedthrough terminal of the detonator;

a ground plate slot formed in the detonator holder; and a ground contact plate configured to be in electrical communication with a ground terminal of the detonator, the ground contact plate being in electrical communication with an inner surface of the gun housing and having a first portion disposed within the detonator holder cap and a second portion extending through the ground plate slot;

wherein the first portion of the ground contact plate is configured to be in electrical communication with a ground terminal of the detonator; and a charge holder module having a first end coupled to the detonator holding coupling;

an end connector coupled to a second end of the shaped charge module opposite the first end of the shaped charge module, the end connector comprising a conductive end contact; and a signal relay wire in electrical communication with the feedthrough contact plate and the conductive end contact;

wherein the detonator holder extends through the centralizer and is mechanically coupled to the centralizer; and the centralizer is configured to engage with an inner surface of the gun housing.

17. The perforating gun of claim 16, wherein the centralizer further comprises:

an outer centralizer ring; and a plurality of spokes extending from the centralizer body to the outer centralizer ring;

wherein the outer centralizing ring is configured to engage with the inner surface of the gun housing.

18. The perforating gun of claim 16, the detonator holder comprising:

a detonator holder stem extending from the detonator holder cap along a longitudinal axis;

a detonator holder bore extending through the detonator holder stem;

a feedthrough plate slot formed in the detonator holder; and a feedthrough contact plate having a first portion disposed within the detonator holder cap and a second portion extending through the feedthrough plate slot.

19. The perforating gun of claim 18, further comprising a locking tab extending from the detonator cap along the longitudinal axis, the locking tab being configured to couple with a centralizer.

* * * * *